US009828124B2

(12) United States Patent
Wissner et al.

(10) Patent No.: US 9,828,124 B2
(45) Date of Patent: Nov. 28, 2017

(54) PROCESS AND APPARATUS FOR TREATING CONTAINERS FOR STORING SUBSTANCES FOR MEDICAL, PHARMACEUTICAL OR COSMETIC APPLICATIONS

(71) Applicant: SCHOTT AG, Mainz (DE)

(72) Inventors: Kai Wissner, Hirschberg (DE); Edgar Pawlowski, Stadecken-Elsheim (DE); Gregor Fritz Deutschle, Wiesbaden (DE); Kristopher Koch, Lebanon, PA (US)

(73) Assignee: SCHOTT AG, Mainz (DE)

( * ) Notice: Subject to any disclaimer, the term of this patent is extended or adjusted under 35 U.S.C. 154(b) by 2 days.

(21) Appl. No.: 14/995,927

(22) Filed: Jan. 14, 2016

(65) Prior Publication Data

US 2016/0130022 A1 May 12, 2016

Related U.S. Application Data

(63) Continuation of application No. 14/398,541, filed as application No. PCT/EP2013/059183 on May 2, 2013, now Pat. No. 9,522,752.

(Continued)

(30) Foreign Application Priority Data

May 3, 2012 (DE) ..... 10 2012 103 899
Jul. 13, 2012 (DE) ..... 10 2012 106 341

(Continued)

(51) Int. Cl.

| | |
|---|---|
| ***F26B 5/06*** | (2006.01) |
| ***B65B 7/28*** | (2006.01) |
| ***B65B 43/42*** | (2006.01) |

(52) U.S. Cl.
CPC ..... *B65B 7/2892* (2013.01); *B65B 43/42* (2013.01); *F26B 5/06* (2013.01)

(58) Field of Classification Search
CPC ..... F26B 5/06; B65B 43/42; B65B 7/2892

(Continued)

(56) References Cited

U.S. PATENT DOCUMENTS 2,140,314 A 12/1938 Doscher
3,243,049 A 3/1966 Seligmann, Jr. et al.

(Continued)

FOREIGN PATENT DOCUMENTS

CH 343881 A 2/1960
CN 101663228 A 3/2010

(Continued)

OTHER PUBLICATIONS

International Search Report dated Oct. 17, 2013 for corresponding International Patent Application No. PCT/EP2013/059183 with English translation, 9 pages.

(Continued)

*Primary Examiner* — Stephen M Gravini
(74) *Attorney, Agent, or Firm* — Ohlandt, Greeley, Ruggiero & Perle, L.L.P.

(57) ABSTRACT

A process and apparatus are provided for treating or processing containers that are used for storing substances for medical, pharmaceutical or cosmetic applications or contain the same. During the process, cylindrical containers open at least at one end are automatically led past or pass through processing stations for treatment or processing by means of a conveying device, while the containers are jointly held by a carrier in a regular two-dimensional arrangement. The carrier includes a plurality of openings or receptacles that determine the regular arrangement. The treatment or processing of the containers is performed on or in at least one (Continued)

of the processing stations while the containers are supported by the carrier.

16 Claims, 64 Drawing Sheets

Related U.S. Application Data

(60) Provisional application No. 61/642,125, filed on May 3, 2012, provisional application No. 61/696,457, filed on Sep. 4, 2012.

(30) Foreign Application Priority Data

Sep. 4, 2012 (DE) ..... 10 2012 108 215
Nov. 5, 2012 (DE) ..... 10 2012 110 547

(58) Field of Classification Search
USPC ..... 34/284
See application file for complete search history.

(56) References Cited

U.S. PATENT DOCUMENTS

| | | | | |
|---|---|---|---|---|
| 3,537,189 | A | 11/1970 | Bender et al. | |
| 4,040,234 | A | 8/1977 | Stockdale et al. | |
| 4,286,389 | A | 9/1981 | Ogle | |
| 5,964,043 | A | 10/1999 | Oughton et al. | |
| 6,843,357 | B2 * | 1/2005 | Bybee | B25J 18/04 198/345.3 |
| 7,428,807 | B2 | 9/2008 | Bush | |
| 8,100,263 | B2 | 1/2012 | Vanderbush et al. | |
| 8,118,167 | B2 | 2/2012 | Togashi et al. | |
| 9,522,752 | B2 * | 12/2016 | Wissner | F26B 5/06 |
| 9,695,029 | B2 * | 7/2017 | Clusserath | B67C 3/242 |
| 2001/0002984 | A1 | 6/2001 | Vetter | |
| 2001/0052476 | A1 | 12/2001 | Heinz et al. | |
| 2003/0037514 | A1 * | 2/2003 | Hartness | B65B 21/183 53/471 |
| 2004/0250441 | A1 | 12/2004 | Haseley et al. | |
| 2007/0272587 | A1 | 11/2007 | Nguyen et al. | |
| 2010/0058711 | A1 | 3/2010 | Blumenstock et al. | |
| 2011/0173930 | A1 | 7/2011 | Poutot | |
| 2011/0277419 | A1 | 11/2011 | Nicoletti | |
| 2012/0090268 | A1 | 4/2012 | Krauss et al. | |
| 2013/0161225 | A1 | 6/2013 | Lepot | |
| 2013/0186793 | A1 | 7/2013 | Gagnieux | |
| 2015/0013277 | A1 * | 1/2015 | Brandhorst | B65B 35/18 53/475 |
| 2016/0130022 | A1 * | 5/2016 | Wissner | F26B 5/06 53/486 |

FOREIGN PATENT DOCUMENTS

| | | | | |
|---|---|---|---|---|
| CN | 102083697 | | 6/2011 | |
| DE | 2658432 | A1 | 7/1977 | |
| DE | 3819095 | A1 | 12/1989 | |
| DE | 3908582 | A1 | 9/1990 | |
| DE | 10012575 | A1 | 9/2001 | |
| DE | 102007042218 | A1 | 3/2009 | |
| DE | 102009027452 | A1 | 1/2011 | |
| DE | KR 20150009982 | A * | 1/2015 | F26B 5/06 |
| EP | 1449551 | A1 | 8/2004 | |
| EP | 2119463 | A1 | 11/2009 | |
| GB | 295672 | A | 8/1928 | |
| GB | 590421 | A | 7/1947 | |
| JP | 2004537025 | A | 12/2004 | |
| WO | 2009015862 | A1 | 2/2009 | |
| WO | 2010086128 | A1 | 8/2010 | |
| WO | 2011000606 | A1 | 1/2011 | |
| WO | 2011015896 | A1 | 2/2011 | |
| WO | 2011135085 | A1 | 11/2011 | |
| WO | 2014033766 | A1 | 3/2014 | |

OTHER PUBLICATIONS

English translation of Written Opinion of the International Searching Authority dated Oct. 17, 2013 for corresponding International Patent Application No. PCT/EP2013/059183, 10 pages.
English translation of the International Preliminary Report on Patentability dated Nov. 4, 2014 for corresponding International Patent Application No. PCT/EP2013/059183, 11 pages.
English Translation of the International Search Report dated Sep. 2, 2013 for corresponding International Application No. PCT/EP2013/059297, 2 pages.
Written Opinion of the International Searching Authority dated Sep. 2, 2013 for corresponding International Application No. PCT/EP2013/059297 with English Translation, 7 pages.
English Translation of the International Preliminary Report on Patentability dated Jan. 13, 2015 for corresponding International Application No. PCT/EP2013/059297, 6 pages.

* cited by examiner

180

25

1

A-A

PROCESS AND APPARATUS FOR TREATING CONTAINERS FOR STORING SUBSTANCES FOR MEDICAL, PHARMACEUTICAL OR COSMETIC APPLICATIONS

CROSS REFERENCE TO RELATED APPLICATIONS

This application is a divisional of U.S. application Ser. No. 14/398,541 filed on 3 Nov. 2014 (the '541 application). The '541 application is a national stage application of International Application No. PCT/EP2013/059183 filed on 2 May 2013 (the '183 application). The '183 application claims benefit under 35 U.S.C. §119(a) of German Patent Application No. 10 2012 103 899.6 filed on 3 May 2012, German patent Application No. 10 2012 106 341.9 filed on 13 Jul. 2012, German Patent Application No. 10 2012 108 215.4 filed on 4 Sep. 2012, and German Patent Application No. 10 2012 110 547.2 filed on 5 Nov. 2012. Additionally, the '183 application claims the benefit of U.S. Provisional Application Ser. No. 61/642,125 filed on 3 May 2012 and U.S. Provisional Application Ser. No. 61/696,457 filed on 4 Sep. 2012. The entire contents of all of which are hereby expressly incorporated herein by reference.

BACKGROUND OF THE INVENTION

1. Field of the Invention

The present invention relates generally to the concurrent treatment or processing of containers, which serve for storing substances for cosmetic, medical or pharmaceutical applications, in particular of vials containing active ingredients or solutions with active ingredients, and more particularly to the concurrent automatic conveyance and transfer of a plurality of containers to processing stations, e.g. a filling or processing station, a sterile tunnel, a freeze-dryer for freeze-drying (lyophilization) of a liquid containing an active ingredient or the like.

2. Description of Related Art

Medication containers, for example vials, ampoules or carpoules, are widely used as containers for preservation and storage of medical, pharmaceutical or cosmetic preparations to be administered in liquid form, in particular in pre-dosed amounts. These generally have a cylindrical shape, can be made of plastic or glass and are available in large quantities at low costs. In order to fill the containers under sterile conditions as efficiently as possible concepts are increasingly used according to which the containers are already packaged in a transport or packaging container at the manufacturer of the containers under sterile conditions, which are then unpacked and further processed at a pharmaceutical company under sterile conditions, in particular in a so-called sterile tunnel.

For this purpose, various transport and packaging containers are known from the prior art, in which a plurality of medication containers are concurrently arranged in a regular arrangement, for example in a matrix arrangement along rows and columns extending perpendicular thereto. This has advantages in the automated further processing of the containers since the containers can be transferred to processing stations at controlled positions and in a predetermined arrangement, for example to processing machines, robots or the like. For this purpose, supporting structures are used, in which a plurality of containers can be supported concurrently in a predetermined regular arrangement. For the transfer to a processing station it is just required to properly position and open the transport and packaging container. The downstream processing station will then know at what position and in what arrangement the containers to be processed further are arranged.

Such a transport and packaging container and a corresponding packaging concept are disclosed for example in U.S. Pat. No. 8,118,167 B2. The further processing of the containers is, however, always performed such that the supporting structure will be removed from the transport and packaging container, that the containers will be removed from the supporting structure and isolated and then individually placed on a conveyor, in particular a conveyor belt, and transferred to the processing stations for further processing. This limits the speed of processing that can be achieved. Particularly in the isolation of the containers by means of cell wheels or the like, it always occurs that individual containers abut uncontrolled, which results in an undesired abrasion and subsequently in a contamination of the interior volume of the containers or of the processing station and in an impairment of the outer appearance of the containers which is undesirable.

U.S. Pat. No. 8,100,263 B2 discloses a portable transport and packaging container that can be packed in a sterile manner, in which a plate-shaped supporting structure can be inserted in which a plurality of medication containers are held in a regular arrangement. Firstly, the individual medication containers are placed loosely in receptacles, which are formed in the supporting structure. Then, the supporting structure is placed in the transport and packaging container, which is then surrounded by a gas-impermeable plastic tube. Upon subsequent evacuation of the packaging unit thus formed, the plastic tube is pressed into the spaces between the medication containers due to the negative pressure prevailing in the tube, which, on the one hand, results in a stabilization of the positions of the medication containers in the supporting structure and, on the other hand, in a prevention of further uncontrolled collisions of adjacent medication containers. During the evacuation and the subsequent opening of the plastic tube, however, the medication containers may slip sideways, increasing the efforts required for automation for processing further the medication containers. In addition, the medication containers may still collide uncontrollably after opening of the plastic tube, resulting in the aforementioned disadvantages. The medication containers cannot be processed further while being in the transport or packaging container or in the supporting structure, but must be isolated first in the conventional manner and handed over to downstream processing stations.

Other comparable transport and packaging containers and supporting structures are disclosed in WO 2011/135085 A1, US 2011/0277419 A1, WO 2012/025549 A1, WO 2011/015896 A1, WO 2012/007056 A1 and WO 2009/015862 A1.

However, for further processing the medication containers must always be isolated. This is exemplified with reference to FIG. 1, which is a schematic flow diagram of a conventional method for freeze-drying of pharmaceutical preparations in medication containers, as disclosed e.g. in U.S. Pat. No. 5,964,043.

First, the processing apparatus, namely a sterile tunnel, is charged with the vials. For this purpose, the vials are mounted upside down in transport frames, which are then conveyed through the processing apparatus. For a pretreatment, the vials supported in the transport frames are sterilized. Subsequently, the transport frames together with the vials supported are turned and then filled with a drug solution. Then, a stopper is placed on the upper rim of the vial, in which a channel is formed, wherein the inner volumes of the vials respectively communicate with the chamber of the freeze-dryer during the freeze-drying process.

For freeze-drying (also known as lyophilization or sublimation drying), the vials are then removed from the transport frame and individually fed into the freeze-dryer. The bottoms of the vials must be placed directly on a planar cooling bottom in order to achieve a good cooling effect. If no direct contact over the entire surface is ensured at this stage, this results in a significant extension of the freeze-drying process, resulting in higher costs.

After lyophilization, the vials are removed from the freeze-dryer, the stoppers are pushed down and a metal lid is put onto the stoppers and crimped. Vials processed in this manner are then shipped, for example by accommodating a plurality of vials in a common supporting structure and then inserting the supporting structure into a transport and packaging container, which is then sterile packaged for delivery.

The direct contact between the bottoms of the drug containers and the cooling bottom required for the freeze-drying process conventionally requires a treatment or processing of individual containers, which increases the processing and packaging costs. According to the prior art, a batch further-processing of drug containers is not possible. In any case, a direct contact of the bottoms of the drug containers, in particular of the bottoms of vials, is not possible in conventional supporting structures.

SUMMARY

It is an object of the present invention to further enhance a process for the treatment or processing of containers, which serve for storing substances for cosmetic, medical or pharmaceutical applications such that it can be carried out even faster and more economically, that it can be automatized in an easy manner and that it can be carried out more reliably. According to a preferred further aspect of the present invention a corresponding apparatus for the treatment or processing of such containers is to be provided.

According to the present invention, this problem is solved by a process with the features of claim 1 and by an apparatus according to claim 28. Further advantageous embodiments are the subject-matter of the dependent claims.

In a process for the treatment or processing of containers, which serve for storing substances for cosmetic, medical or pharmaceutical applications or contain such substances, in particular of vials, the containers are conveyed, by means of a conveyor, automatically past processing stations or pass them, wherein a plurality of containers is conveyed by the conveyor while being supported together by a supporting structure in a regular two-dimensional array, and wherein the supporting structure has a plurality of openings or receptacles, which define the array. According to the present invention the treatment or processing of the containers is carried out at or in at least one of the processing stations, while the containers are supported by the supporting structure.

Thus, according to the present invention the containers can be treated or processed in batches. A removal from the supporting structure or a separation, which conventionally make the processes complex, is not required according to the present invention. For this purpose, according to the present invention the supporting structure is configured such that the containers can be held in a positive-fit manner or by frictional engagement. In particular, the containers are supported in openings or receptacles of the supporting structure that are formed suitably for this purpose.

Preferably, side wall portions and/or bottoms of the containers, while being supported by the supporting structure, are freely accessible at least for the most part so that the container can be easily handled on the supporting structure. For example, the bottoms of the containers may be fully accessible or for the most part, i.e. they are not covered by a supporting structure or the like, while they are supported at the supporting structure. Thus, the supporting structures together with the containers can be placed, for example, on a cooling bottom of a freeze-dryer, so that a full-area contact is ensured for an efficient cooling. Conveniently, all containers are supported at the supporting structure at the "same level" for this purpose.

According to a further embodiment, the supporting structures can be configured such that the containers, while being supported by them, can be displaced or rotated or adjusted or moved in a similar manner. This can be ensured easily by an appropriate design of the positive-fit or frictional engagement. Thus, the containers can by rotated while they are supported on the supporting structure, for example, for crimping a metal lid which is placed on the upper rim.

According to a further embodiment, the containers can be displaced in the respective opening or receptacle of the supporting structure in a longitudinal direction thereof to a raised position for the treatment or processing at or in the processing station, in which the further treatment or processing is then facilitated. For example, in this raised position the bottoms of the containers can be fully accessible, or the upper ends of the containers may project beyond the upper edge of the supporting structure or of a transport and packaging container to a suitable extent so that a treatment or processing is possible only in the raised position.

Conveniently, the containers are supported in this raised position in the region of their cylindrical side wall or of a constricted neck portion below the upper rim or at their upper rim, which may depend on the particular processing station.

According to a further embodiment, the containers continue to be accommodated in the openings or receptacles of the supporting structure in the raised position, however, are supported on an additional supporting surface or by an additional holding or gripping device to be treated or processed at or in the processing station. The holding means on the supporting structure are configured such that they do not support the containers in the raised position, in any case not with a holding force which is sufficient and in correspondence with the weight of the containers. However, also in this embodiment, the containers do not need to be completely removed from the supporting structure, so that they can continue to be treated or processed in batches, but can nevertheless be transferred to a subsequent processing step more rapidly. The aforementioned holding or gripping device may be for example a robot arm of a processing apparatus controlled fully automatically.

Particularly, the aforementioned supporting surface can also be a guiding surface, which guides the further conveyance of the containers through the processing apparatus in a suitable manner. These guiding surfaces, for example, may also be designed in the shape of curves or ramps to thereby define height levels of the containers during their conveyance through the processing plant in a suitable manner. In particular, such a supporting surface may also be provided with a turntable or may be configured as such a turntable to rotate individual containers while they are still accommodated in the openings or receptacles of the supporting structure. Conveniently, for this purpose the supporting structure is configured such that the holding forces exerted by the holding means can be adjusted in a simple manner, namely, between a first holding position in which the containers are supported with sufficient force in a positive-fit manner or by friction on the supporting structure, and a second holding position in which the holding force is reduced completely or at least to a sufficient extent. This can be accomplished in a simple manner, for example, by adjusting the opening width of the openings or receptacles of the supporting structure.

According to a further embodiment, edge portions of the supporting structure, in particular of a base plate thereof, can be removed or pivoted away to reduce the total base area of the supporting structure, when the containers are handled and processed in or at the processing station. Especially in the freeze-drying process of a plurality of containers held by a supporting structure, this results in significant cost savings.

According to a first aspect of the present invention the containers are supported in the carrier (supporting structure) by friction or clamped. For frictional supporting or clamping the cylindrical containers various types of holding means are available. As is well-known, frictional couplings only require a sufficient normal force onto the surfaces to be coupled together. The mutual displacement between the container and carrier is thus prevented as long as the counteracting force caused by the static friction between the carrier and the container is not exceeded. The frictional holding effect stops and the surfaces slide on each other, if the tangential load force is greater than the static friction. However, the latter is unlikely for the relatively low weights of the containers to be accommodated in the carrier, but may be utilized in order to displace the containers, while they are supported in the carrier, from a first position axially to a second position, in which these can be processed further, e.g. in which their openings are sealed with a stopper or in which an outer cap (for example a beaded cap or crimp) often made from sheet aluminum is placed on the stopper.

Suitably the frictional coupling is accomplished either below the expanded upper rim of the containers, i.e. at its constricted neck portion below the upper rim, or in the region of the cylindrical side wall. According to the present invention a support of the bottoms of the containers is in general not necessary, so that an access to the bottom sides (bottoms) of the containers accommodated in the carrier is in general possible. According to the present invention this enables that the containers can be further processed while being accommodated in the carrier. In other words, the containers can be processed further batch-wise in the carriers, but remain supported reliably and free of collisions in or on the carrier during the further processing, resulting in significant advantages with regard to processing speed and in benefits for the automation of processing units and thus overall results in even more economical and more cost-efficient processes. Furthermore, a direct glass-to-glass contact of adjacent containers is reliably prevented, effectively preventing abrasion and contaminants within the further processing plant and thus enabling significantly longer operation periods and maintenance intervals of the stations. Furthermore, scratches or the generation of particles can be effectively prevented on or in the containers.

The carrier according to the present invention thereby suitably permits removing the containers towards the upper side or lower side. Since the position of the forced engagement or frictional engagement between the container and the supporting structure can be varied easily, the supporting structure of the present invention can be used in a very flexible manner also for containers having different outer dimensions, as long as a sufficient normal force can be ensured for the frictional engagement. The containers can in particular be displaced easily in axial direction in the carrier, such that containers of different heights can be held in or on the same carrier. The possibility of axially displacing the containers also enables an easy compensation of tolerances.

According to a second aspect of the present invention, the containers are supported in the supporting structure in a positive-fit manner. For the positive-fit support of the cylindrical containers various types of holding means are available. The mutual displacement between the container and the supporting structure is prevented as long as one coupling partner stands in the way of the other coupling partner, i.e. blocks it.

Conveniently, the positive-fit is implemented either below the expanded upper rim of the containers, i.e. in the area of the constricted neck regions and directly below the upper rims or at the lower ends of the containers, for example at the bottoms of the containers. Suitably, the expanded upper rim or the bottom of the container is directly supported on the positive-fit members of the supporting structure. Alternatively, the upper rim or the lower end or bottom of the container can also be embraced or engaged behind in a positive-fit manner.

According to a further embodiment of the above-mentioned positive fit is formed in particular by holding means, wherein at least two holding tongues are provided on the carrier or the supporting structure as said holding means, which are provided on the rim of a respective opening or receptacle and project from an upper side of the carrier for supporting the respective container in the opening or receptacle. The holding tongues are configured such that these are elastically pivoted away or folded away during insertion of the containers into the openings or receptacles, and are further adapted to the containers such that these are supported by the holding tongues with a radial play. The radial play makes it possible that containers with different tolerances in radial direction and/or with different outer dimensions can be reliably supported by the same supporting structure. Conveniently, the radial play is configured such and matched to the outer contour and dimension of the containers that not all holding tongues are in contact with the constricted neck portion at the upper rim of the containers, in particular of the vials, at the same time. Furthermore, the radial play prevents an undesired tensioning or even bulging of the carrier while supporting containers having different radial tolerances and/or outer dimensions, which offers considerable advantages, particularly in the concurrent processing of a plurality of containers while they are supported by the supporting structure, for example, in the freeze-drying process including a processing at very low temperatures.

Even if the supporting structure should nevertheless buckle or bulge during the processing, nevertheless a uniform contact with the bottoms of all containers supported by the supporting structure can be achieved, especially when these are supported by the holding tongues on the supporting structure in addition with a sufficient axial play, because the axial play furthermore also enables a compensation of length tolerances.

The holding tongues are formed or supported properly elastically, so that the containers can be inserted axially, i.e. in the direction of the longitudinal axis of the containers and perpendicular to the plane of the supporting structure, from the upper or bottom side of the carrier into the openings or receptacles, in particular with elastic deformation of the holding tongues, for example by bending them away. The loading of the carrier with containers can thus be easily automated, which is further favored by a regular array of openings or receptacles, in a two-dimensional array.

The bottom side of the expanded upper rim portion of the containers has proven to be the preferred location at which the containers are held or supported on the holding tongues, as they are typically provided in particular as the so-called rolled edge or shoulder of vials. In this region there is provided a supporting or bearing surface for holding or supporting the containers with a sufficient extension in the radial direction of the openings or receptacles in order to implement the above-mentioned radial play for supporting the containers easily.

Because the containers can be raised or moved in the openings or receptacles with very little effort, they can be processed easily, for example, rotated while they are disposed in or held or at least guided by the supporting structure. This type of supporting has proved to be of particular advantage e.g. for the crimping of a metal lid when sealing the containers. The operations necessary for this purpose can be performed on the metal lid while the containers are supported in or at least guided by the openings or receptacles of the supporting structure. This type of support has also proved to be of particular advantage during the processing of containers while they are supported or accommodated in the supporting structure. For example, the supporting structures together with the containers accommodated or supported therein can be inserted into a freeze-dryer. Because the containers are supported with a certain play in the supporting structures, it can be ensured that the bottoms of all containers evenly rest on a cooling base, such as a cooling finger of the freeze-dryer. Or the containers can be raised in the openings or receptacles of the supporting structure without much effort and can be handled for the processing.

According to a preferred embodiment, the holding tongues are designed as resilient holding tongues, but have sufficient resiliency to be sufficiently elastically pivoted or clapped away during insertion of the containers into the openings or receptacles to unblock the way for the containers into the openings or receptacles. This can be achieved easily by suitable dimensioning, choice of materials and design of the material thickness of the holding tongues. Hence, the holding tongues are preferably formed from a plastic material.

According to an embodiment, the holding tongues are resiliently biased towards a support position, preferably by means of an elastic resetting member, such as a return spring or a plastic lamina or a flexible plastic structure, which cooperates with the associated holding tongue in a suitable manner and is provided or formed on the upper side of the supporting structure.

According to an embodiment, the holding tongues are matched to the containers such that the containers rest loosely on the upper sides of the holding tongues with an expanded rim, which is formed at an upper end of the containers, in particular with the above-mentioned rolled edge. Thus, the containers can be removed again upwards from the openings or receptacles without resistance.

According to an embodiment, the holding tongues embrace the expanded rim such that the containers are supported by the holding tongues with a radial play or with a radial and axial play. In this manner the containers can be supported in the openings or receptacles so that they cannot be lost. For removing the containers from the openings or receptacles the holding tongues only need to be pivoted or clapped back again, in the manner as for the insertion of the containers.

According to an embodiment, the holding tongues are arranged distributed on the upper side of the supporting structure such that they do not touch each other directly when they are pivoted or clapped away and do not obstruct a directly adjacent opening or receptacle. Thus, the packing density of the containers on the supporting structure can be further increased. In particular, the holding tongues are designed such that directly adjacent holding tongues do not touch each other, when they are pivoted or folded toward the supporting structure upon insertion of the containers into the associated openings or receptacles.

According to an embodiment, slanted insertion surfaces are formed at the upper ends of the holding tongues, each of which pass over into a holding nose protruding radially inwards for supporting the containers. Thus, the containers can be inserted more easily and with lower force into the openings or receptacles. In particular, first the bottoms or lower ends of the containers get in contact with the slanted insertion surfaces when the containers are inserted from above into the openings or receptacles. Upon further insertion of the containers, the lower ends or the bottoms of the containers slide along the slanted insertion surfaces downward and spread the holding tongues apart or clap or pivot them back. Upon further insertion of the containers finally the cylindrical side walls get in contact with the holding tongues and slide therealong, until eventually the underside of the aforementioned rolled edge rests loosely on the holding noses of the holding tongues.

According to a further aspect of the present invention, which can be expressly claimed by an independent claim, regardless of the above-mentioned aspects, further a supporting structure is provided for concurrently holding a plurality of containers for substances for cosmetic, medical or pharmaceutical applications, in particular vials, comprising a carrier having a plurality of openings or receptacles into which the containers can be inserted, and holding means for supporting the containers in the openings or receptacles, the supporting structure having a longitudinal direction (x) and a transverse direction (y). According to the present invention respective directly adjacent supporting structures can be directly connected with each other in such a manner that these cannot be displaced relative to each other in the longitudinal direction and/or in the transverse direction. In other words, the respective directly adjacent supporting structures can be displaced together, as a kind of unit consisting of several (at least two) supporting structures, without significantly changing their position relative to each other.

For this purpose, according to the present invention a releasable, temporary coupling of the directly adjacent supporting structures is selected, wherein in general any kind of positive-fit or frictional coupling can be used, as long as the coupling force that can be obtained by the coupling is greater than the forces typically encountered during handling or processing of the supporting structures that seek to separate again the directly adjacent supporting structures from each other. The selected coupling technique may well allow some play between the directly adjacent supporting structures in order to avoid excessive stress on the material. In particular, the form-fitting or frictional coupling structures provided for the coupling can have a certain elasticity between the directly adjacent supporting structures, which can be achieved easily by a suitable design of the coupling structures.

By means of the releasable, temporary coupling according to the present invention a plurality of supporting structures may be arranged in a row behind one another or side by side and may be inserted together into a treatment or processing station, such as a freeze-dryer, and removed again. The loading of treatment or processing stations, such as freeze-dryers, can be carried out manually but also semi-automatically or full-automatically by means of suitable conveying devices. According to the present invention, the loading of a freeze-dryer may in particular be done from the outside and inside.

According to a further embodiment, the releasable, temporary coupling of directly adjacent supporting structures is accomplished by means of a positive-fit using positive-fit structures, which are suitably arranged along the edges of the supporting structures and configured to cooperate with each other suitably, in order to accomplish a releasable coupling. The positive-fit is preferably implemented directly between the positive-fit structures, i.e. without the mediation of a third coupling member such as a screw, so that the coupling can be implemented in a time-saving and cost-efficient manner. For this purpose, positive-fit structures corresponding to each other may be disposed on opposite edges of the directly adjacent supporting structures that can be brought into a positive-fit engagement.

The positive-fit structures may be especially designed for a coupling in the manner of a dovetail coupling, of a tongue and groove coupling or a fitting key. Recesses are also conceivable, for example with a circular cross section, into which corresponding pin-like protrusions of an adjacent supporting structure engage in a positive-fit manner.

According to a further embodiment, the positive-fit structures are formed as protrusions and recesses along the opposite edges of the two directly adjacent supporting structures, the base areas of which, if respectively viewed in a top view, are different from a rectangular shape and which are formed in direct correspondence with each other. Thus, the positive-fit structures can easily be hooked directly into each other. Preferably, these protrusions and recesses do not significantly project beyond the plane defined by the flat supporting structure, so that the supporting structures are still flat and thus save space. The aforesaid entanglement is effected by simply lifting the supporting structure and then by lowering it in order to accomplish the above-mentioned positive-fit coupling between the correspondingly formed positive-fig structures. For example, the protrusions and recesses can have a substantially triangular base. Preferably, these protrusions and recesses are arranged alternately and in regular intervals to each other along opposite edges of the supporting structures, so that the supporting structures generally can also be coupled with each other if they are not aligned with one another in a row side by side, which may be of advantage, for example, for a more efficient use of treatment and processing stations having a non-rectangular-shaped base. The loading of treatment and processing stations can thus be performed even more flexibly.

According to a further embodiment, side walls are formed at least partially along the edges of the mutually corresponding protrusions and recesses which protrude perpendicularly from a surface of the supporting structures. It is advantageous that these protruding edges enlarge the contact area during pushing and pulling. Here, the edges serve as a kind of stop and guiding surfaces and allow an even more precise positive-fit between the directly adjacent supporting structures. In particular, the risk of "layering over each other" the planar supporting structures can be effectively reduced.

According to a further embodiment, the positive-fit structures comprise an elastic tongue, on a first of the two directly adjacent supporting structures, an elastic tongue including a locking protrusion formed thereon or a locking recess formed thereon, and, on the second of the two directly adjacent supporting structures, a receptacle formed corresponding to the locking protrusion or a protrusion formed corresponding to the locking recess. For the coupling the supporting structures are moved toward each other until finally the front end of the elastic tongue gets in contact with the edge of the adjacent supporting structure. Upon further movement toward each other, finally the bottom of the elastic tongue slides on the surface of the adjacent supporting structure, and in this condition, the elastic tongue is slightly bent upward. Finally, the locking protrusion and the corresponding receptacle engage with each other in a positive-fit manner and the elastic tongue returns back to its relaxed home position, wherein a reliable coupling between the adjacent supporting structures is implemented due to the positive-fit engagement between the locking protrusion and the corresponding receptacle. The coupling and release of the coupling is advantageously simple.

A further aspect of the present invention also relates to a transport and packaging container having at least one supporting structure as outlined above and disclosed in further detail in the following.

A further aspect of the present invention relates to a transport and packaging container with measures for protection against plagiarism, especially for identification and/or tracking purposes, as outlined below.

BRIEF DESCRIPTION OF THE DRAWINGS

The invention will now be described by way of example and with reference to the accompanying drawings, from which further features, advantages and problems to be solved will become apparent. In the drawings.

DETAILED DESCRIPTION

Figure 1:
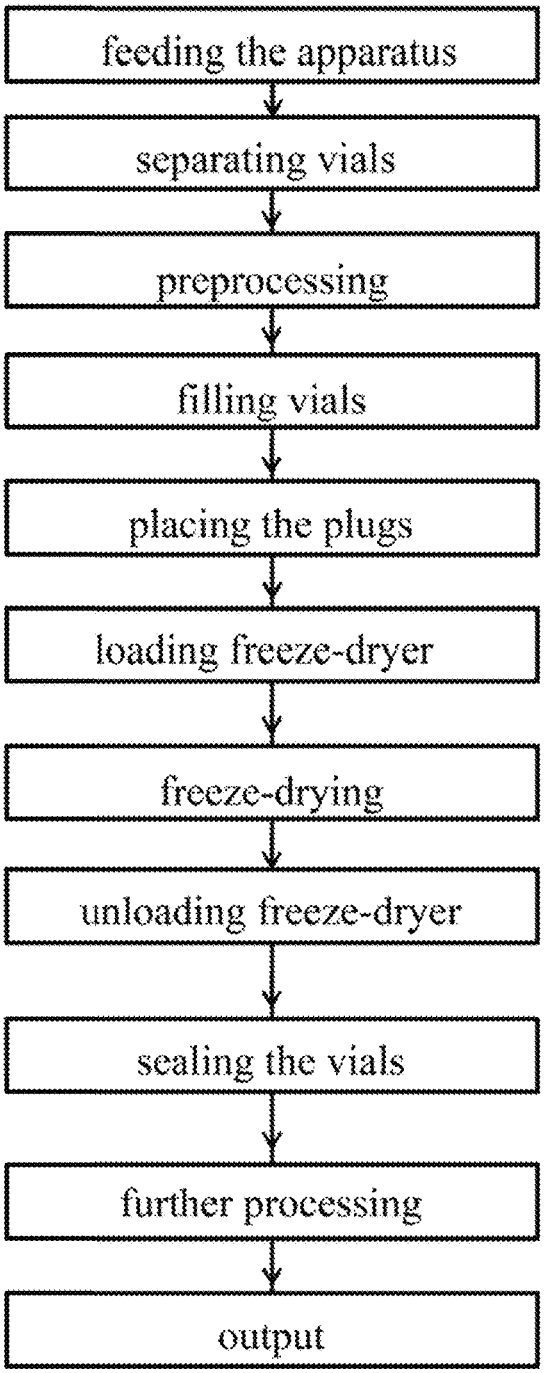
Fig. 1 PRIOR ART
FIG. 1 is a flow diagram of a process for the treatment or processing of containers according to the prior art.

In the drawings, identical reference numerals designate identical or substantially equivalent elements or groups of elements.

A supporting structure (a carrier, also referred to as a so-called 'nest' in the prior art) as well as a transport and packaging container (in the prior art often also referred to as a so-called 'tub') accommodating such a supporting structure are used, as described below, for concurrently supporting a plurality of containers for storage of substances for cosmetic, medical or pharmaceutical applications in an array configuration, in particular in a matrix configuration with regular intervals between the containers along two different directions in space, preferably along two mutually orthogonal spatial directions.

Figure 4A:
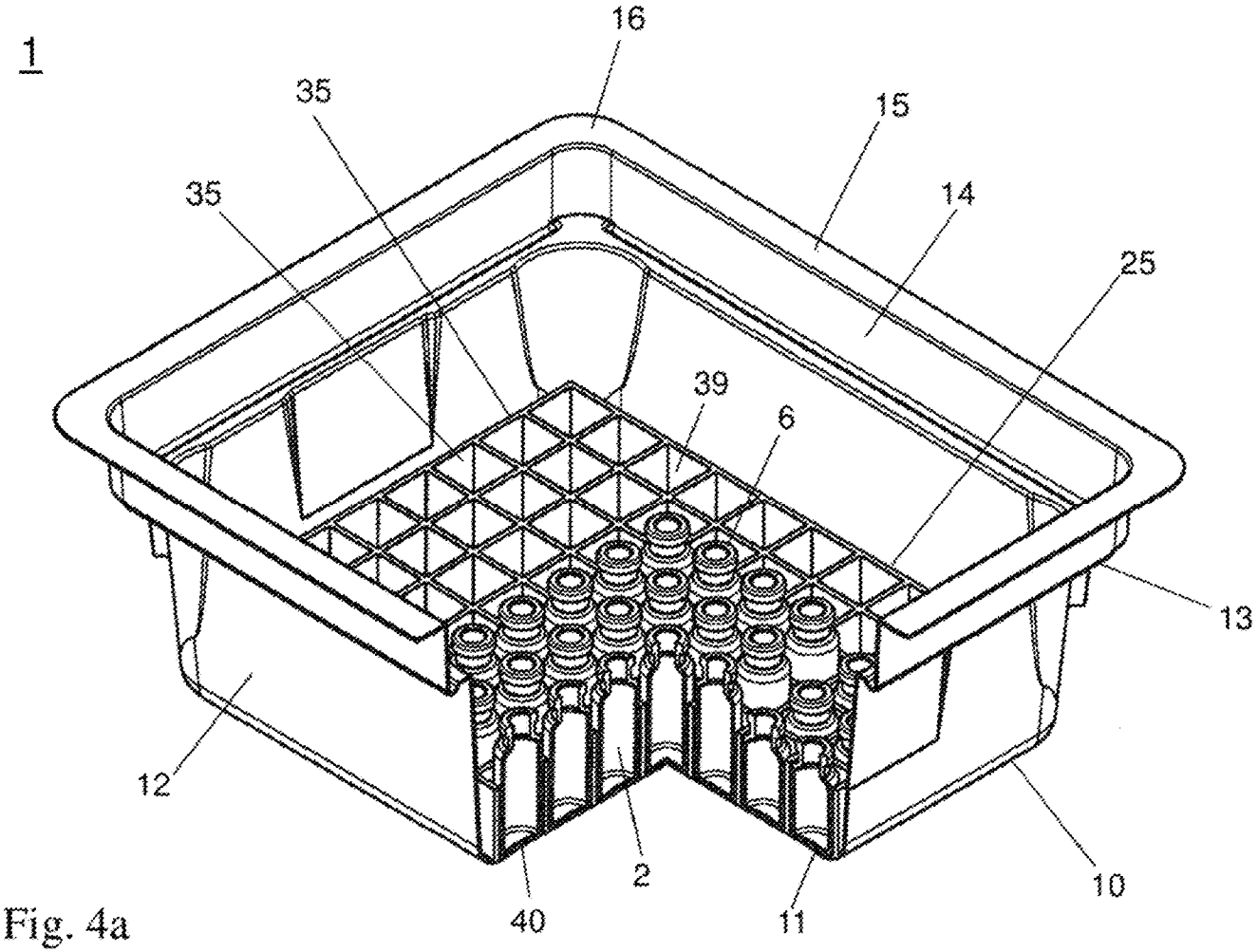
FIGS. 4*a*-4*b* show a transport and packaging container according to a further embodiment for use in a process according to the present invention.
Figure 4B:
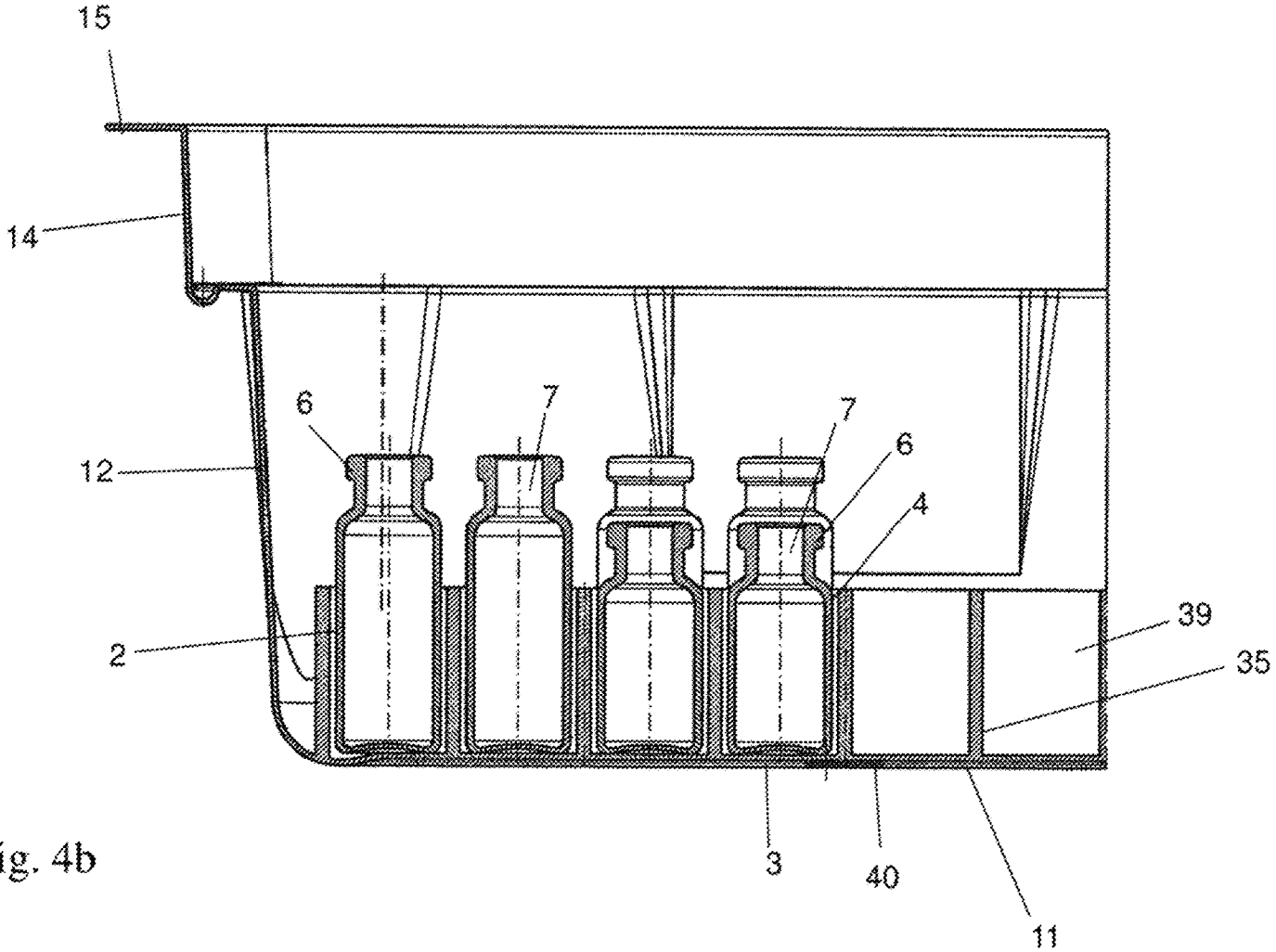
Figure 17A:
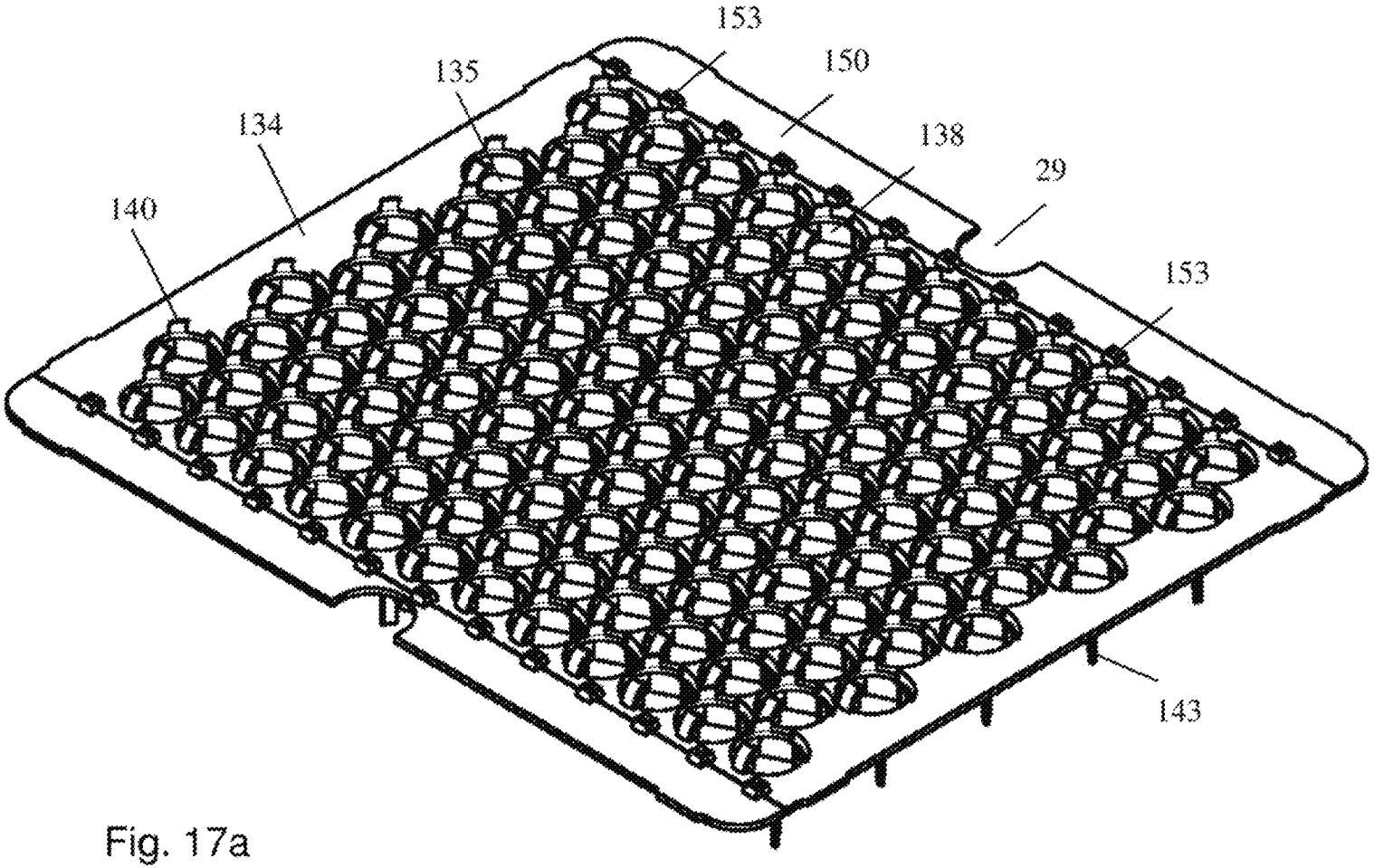
FIGS. 17*a*-17*h* show a further supporting structure according to a further embodiment for use in a process according to the present invention.
Figure 17B:
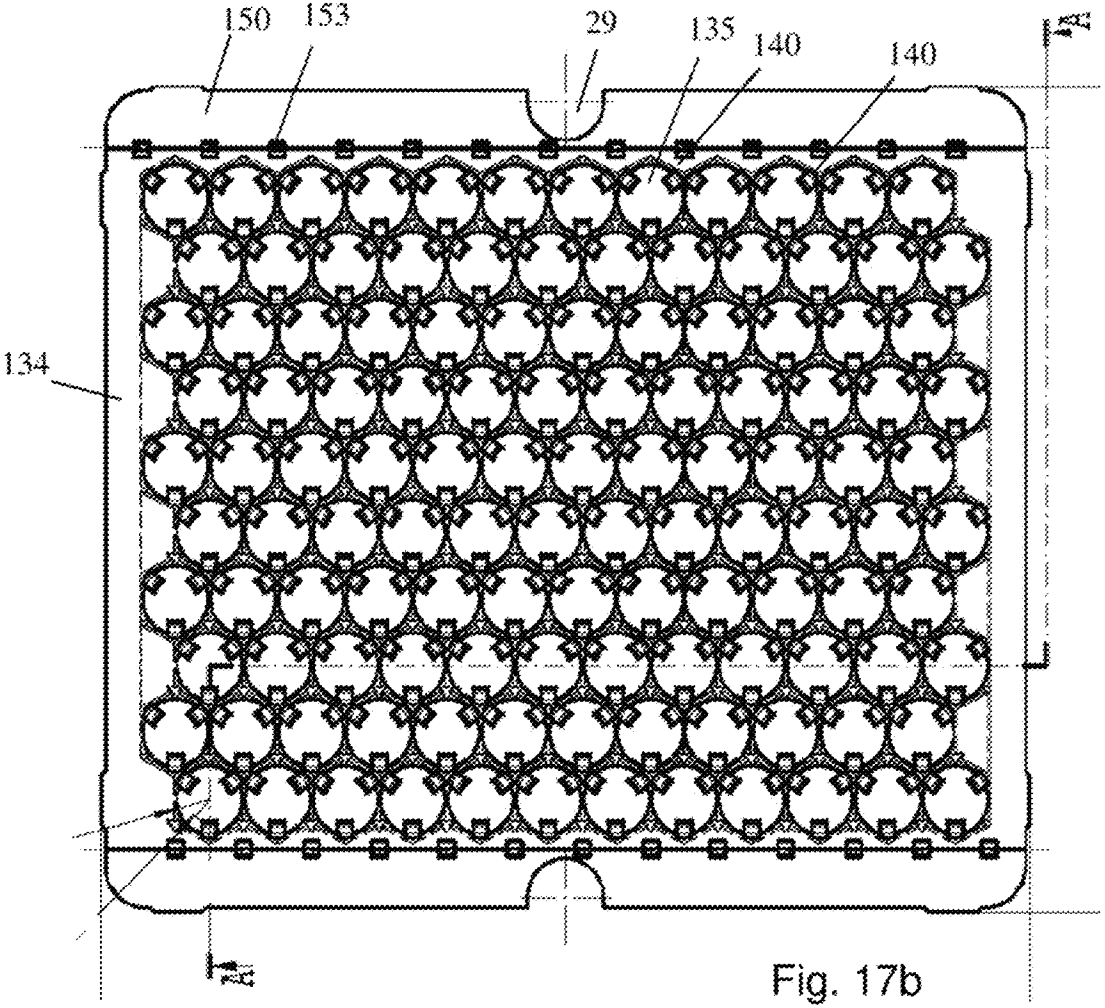
Figure 17C:
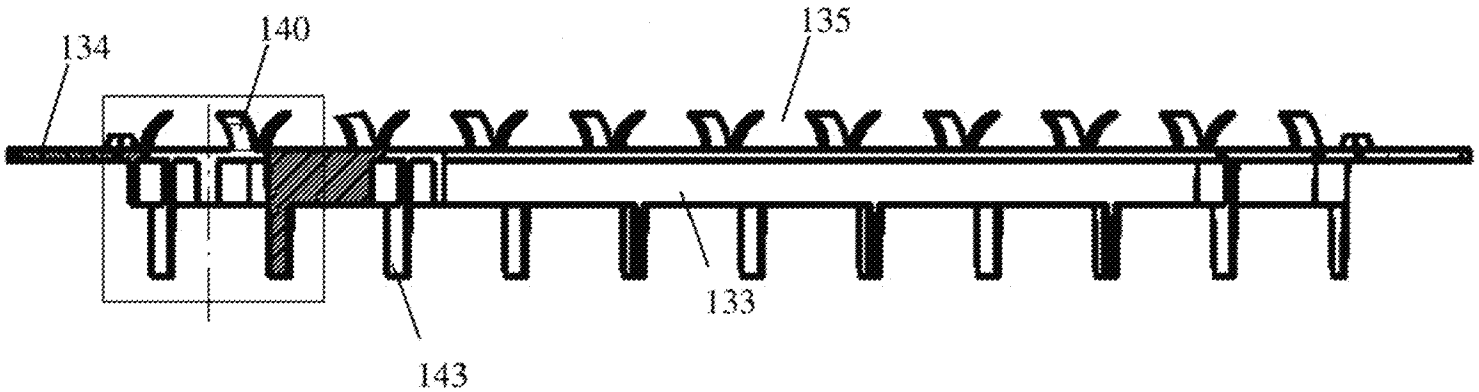

An example of such medication containers embodied as vials (English: vial) is schematically shown in FIG. 4*b* or FIG. 17*c* in a longitudinal sectional view. The vials have a cylindrical basic shape, having a cylindrical side wall 4 with—within tolerances—constant inner and outer diameters, which project vertically from a flat vial bottom 3, which merges in a constricted neck portion 5 of a relatively short axial length near the upper open end of the vial and then merges in a expanded upper rim 6, which has a larger outer diameter than the associated neck portion 5 and is configured for connection to a closure member. The neck portion 5 can be formed with smooth walls and without an external thread or may be provided with an external thread for screwing on a closure member. For example, a stopper (not shown) may be inserted in the inner bore of the neck portion 5 and the upper rim 6, whose upper end is connected with the upper rim 6 of the vial in a gas-tight manner and protected against the intrusion of contaminants into the vial, for example by crimping a metal protective foil, which is not shown. Such vials are radially symmetric and are made of a transparent or colored glass or of a suitable plastic material by blow molding or plastic injection molding techniques, and in general can be internally coated so that the material of the vial emits minimal impurities to the agent to be received.

Another example of a medication container according to the present application are ampoules, carpoules, syringes or injection containers. Ampoules or carpoules are containers for medication agents for usually parenteral administration (injection), for cosmetics and other agents and are usually cylindrical in shape with an extended tip (spear or head) and a flat bottom or also with two extended tips at both ends. These may be formed in particular as snap-off ampoules with an annular predetermined breaking point around the ampoule neck or as an OPC cartridge (One-Point-cut ampoule) having a breaking ring inscribed into the glass. Syringes or injection containers, also known as injection flasks, vials or reusable ampoules, are cylindrical containers of glass or plastic shaped similar to a bottle, usually having a relatively small nominal volume (e.g. 1 ml, 10 ml). They are sealed with a rubber plug with septum (puncture rubber). For protecting the septum and fixing the rubber plug an outer closure (beaded cap or cramp), often made from an aluminum sheet, is necessary. In a carpoule the liquid is stored in a cylinder, which is closed at one end by means of a thick rubber or plastic plug. This acts as a piston when the content is pressed out using a carpoule syringe. At the other end the cylinder is closed only by means of a thin diaphragm, which is pierced from the rear end of the carpoule syringe (a cannula sharpened on both sides) in the application. Cylindrical ampoules are often used in dentistry for local anesthesia. Special cylindrical ampoules with a specially shaped front part (e.g. thread) are used for insulin therapy in insulin pens.

In the sense of the present invention, such containers are used for storage of substances or agents for cosmetic, medical or pharmaceutical applications, which are to be stored in one or several components in solid or liquid form in the container. Especially in the case of glass containers storage periods can amount many years, notably depending on the hydrolytic resistance of the glass type used. While, in the following, cylindrical containers are disclosed, it should be noted that the containers, in the sense of the present invention, may also have a different profile, for example a square, rectangular or polygonal profile.

Inevitably such containers have tolerances due to the production which can be of the order of one or several tenths of a millimeter in particular for glass containers. To compensate for such manufacturing tolerances, while ensuring that all bottoms 3 or bottom ends of the containers can be disposed in a plane, according to the present invention the containers are fixed by means of a positive-fit or frictional fit on a supporting structure or carrier. This frictional fit is implemented in the region of constricted neck portion 5, at the cylindrical side wall portion 4 or in the region of the lower end of the container 2, in particular at the bottom 3 of the container 2.

Figure 2A:
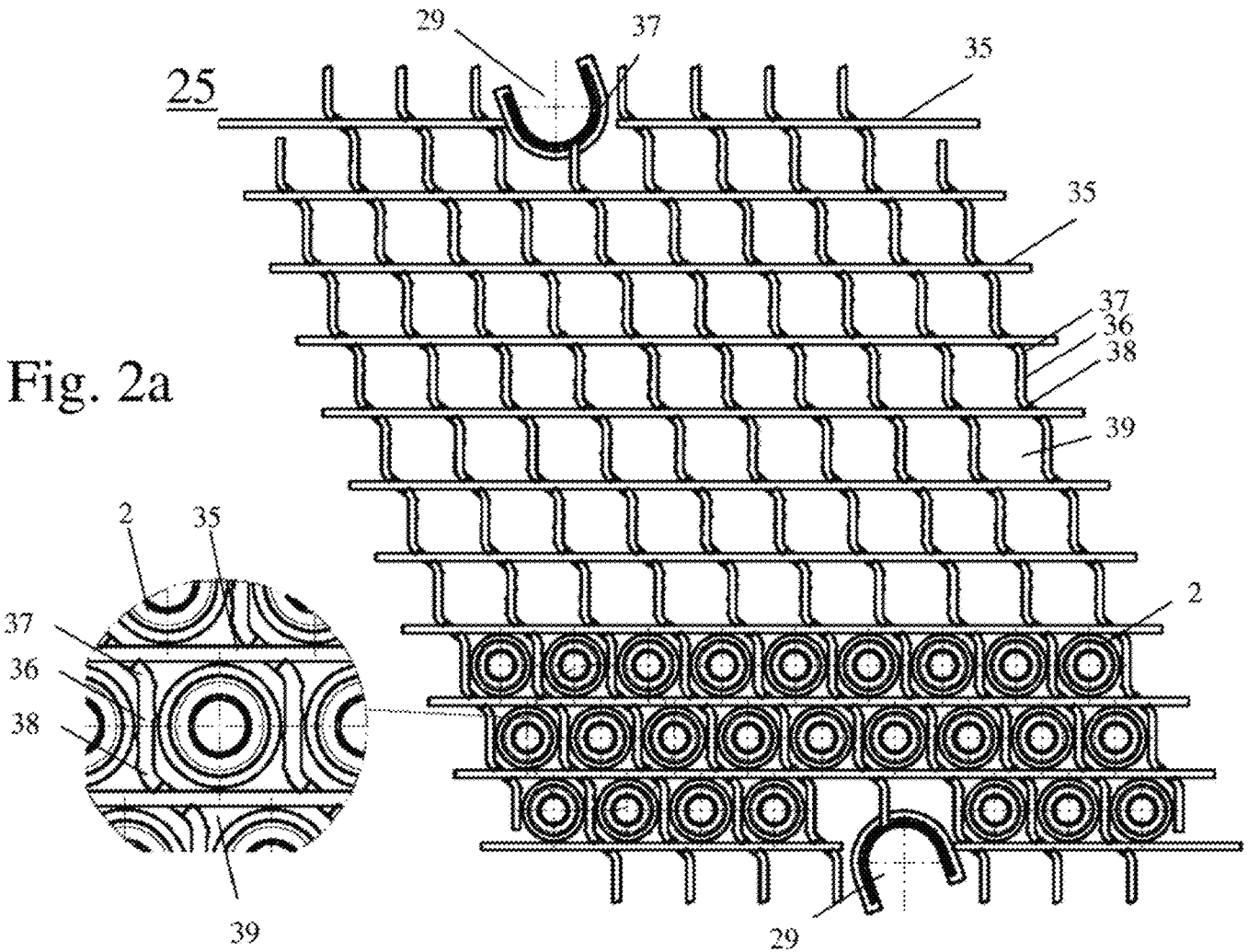
FIGS. 2*a*-2*f* show a transport and packaging container according to a first embodiment for use in a process according to the present invention.

FIG. 2*a* shows a supporting structure (carrier) 25 according to a first embodiment according to the present invention, with frictional supporting of the containers. The supporting structure comprises a plurality of transverse webs 35, which extend in parallel with each other and which are connected to each other via S-shaped connecting webs 36, which extend substantially perpendicularly to the transverse webs 35. More specifically, the connecting webs 36 are connected with the transverse webs 35 via front and rear ends 37, 38, respectively, which are curved in opposite directions. The connecting webs 36 are made of a plastic, preferably of a flexible plastic. The transverse webs 35 preferably have a greater stiffness than the connecting webs 36. Due to the S-like shape of the connecting webs 36, the transverse webs 35 are offset to each to each other in the longitudinal direction by a constant distance, so that the supporting structure 35 is configured overall as a parallelogram comprising a basis in the region of the lower rim of the supporting structure 25 shown in FIG. 1*a* and two imaginary lines extending at an acute angle, which connect the front ends of the transverse webs 35 with each other. In the relaxed home position shown in the right-hand part of FIG. 1*a* the containers 2 can be inserted into the elongated holding receptacles 39 formed by the webs 35, 36 freely and without contact with the webs 35, 36, or at least with minimal forces. The supporting receptacles 39 have essentially a square-shaped cross section which is matched to the diameter of the containers 2 such that these can be fixed therein, and in particular can be clamped therein, with a sufficient frictional force in a second position of the supporting structure 25.

Figure 2B:
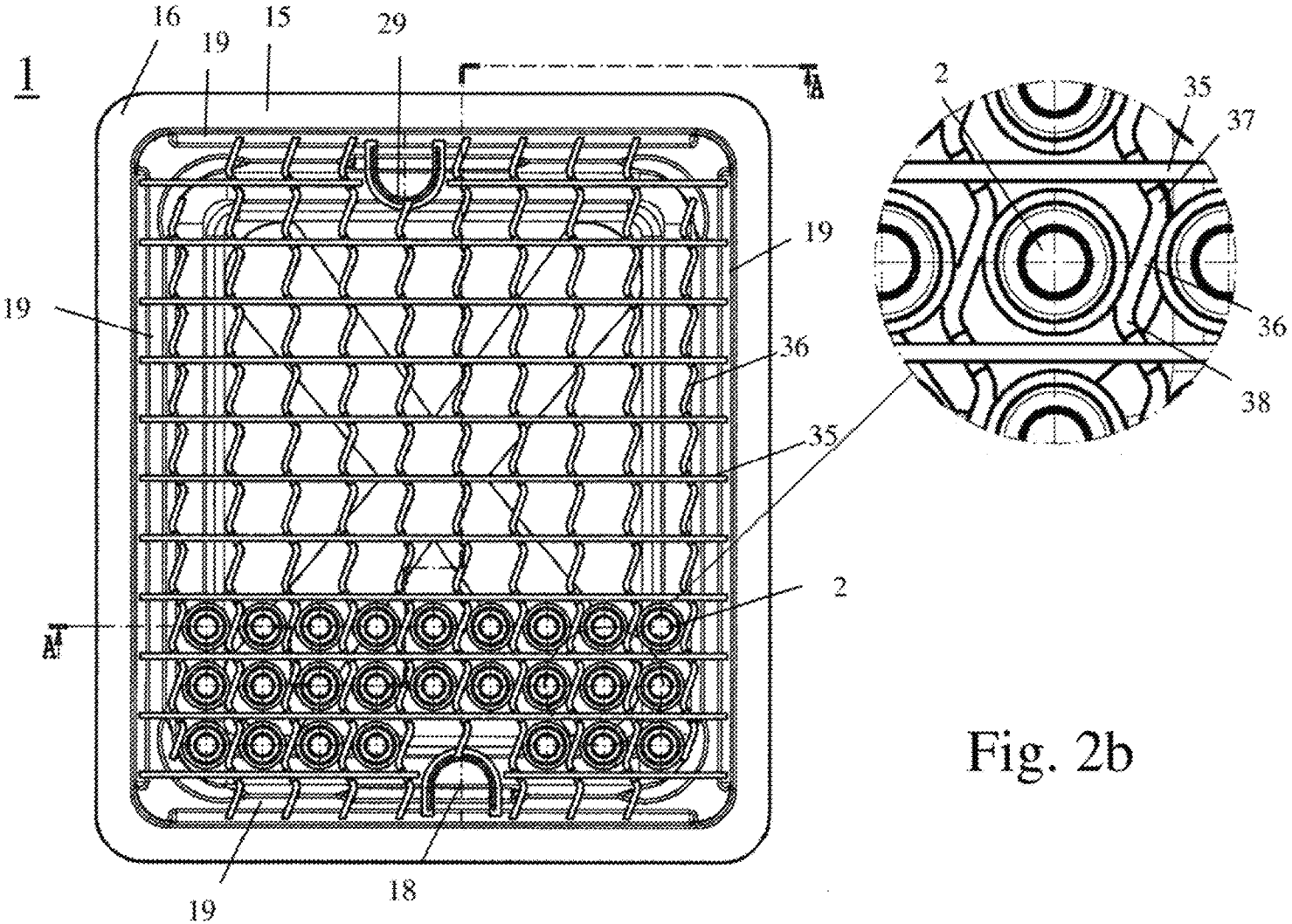

For converting the supporting structure 25 from the first position shown in FIG. 2*a* into the second position shown in FIG. 2*b*, the transverse webs 35 may be shifted respectively in their longitudinal direction so that, finally, the rectangular or square-shaped supporting structure 25 shown in FIG. 2*b* is formed. As can be concluded from the comparison of FIGS. 2*a* and 2*b*, the connecting webs 36 are slightly bended for this purpose. The second position according to FIG. 2*b* can be fixed by means of the cooperation of the access apertures 29 formed in the supporting structure 25 with correspondingly shaped counter-elements of the container 10 or by means of the cooperation of centering openings with correspondingly shaped centering pins of a supporting frame, not shown, which accommodates the supporting structure 25.

As can be concluded from the enlarged partial view shown in FIG. 2*a*, the containers 2 are loosely accommodated in the supporting receptacles 39 in the first position according to FIG. 2*a*. As can be concluded from the enlarged partial view according to FIG. 2*b* the containers 2 are frictionally fixed, in particular clamped, by central portions of the connecting webs 36 in the second position shown in FIG. 2*b*. A certain clearance to the transverse webs 35 may persist, which, however, is preferably minimum or vanishing.

Figure 2C:
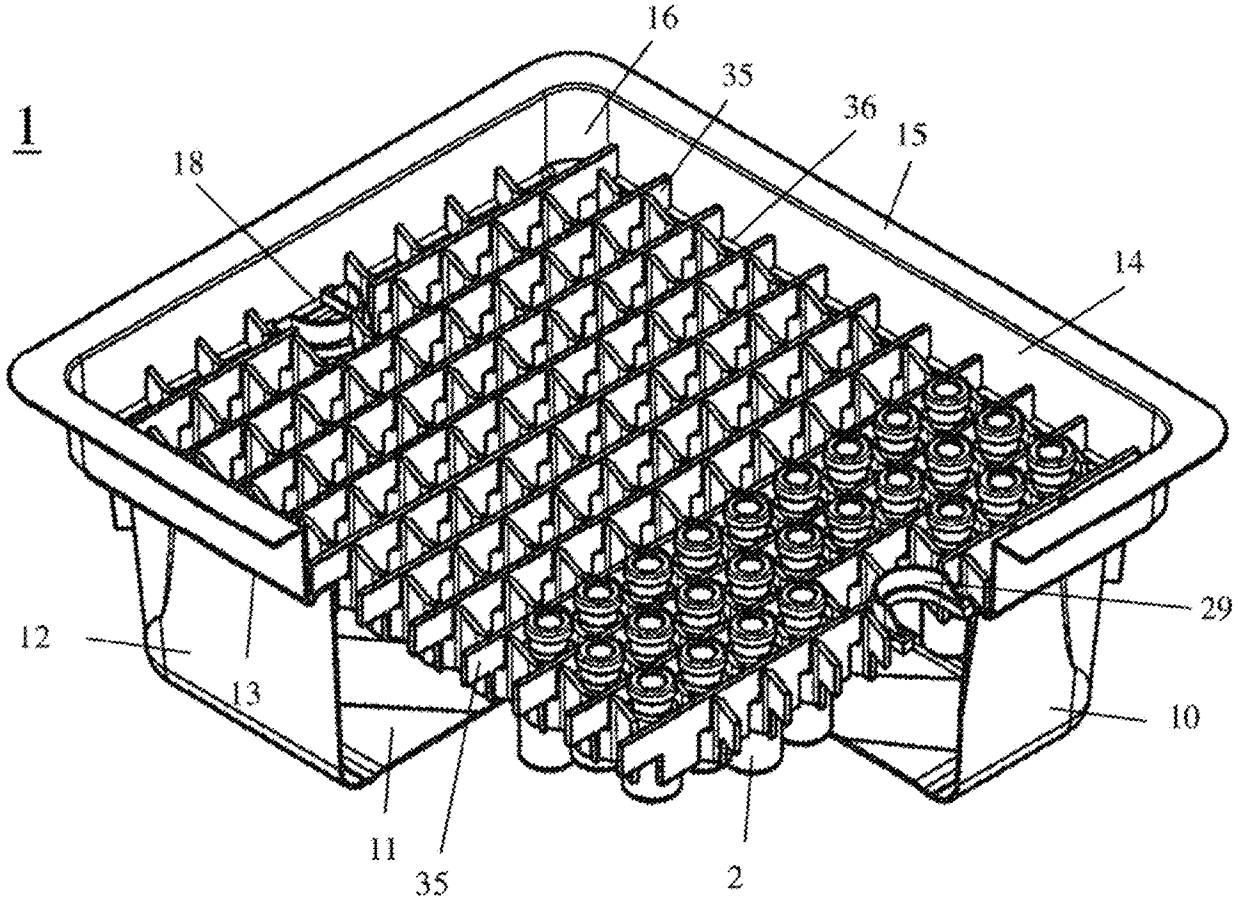
Figure 2D:
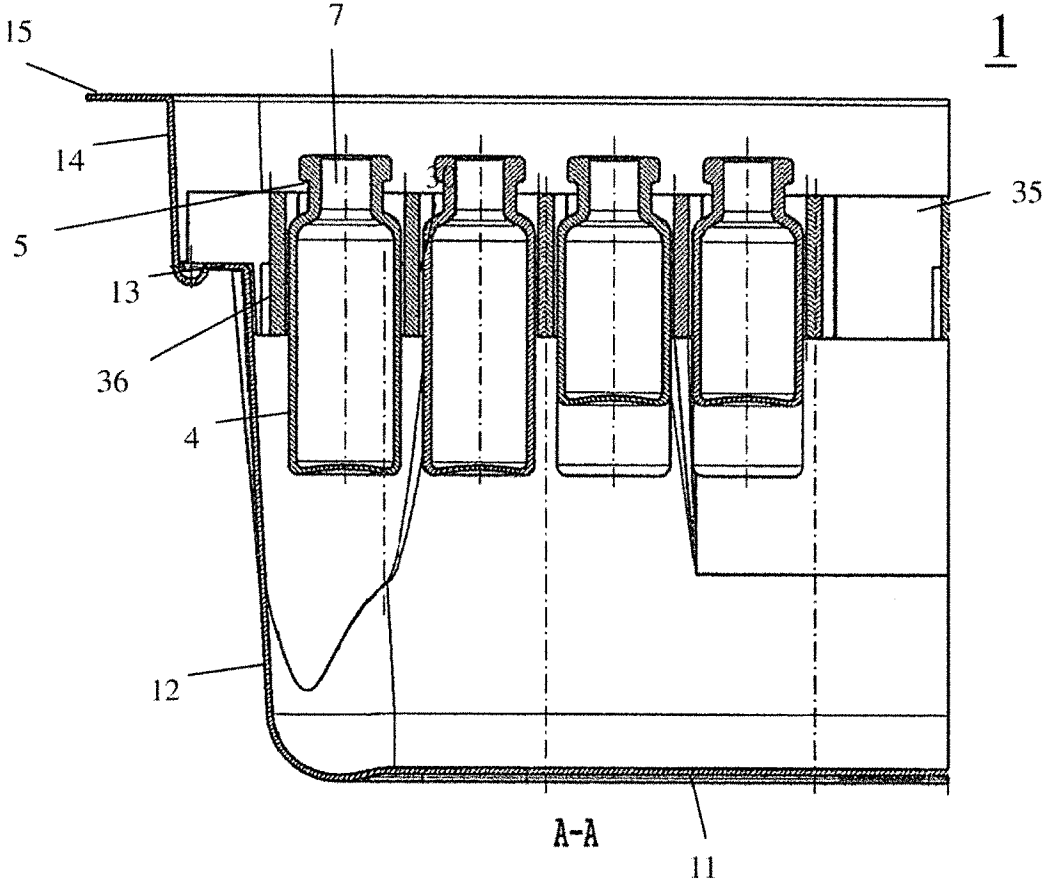

FIG. 2*c* shows the packaging unit 1 formed in this way in a perspective partial section, wherein it can be seen that in this embodiment the transverse webs 35 are directly supported on the supporting surface formed by the step 13 of the container 10. The frictional fixation of the containers can be seen in the partial section of FIG. 2*d*.

As stated above, in the first embodiment described above all the side walls of the receptacles 39 are adjusted in a coordinated manner, i.e. jointly, from the first position to the second position upon displacement of the transverse webs 35, namely by pivoting of the upper end of the supporting structure 25 (see FIG. 2*a*) relative to the base at the lower end of the parallelogram shown in FIG. 2*a*. Thus, the containers can be inserted into the supporting structure and accurately positioned in the afore-mentioned first position, in particular at a predetermined height level and such that all the bottoms of the containers are arranged and aligned in a common plane. All containers are then concurrently frictionally fixed by coordinated adjustment of the supporting structure into the afore-mentioned second position and are precisely positioned in a regular array. The supporting structure according to FIGS. 2*a* to 2*c* is preferably formed integrally of a plastic. A similar supporting structure, however, can also be assembled together of a plurality of identical basic units, as set forth hereinafter.

Figure 2F:
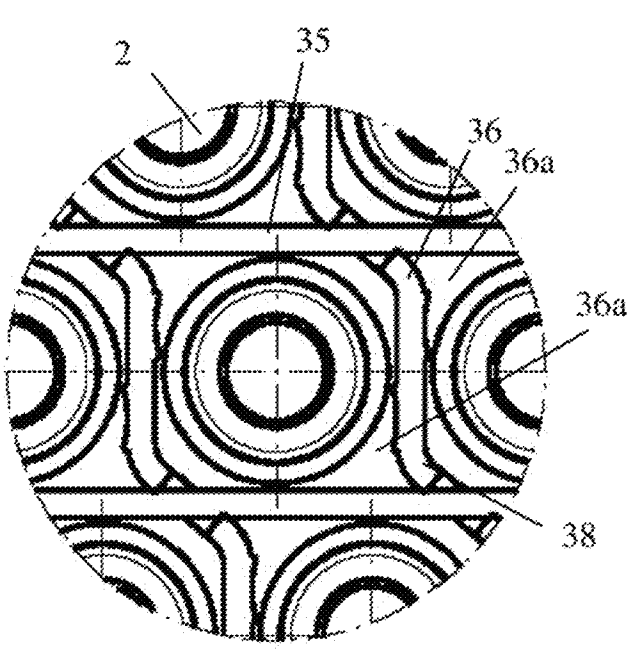
Figure 2E:
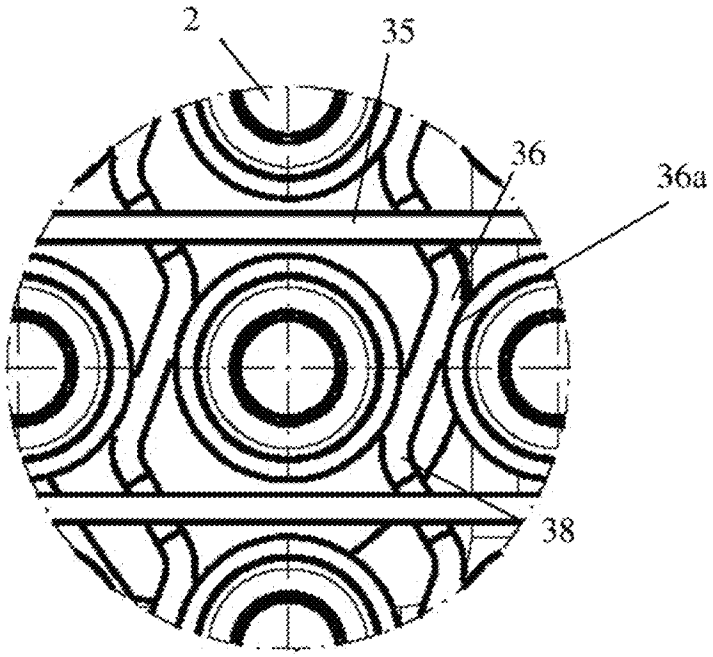

FIGS. 2*e* and 2*f* show in greatly enlarged partial views a further version of the supporting structure according to FIGS. 2*a*-2*c*. FIG. 2*e* shows the region of a receptacle of the supporting structure in the afore-mentioned second position, in which the containers 2 are supported in the receptacles of the supporting structure. Differing from FIGS. 2*a*-2*c*, in this embodiment a respective concave portion 36*a* is formed at the connecting webs 36 at the two sides, wherein the radius of curvature of both concave receptacles of the portions 36*a* is matched to the radius of the containers 2. In the second position according to FIG. 2*e*, in which the connecting webs 36 extend inclined relative to the transverse webs 35, the concave receptacles 36*a* nestle to the cylindrical side walls of the containers 2, so that the containers can be held more reliably and more precisely. In the first position according to FIG. 2*f*, in which the connecting webs 36 extend perpendicular to the transverse webs 35, the concave receptacles 36*a* are not disposed anymore opposite to the cylindrical side walls of the containers 2 so that the containers may be inserted into the receptacles formed by the webs 35, 36 without hindrance, or at least with a significantly reduced force, and removed therefrom. Ideally, the webs 35, 36 do not abut to the side walls of the containers 2 in the first position according to FIG. 2*f*.

FIGS. 3*a* to 3*d* show, as an example of a processing station for the treatment or processing of medical containers, a crimping station 180 for the concurrent crimping of metal lids on the upper rims of containers 2 that are accommodated or supported in a carrier as described above with reference to FIGS. 2*a* to 2*c*. Not shown here is the conveying device, such as a belt conveyor or a line of rollers in a sterile tunnel. The crimping station 180 is disposed on a rack 181, which is located below the conveying device and usually is separated from the processing apparatus as much as possible. The crimping station 180 has a support arm 183 or a cover through which the lifting rods 185 extend, at the upper end of which a turntable 186 is mounted rotatably, which is rotated by the associated rotary drive 182 and via the gear mechanism 184 can.

Above the containers, there is a bracket 190 at which a plurality of centering discs 191 and crimping discs 192 are held whose positions can be adjusted precisely to match the array of containers to be processed, wherein their arrangement is defined by the transverse webs 35 and receptacles of the carrier.

While the carrier is conveyed upstream of the processing station in the configuration of FIG. 2*b*, e.g. in a transport and packaging container according to FIG. 2*c* with frictional support of the containers 2, the carrier is removed from the transport and packaging container and transferred to the position shown in FIG. 2*a*, in which the frictional engagement between the transverse webs 35 and the containers 2 is largely or completely released. For preventing the containers from slipping uncontrollably out of the receptacles of the carrier downward, suitable supporting and guiding surfaces (not shown) are disposed in the region of the crimping station 180. Alternatively, the containers 2 are clamped only with a weak force in the position of the carrier of FIG. 2*a*, so that they can be pushed up easily by raising the lifting rods 185 to a raised or elevated position while being accommodated in the receptacles of the carrier. In this raised position, the upper edges of the containers 2 are freely accessible to a sufficient extent for the crimping process. As can be concluded from the cross-section of FIG. 3*b*, only a few of the containers 2 are pushed up by means of the lifting rods 185. In the raised position, the frictional engagement between the transverse webs 35 of the carrier and the containers 2 is preferably fully released.

Figure 3A:
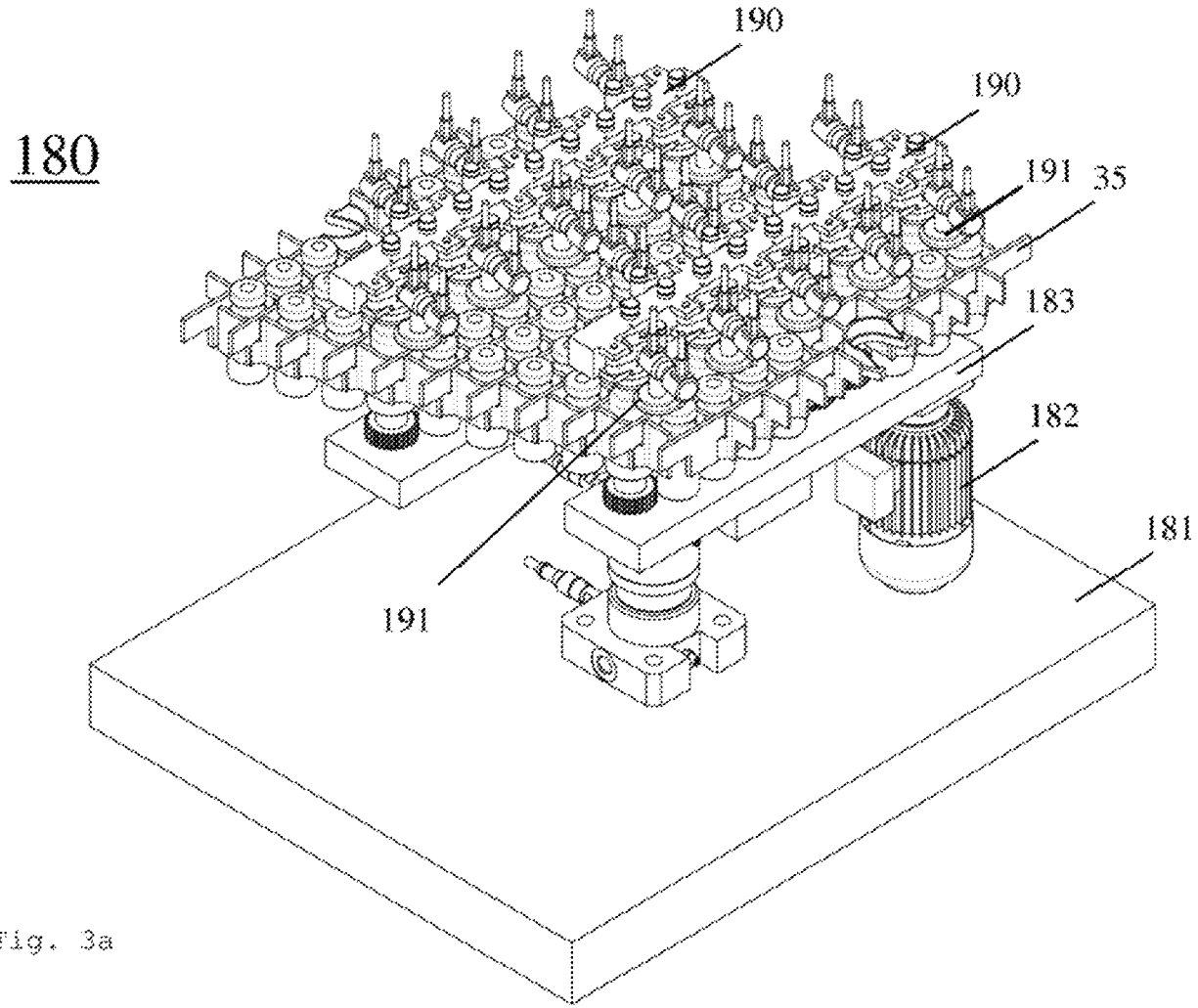
FIGS. 3*a*-3*d* show a processing station for crimping metal lids onto the upper rims of a plurality of containers in a process according to the present invention.
Figure 3B:
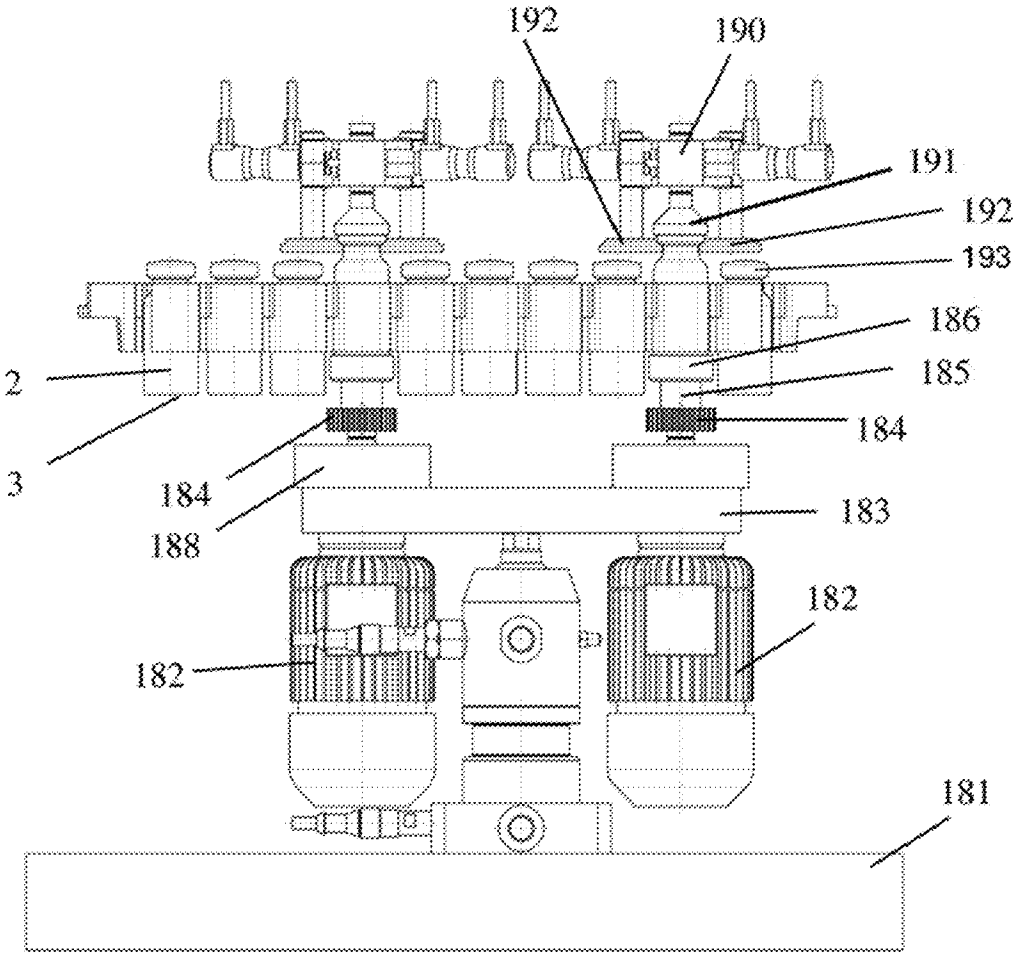
Figure 3C:
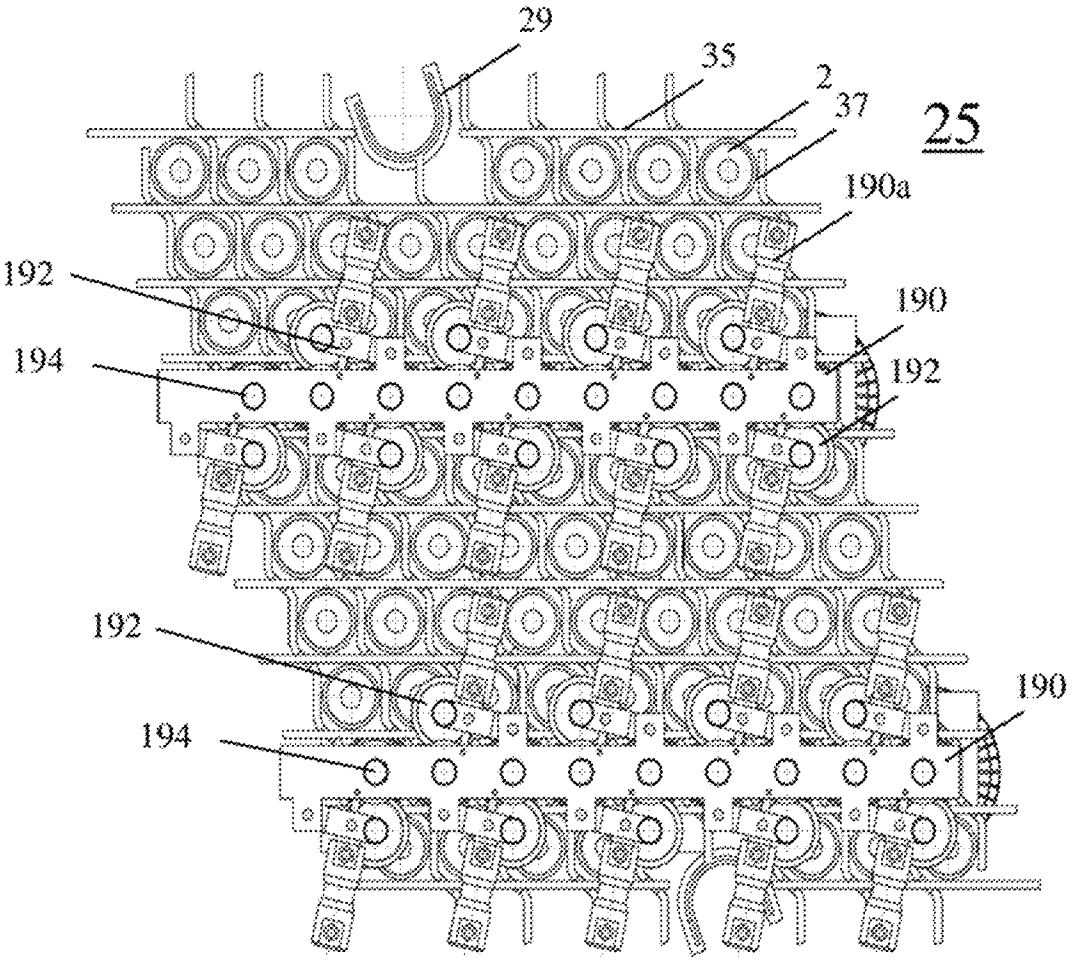
Figure 3D:
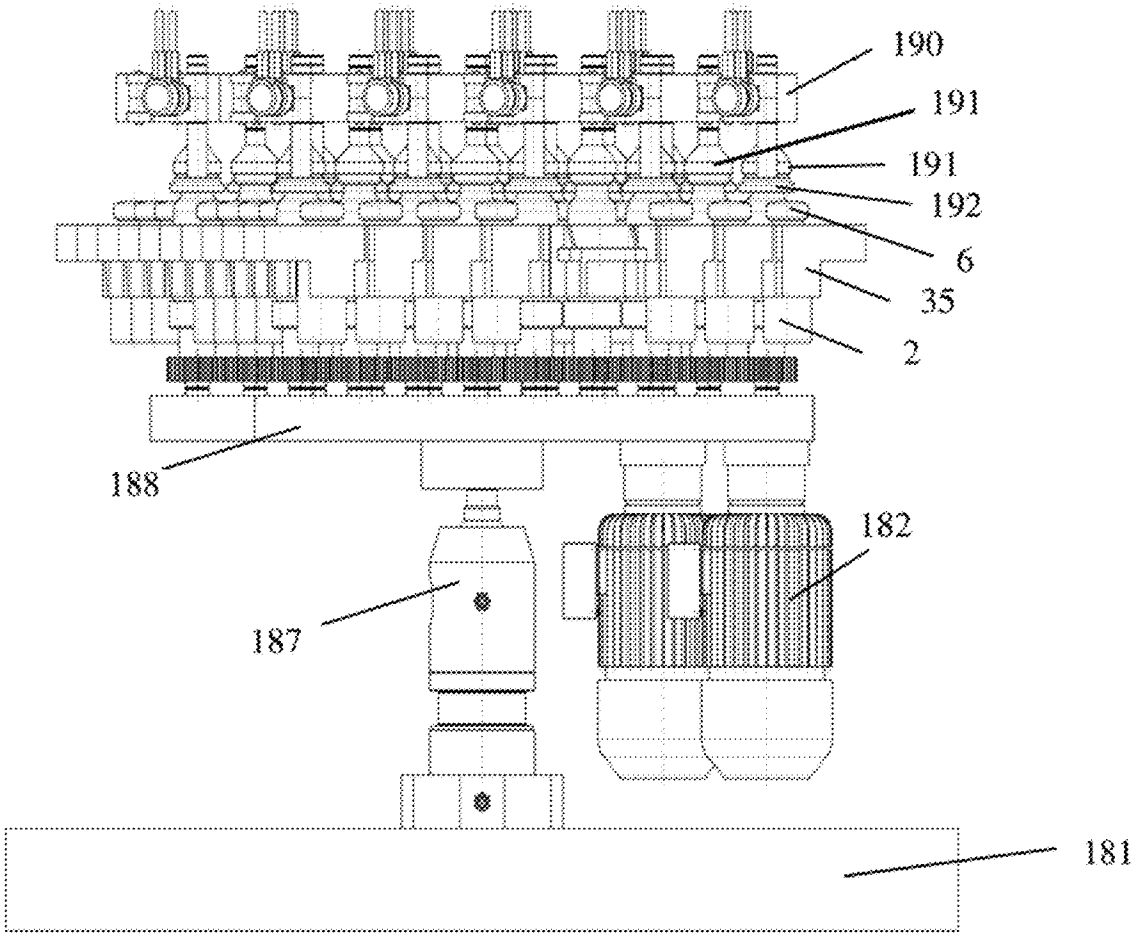
Figure 3E:
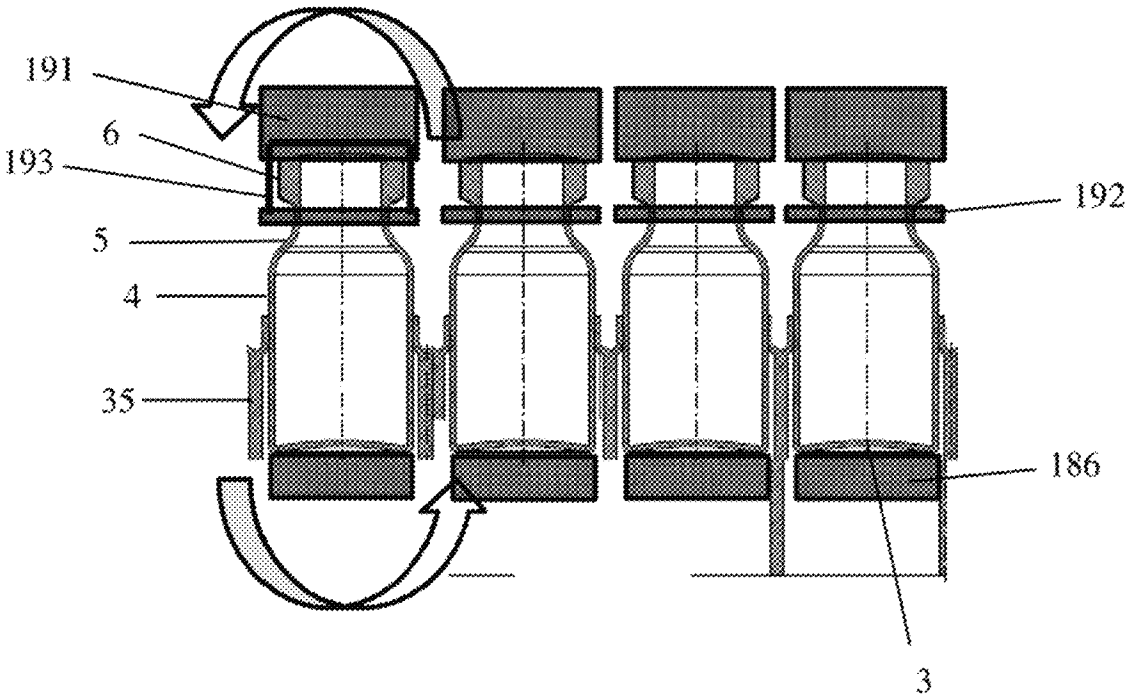
FIG. 3*e* shows in enlarged partial view the procedure for crimping metal lids onto the upper rims of containers in the processing station according to FIGS. 3*a* to 3*d;*

As can be concluded from the enlarged view of FIG. 3*e*, in the raised position the upper edge of the container 2 together with the plug inserted therein and together with a metal lid 193, for example an aluminum cap, are accommodated in an associated centering disc 191 for centering the rotational movement of the container during rotation of the turntable 186. During rotation of the container 2 a crimping disc 192, which is supported on the arm 190, gets in contact with the metal lid 193 so that it is suitably crimped by deforming, so as to seal the container sterile.

If all containers 2 of a carrier have been processed in the manner described above, the carrier is removed from the region of the crimping station 180 and is then conveyed further in the processing apparatus (not shown). For this purpose, the containers can be pushed back again into their normal position in the openings or receptacles of the carrier and the carrier can then be transferred back into the position shown in FIG. 2*b*, for example, by insertion into a transport and packaging container. The processing in the crimping station thus is performed in batches, without the need of completely taking the containers out of the carrier. The transverse webs 35 of the carrier prevent at all times of the processing a collision of directly adjacent containers, which prevents an undesired wear and contamination of the processing apparatus.

By means of a carrier according to the FIG. 2*a* or, as described below, according to the present invention a plurality of containers can be treated or processed concurrently or in batches, while they are supported on or at least guided by a carrier. According to further embodiments of the invention such a treatment or processing may also be performed, whilst the carrier together with the containers supported by it is arranged in a transport and packaging container, as shown in an exemplary manner in FIG. 2*c*. For this purpose, the carrier 25 (see FIG. 2*c*) may be suitably raised, for example, via the access openings 29, but without being removed from the transport and packaging container 1. If despite of all precautions a container is ruptured or if for other reasons a contamination occurs during treatment or processing, the resulting impurities are in any case retained in the transport and packaging container and thus are at least prevented from entering the actual processing apparatus.

Figure 3F:
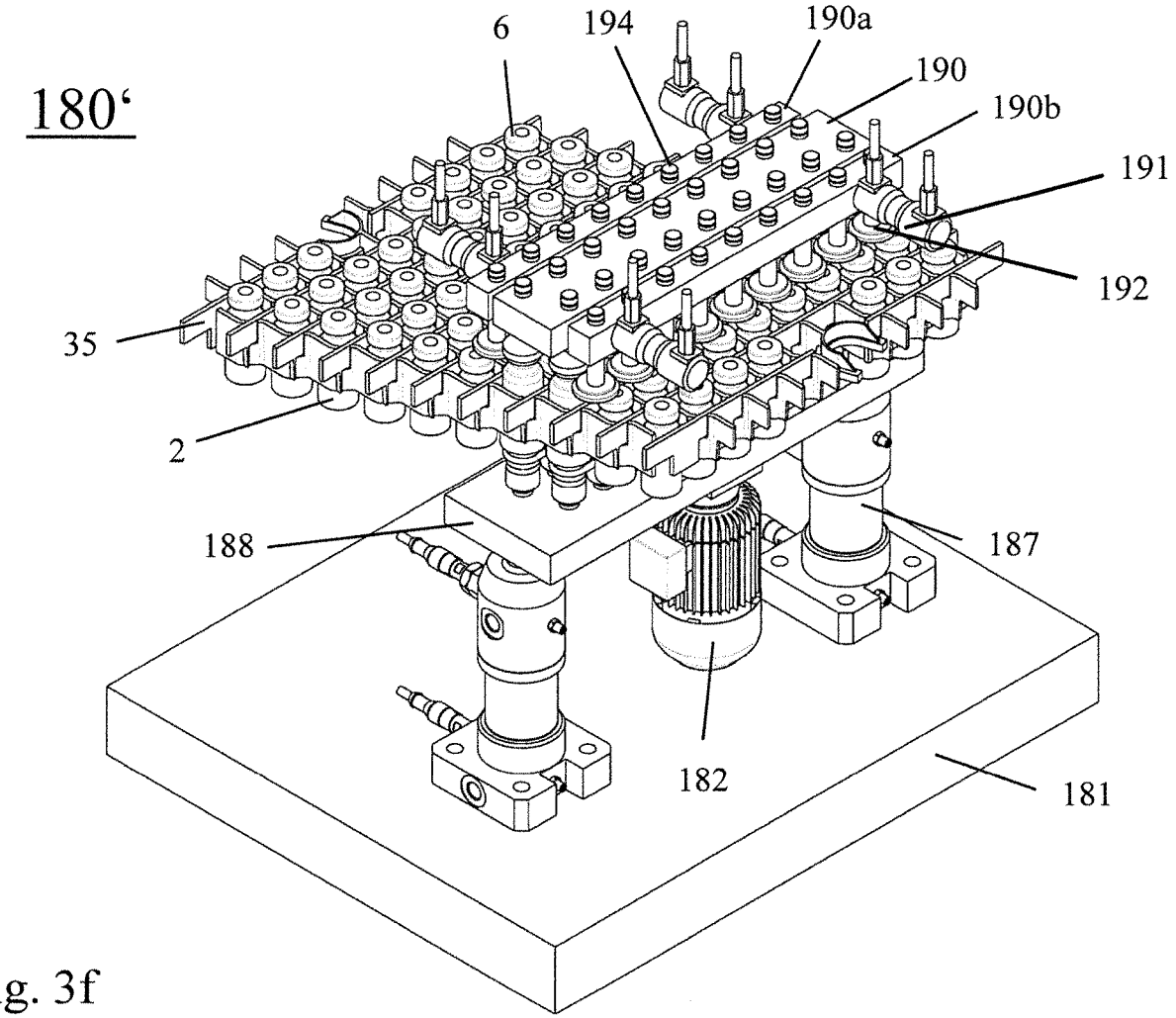
FIGS. 3*f* and 3*g* show two further variants of processing stations for crimping metal lids onto the upper rims of a plurality of containers in a process according to the present invention.
Figure 3G:
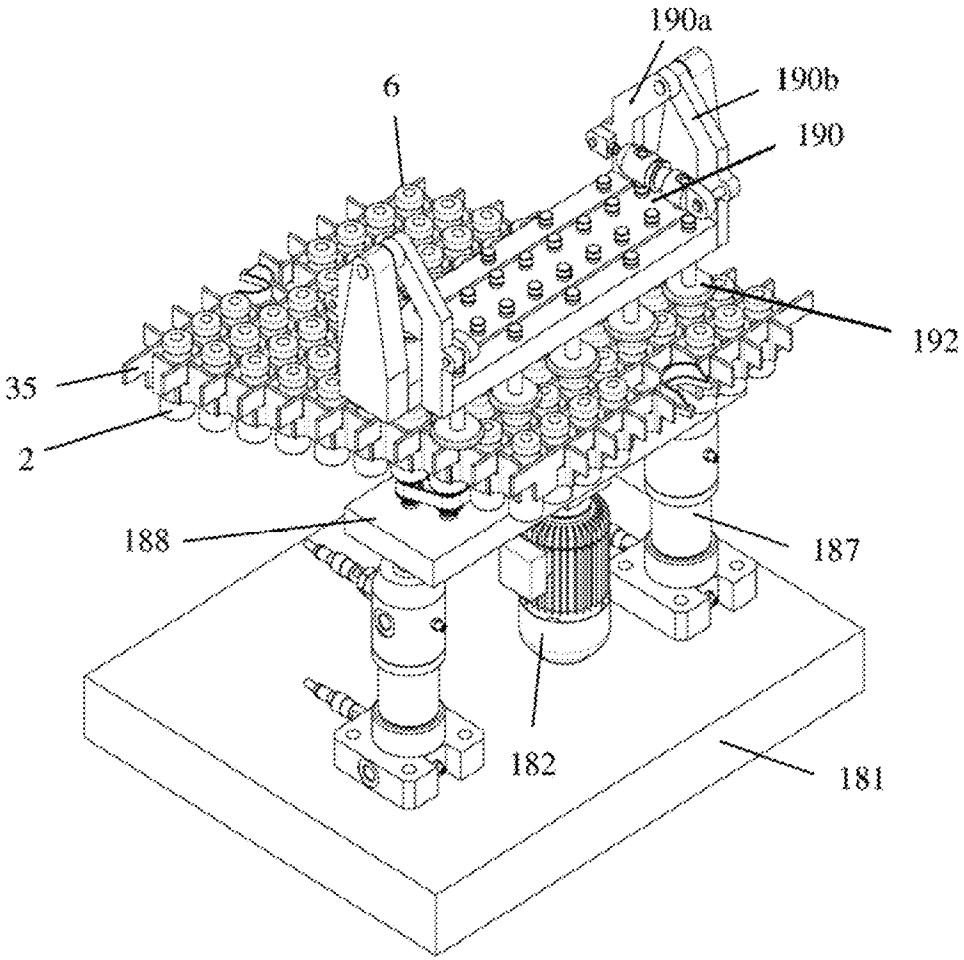

FIGS. 3*f* and 3*g* show further variants of the crimping station according to FIG. 3*a*. In the crimping station of FIG. 3*f* the centering discs 191 are mounted on a central support arm 190, whereas the crimping discs 192 themselves are mounted to support arms 190*a*, 190*b* extending in parallel with them, wherein the distance and orientation relative to the central support arm 190 can be adjusted suitably, for example in accordance with the respective type of container with different dimensions to be processed. In the variant of FIG. 3*g* this adjustment is performed by appropriate adjustment of the lateral support arms 190*a*, 190*b* that are pivotally mounted on the central support arm 190.

In the method according to the present invention, the crimping discs are always disposed above the containers that are already sealed by means of a plug. Thus, the entry of contaminants or debris into the containers can be excluded reliably according to the invention.

While it has been described above, that the supporting structure is supported on the supporting surface formed by the step 13 near the upper edge, according to the embodiment of FIG. 4*a* the supporting structure 25 is supported directly on the bottom 11 of the transport and packaging container 10. This works in principle for all supporting structures that have a certain axial length, be it that the bottoms of the containers 2 rest directly on the bottom 11 of the container 10 or be it that they rest on the bottoms of the elongated receptacles 39 of the holding structure 25. In the embodiment shown in FIG. 4*a*, the supporting structure 25 is formed by a plurality of perpendicularly intersecting transverse webs 35 which form a plurality of elongated receptacles 39 with a square cross-section, wherein the receptacles 39 are arranged in a matrix arrangement. The containers 2 are supported at their lower ends by friction by the transverse webs 35 provided thereon or they are fixed by an insert made of a flexible plastic material. FIG. 4*b* shows a schematic partial section through this supporting structure. The clamping of containers 2 having different heights is shown by way of example. In principle, the supporting structure 25 may also be formed integrally with the bottom 11 of the container 10.

Figure 5A:
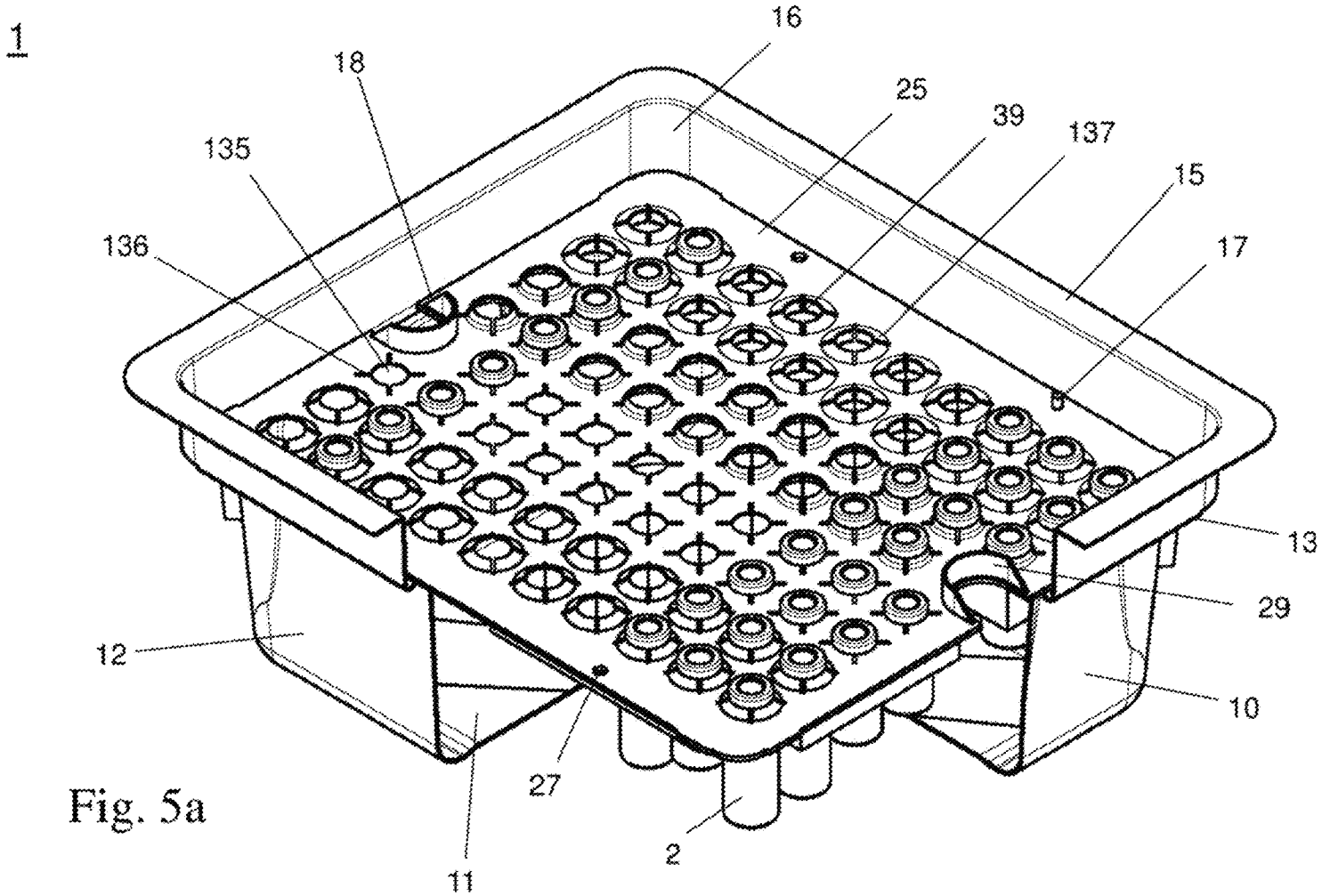
FIGS. 5*a*-5*d* show a transport and packaging container according to a further embodiment for use in a process according to the present invention.
Figure 5B:
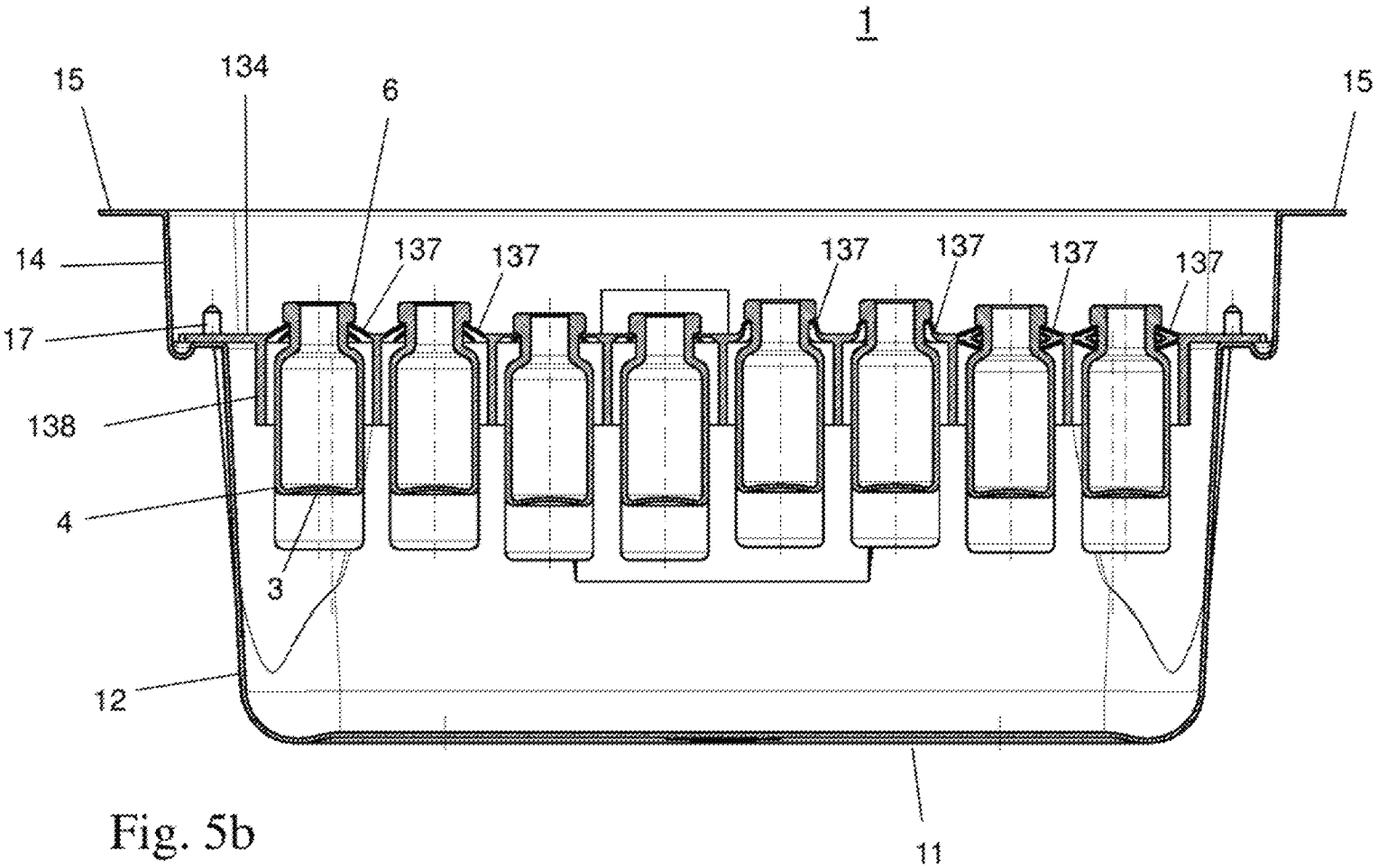
Figure 5C:
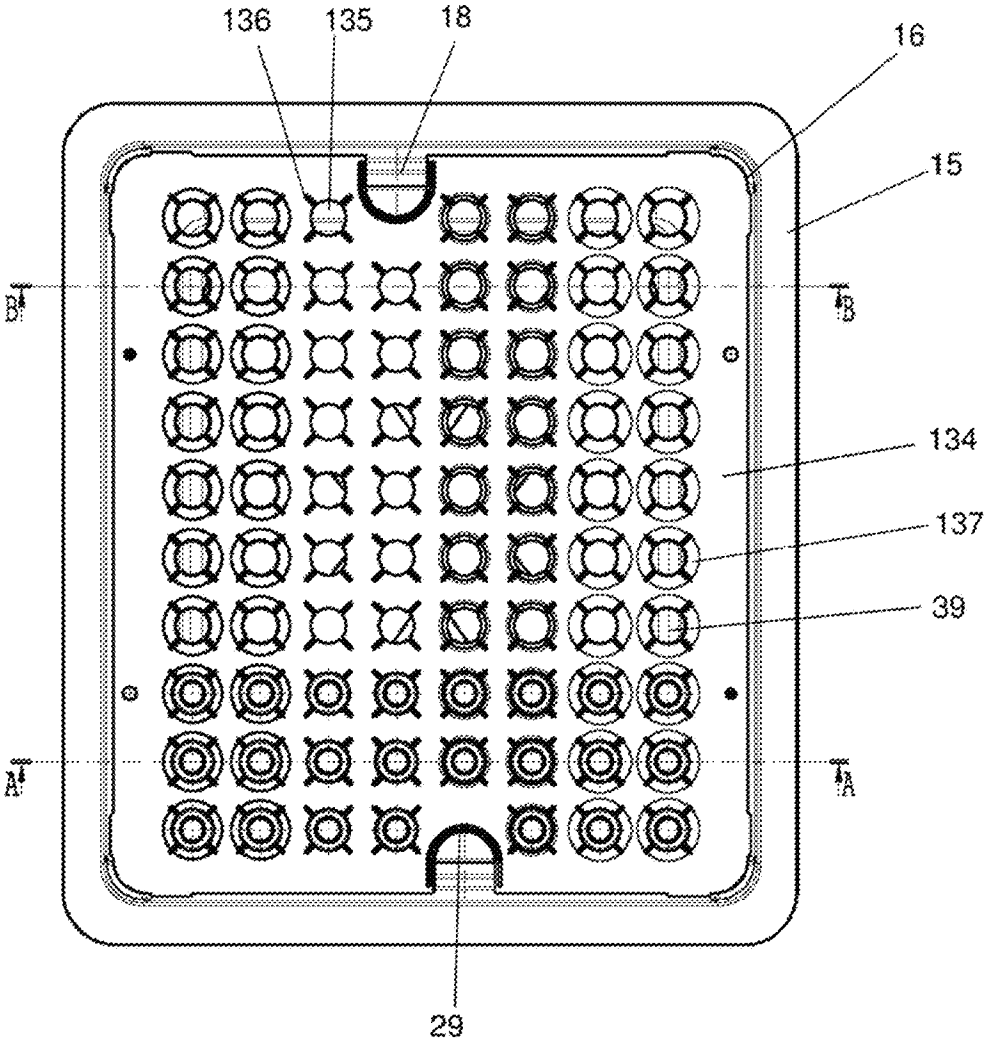

FIGS. 5*a* to 5*c* show a further embodiment of a supporting structure (carrier), wherein a plurality of containers 2 can be supported in a positive-fit manner. Here, according to FIG. 5*a* a plurality of openings 39 are formed in the planar transport board 25 for receiving the containers 2.

The openings are formed in annular form-fitting members 137, which are either inserted in the openings 39, in particular they are latched or clipped in their peripheral edges, or which are formed integrally with the planar carrier 25, e.g. by a 1K or 2K plastic injection molding process.

The schematic longitudinal section of FIG. 5*b* summarily shows in a comparative drawing several different variants for form-fitting members 137. In the fixed state, the form-fitting members 137 support the containers directly below the upper rim 6 and in the region of the constricted neck portion 5.

Although in FIG. 5*a* the bottom 11 of the container 10 is shown to be closed and formed integrally with the side wall 12, the lower end of the container 10 may also be formed open and in the way of the upper end, in particular it may be provided with a flange-like bottom edge in the manner of the upper rim 15 so that the bottoms of the containers 2 are freely accessible from the bottom side of the container 10, for example, for processing steps in a sterile tunnel or in a freeze-dryer, as explained below.

Figure 6A:
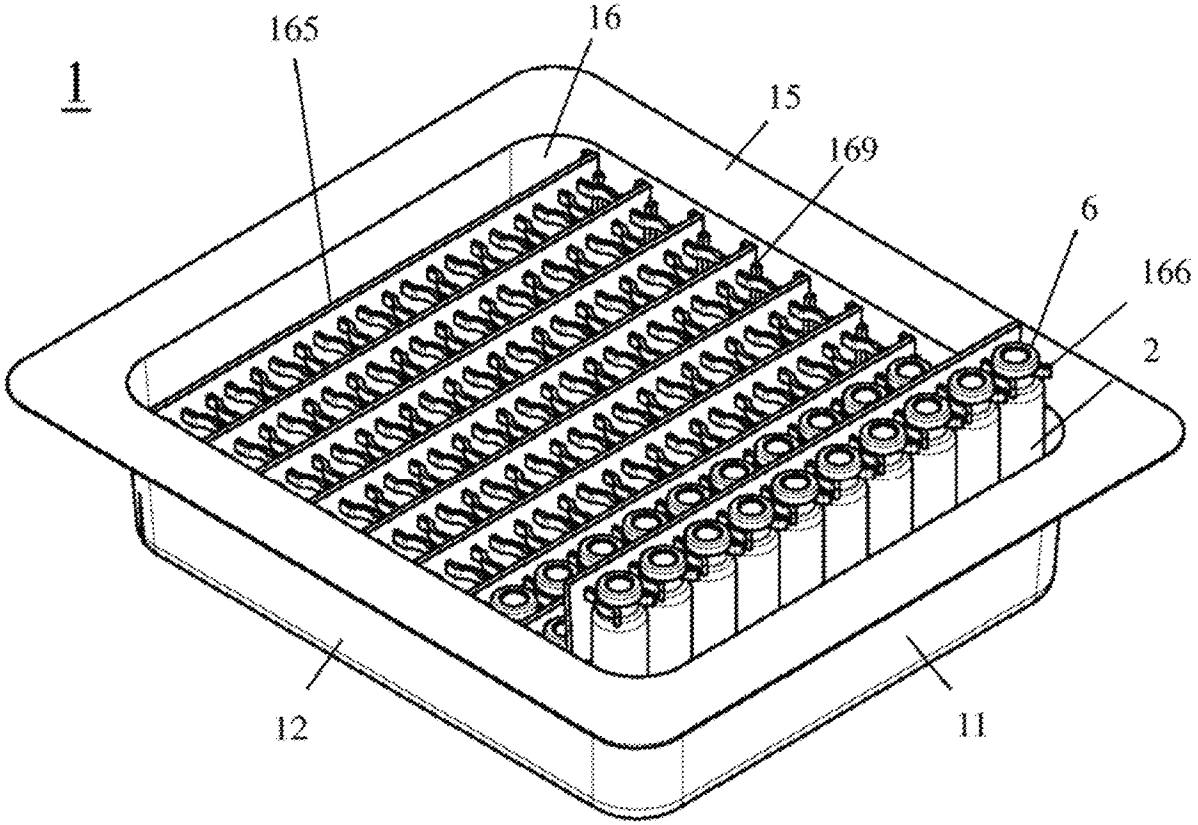
FIGS. 6*a*-6*c* show a transport and packaging container according to a further embodiment for use in a process according to the present invention.
Figure 6B:
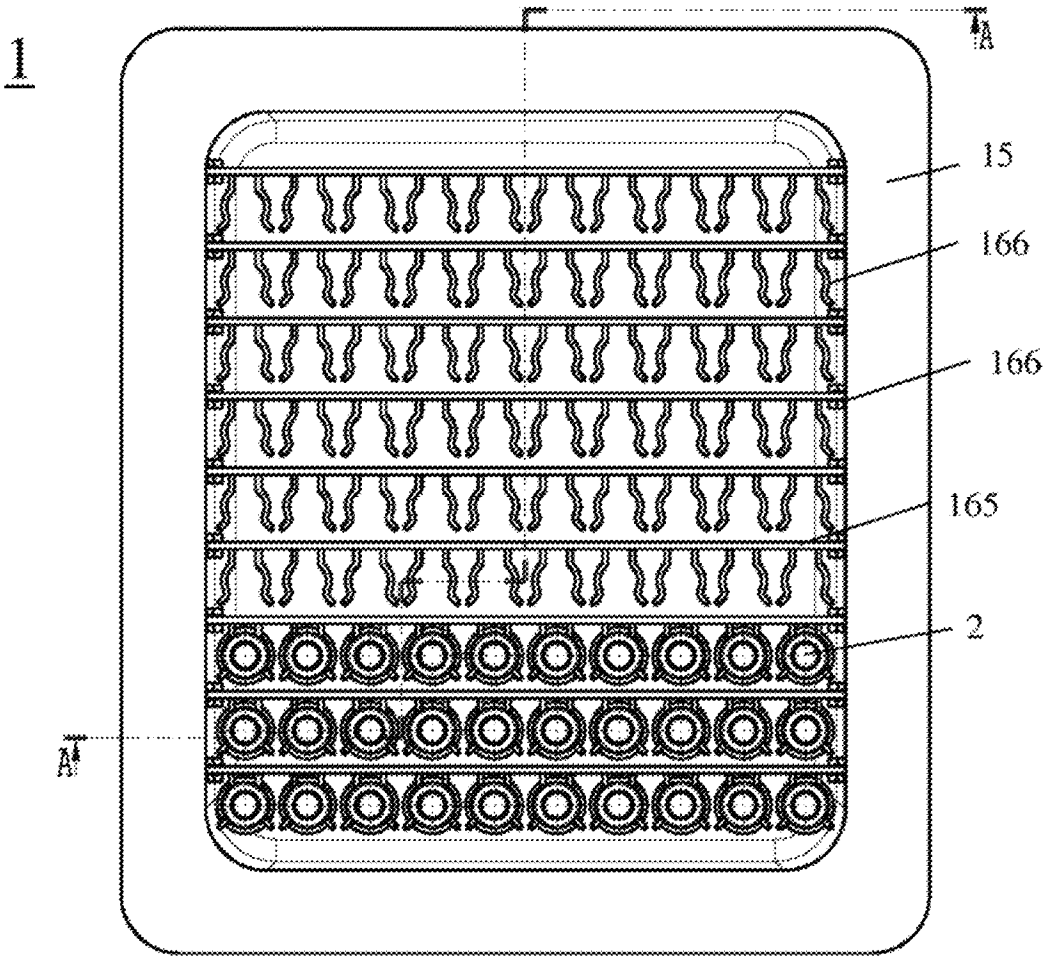
Figure 6C:
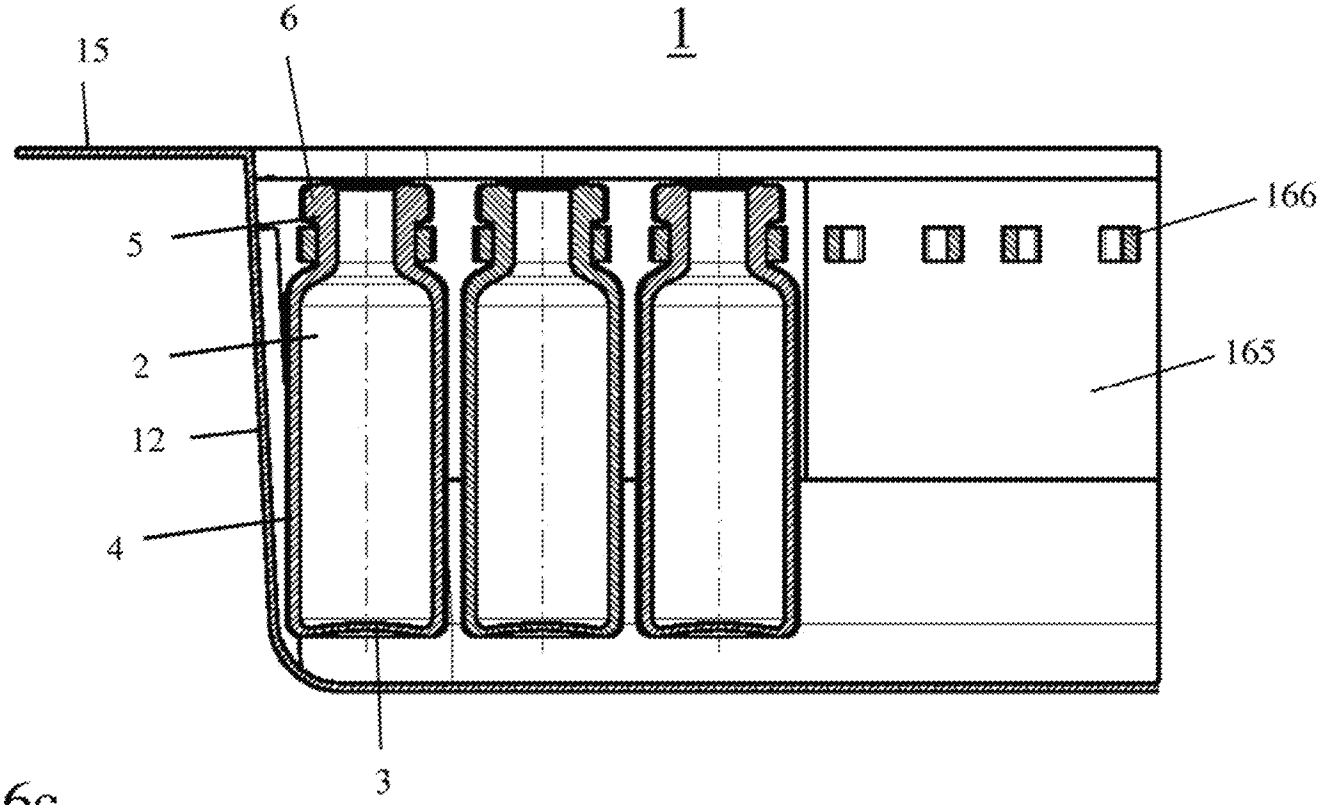

FIGS. 6*a* to 6*c* show a further embodiment of a transport and packaging container 1. According to FIG. 6*a*, the supporting structure 25 is formed as a box, with circumferential side walls 168. This box 168 is divided into several rectangular segments by a plurality of transverse webs 165, which extend in parallel with each other and which are spaced apart from each other at regular intervals. On the surfaces of the transverse webs 165 concavely bent support arms 166 are formed at the same levels and at regular intervals from one another, which are formed from an elastic plastic material and which are either formed integrally with the transverse webs 165 or are mounted to them or are formed integrally. The support arms 166 form receptacles, in which the containers can be inserted from the front end such that their neck portions are embraced in a positive-fit manner and that the upper rim can be supported thereon, as shown in FIG. 6*c*. In the longitudinal direction of the containers 2 a positive-fit is provided. By applying a suitable axial force, however, the containers 2 can be displaced in axial direction while being in the receptacles formed by the support arms 166, for example to a raised position, as described above with reference to FIGS. 3*a* to 3*d*.

Figure 7A:
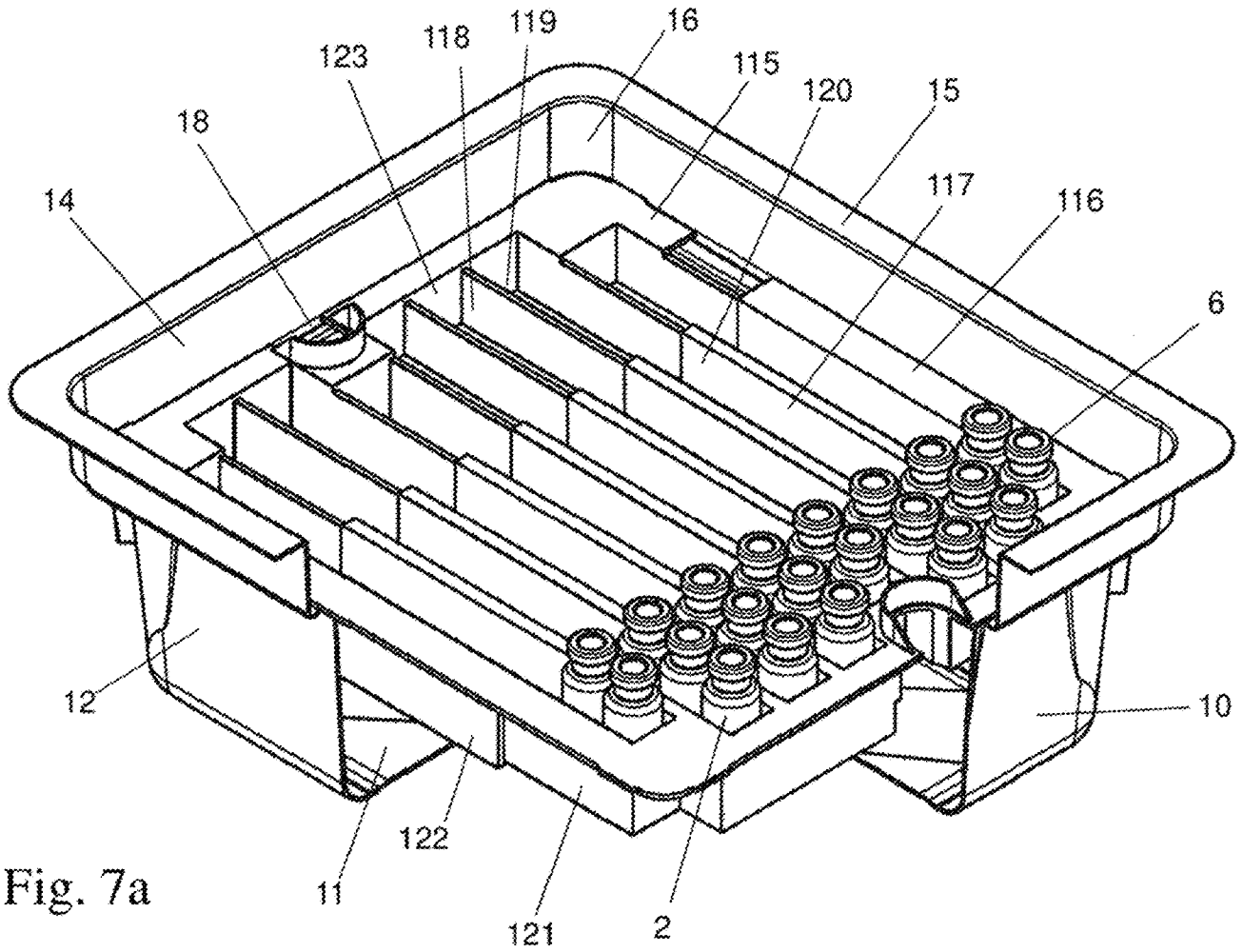
FIGS. 7*a*-7*b* show a transport and packaging container according to a further embodiment for use in a process according to the present invention.

FIG. 7*a* shows a further embodiment of a transport and packaging container 1, having a holding insert, which is formed by two telescoping parts, which together form elongated holding receptacles, which are rectangular in profile and extend in parallel with each other and in which the containers 2 are accommodated and fixed by friction. More specifically, a plurality of rectangular receptacles 120, which extend in parallel with each other, are formed by the guide walls 117 in the right-hand sliding member 116 and corresponding elongated holding receptacles are formed by the side walls 118 in the left-hand sliding member 115. The guide walls 117 are slotted, as can be concluded from the sectional view of FIG. 7*b*. In the longitudinal slots of the guide walls 117, the correspondingly shaped side walls 118 of the left-hand sliding member 115 are slidably guided and accommodated. The two sliding members 115, 116 can be slid together until the front and rear ends 123 of the receptacles 120 directly abut the containers 2 accommodated in the receptacles 120, so that the containers 2 are clamped by the two side walls of the receptacles 120. Basically, the side walls of the receptacles 120 can be formed with supporting protrusions or recesses corresponding to the containers 2, so that the containers 2 do not contact each other directly when they are accommodated in the receptacles 120, but are accommodated spaced apart to each other in the receptacles formed by the protrusions or recesses.

Figure 7B:
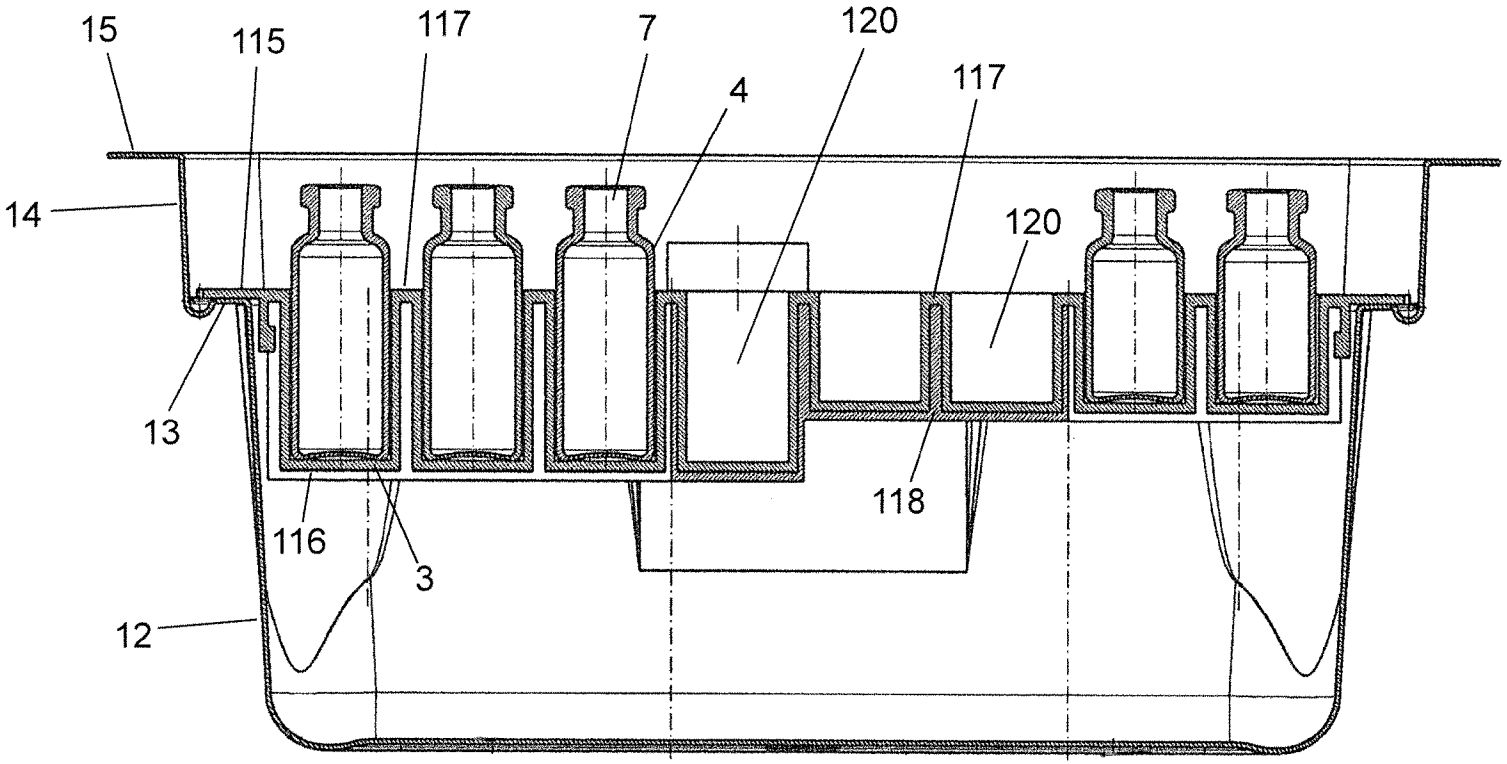

According to a preferred further embodiment, the side walls 118, 122 of the left-hand sliding member 115 is wedge-shaped, if viewed in the longitudinal direction of the receptacles 120, so that the opening width between the side walls 117 of the right-hand sliding member 116 becomes smaller and smaller, until the containers 2 are fixed by friction, in particular clamped, in the elongated receptacles 120. FIG. 7*b* is a schematic sectional view showing the accommodation of containers having different heights in receptacles 120 of different heights (the left-hand and right-hand part of the drawing).

Figure 10:
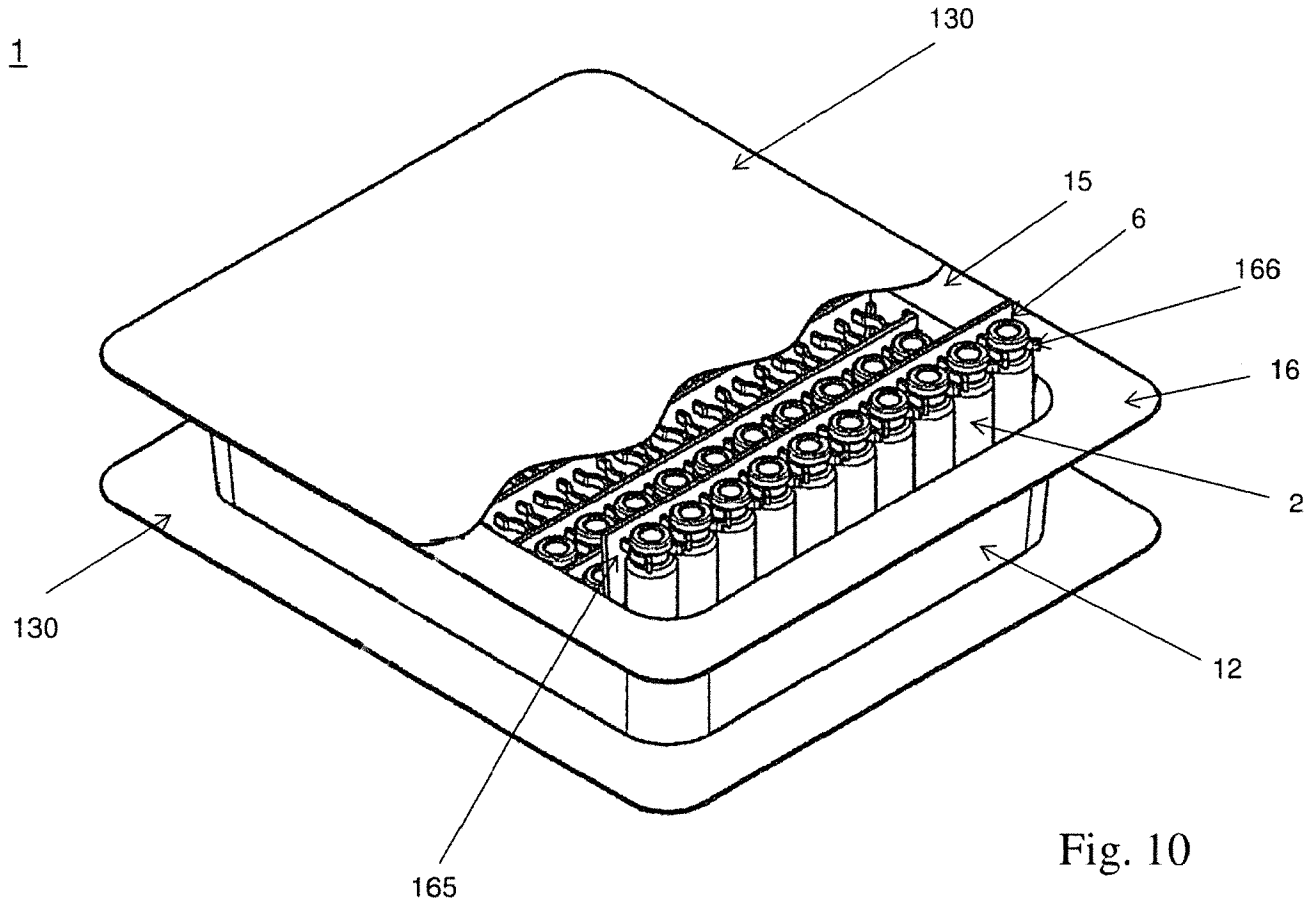
FIG. 10 shows a transport and packaging container according to a further embodiment for use in a process according to the present invention.
Figure 11A:
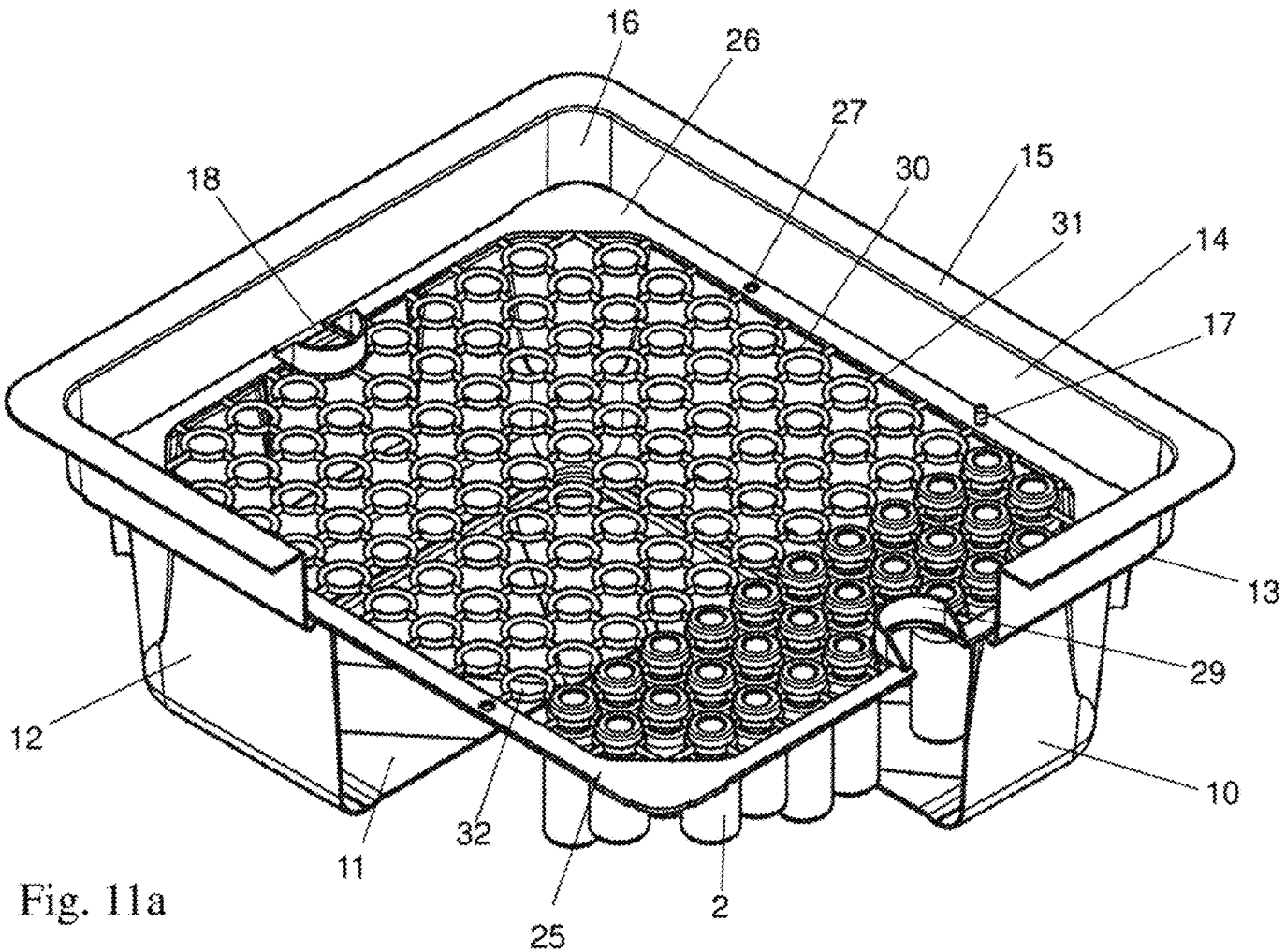
FIGS. 11*a*-11*e* show a transport and packaging container according to a further embodiment for use in a process according to the present invention.
Figure 11B:
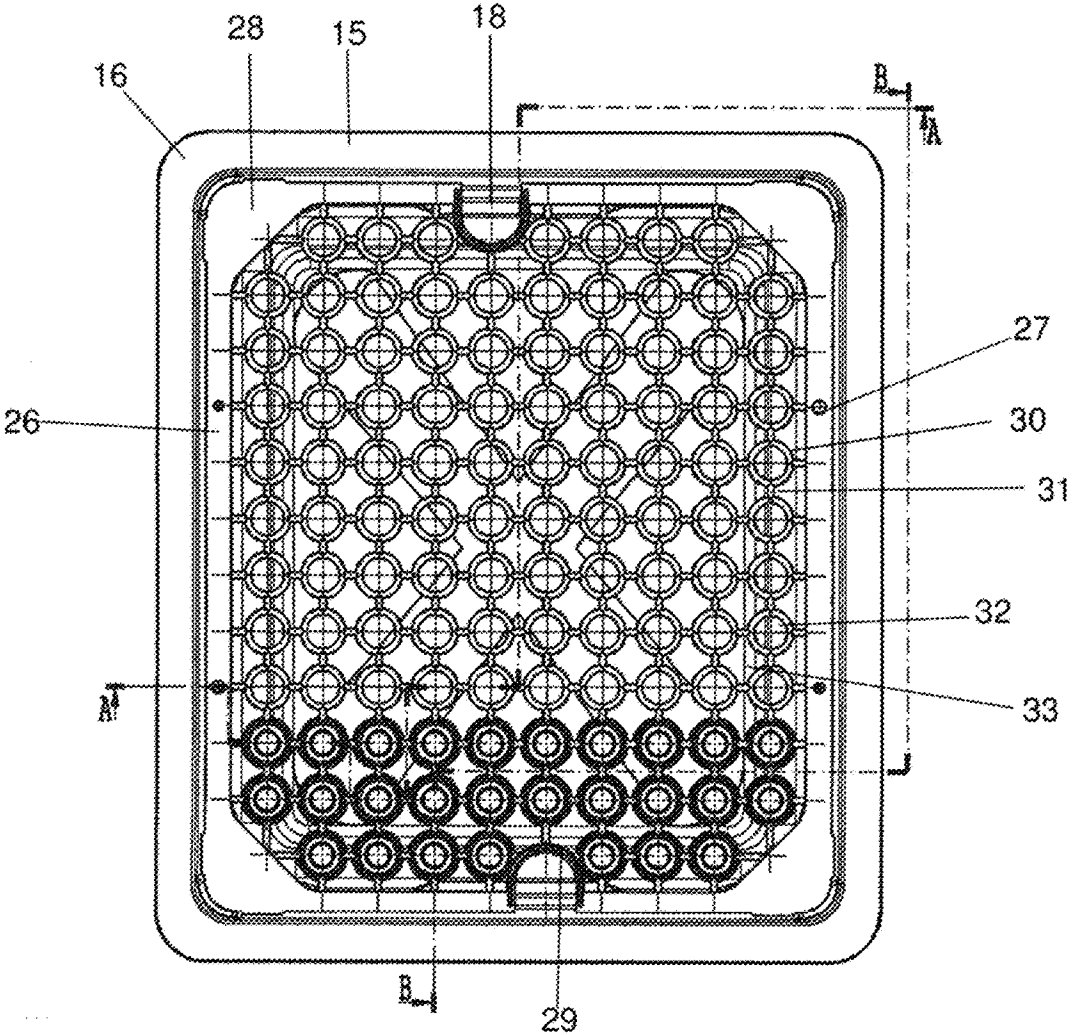
Figure 11D:
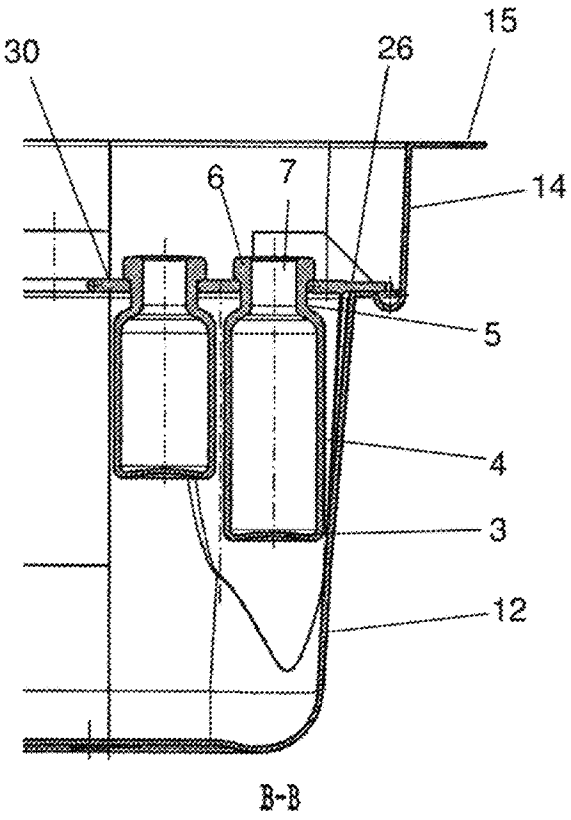
Figure 11C:
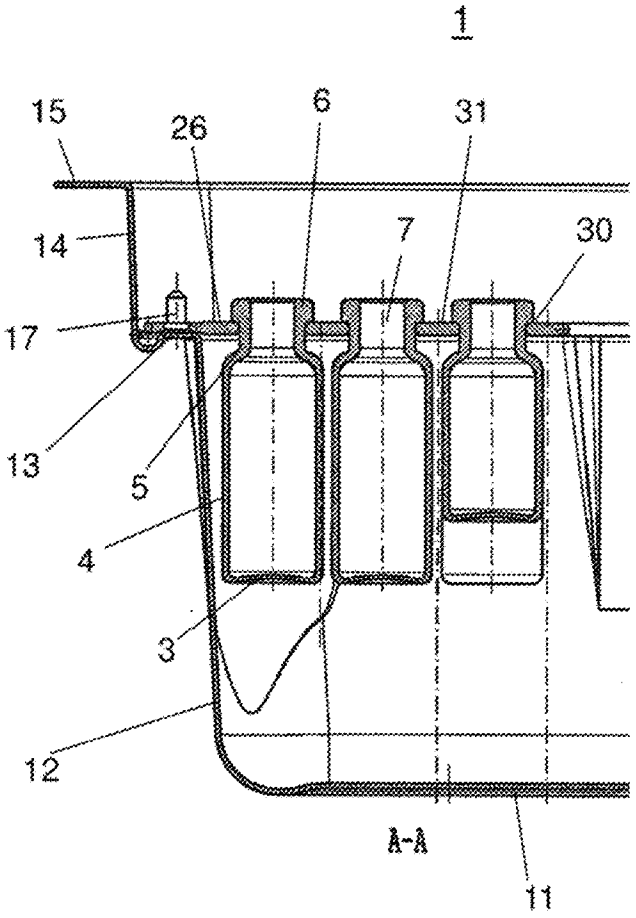
Figure 11E:
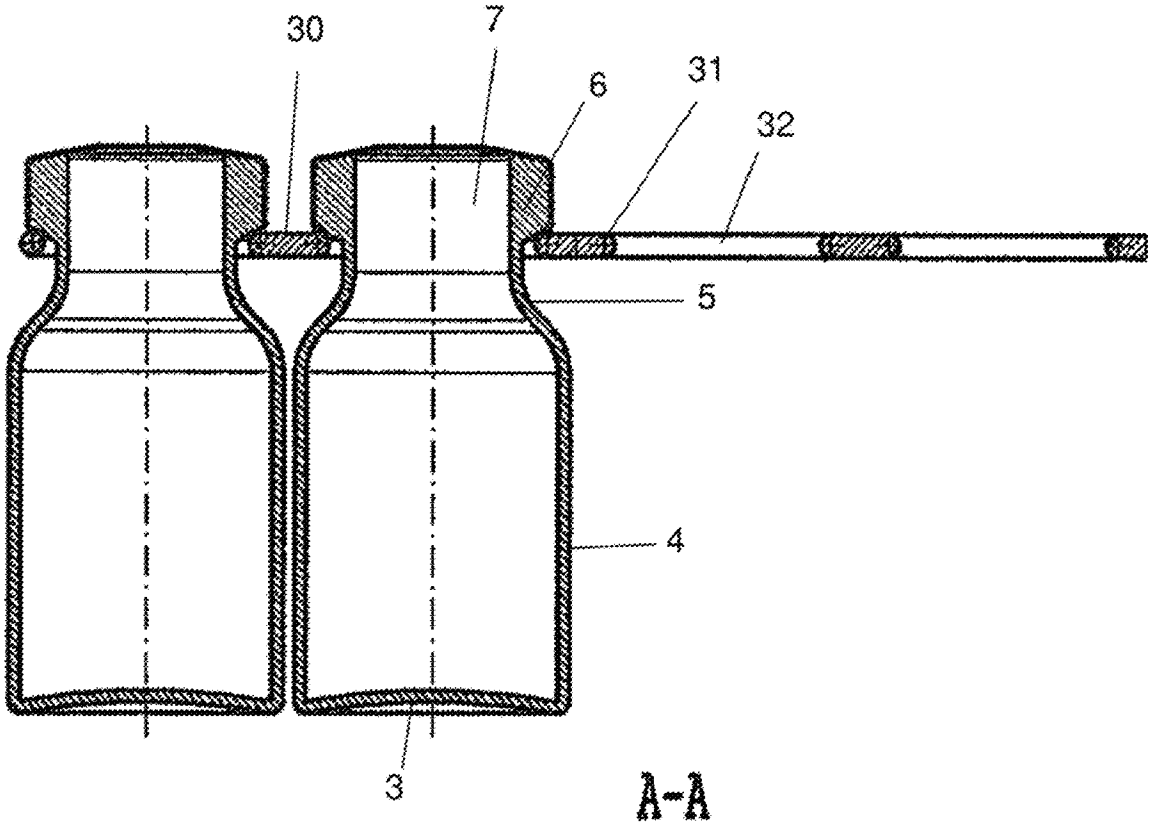

The upper side or the upper and bottom side of a supporting structure 25 according to the present invention or also of a transport and packaging container 1 according to the present invention may be covered by a sterile, gas-permeable protective film, which is glued and can be removed as needed. This is exemplified in FIG. 10 for a packaging unit formed by a transport container, which is open at both ends, and by a supporting structure as shown in FIG. 6*a* accommodated therein and which is sealed on the upper side and bottom side by means of a protective film or a packaging film 130 glued onto the edge 15. The protective film 130 may be in particular a gas-permeable plastic film, in particular a network of plastic fibers, for example of polypropylene fibers (PP), or also a Tyvek® protective film, which enables a sterilization of the containers 2 through the film 130, which are accommodated and packaged in the supporting structure 25.

Figure 9A:
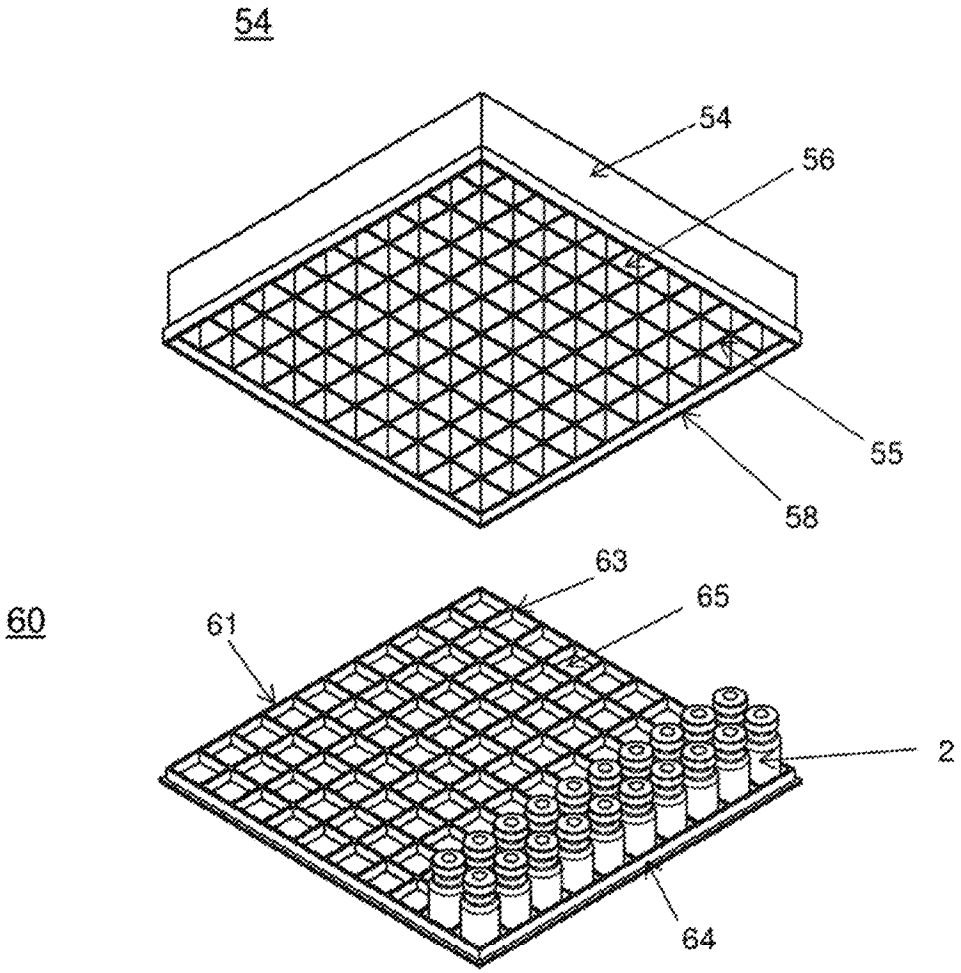
FIGS. 9*a*-9*b* show a transport and packaging container according to a further embodiment for use in a process according to the present invention.
Figure 9B:
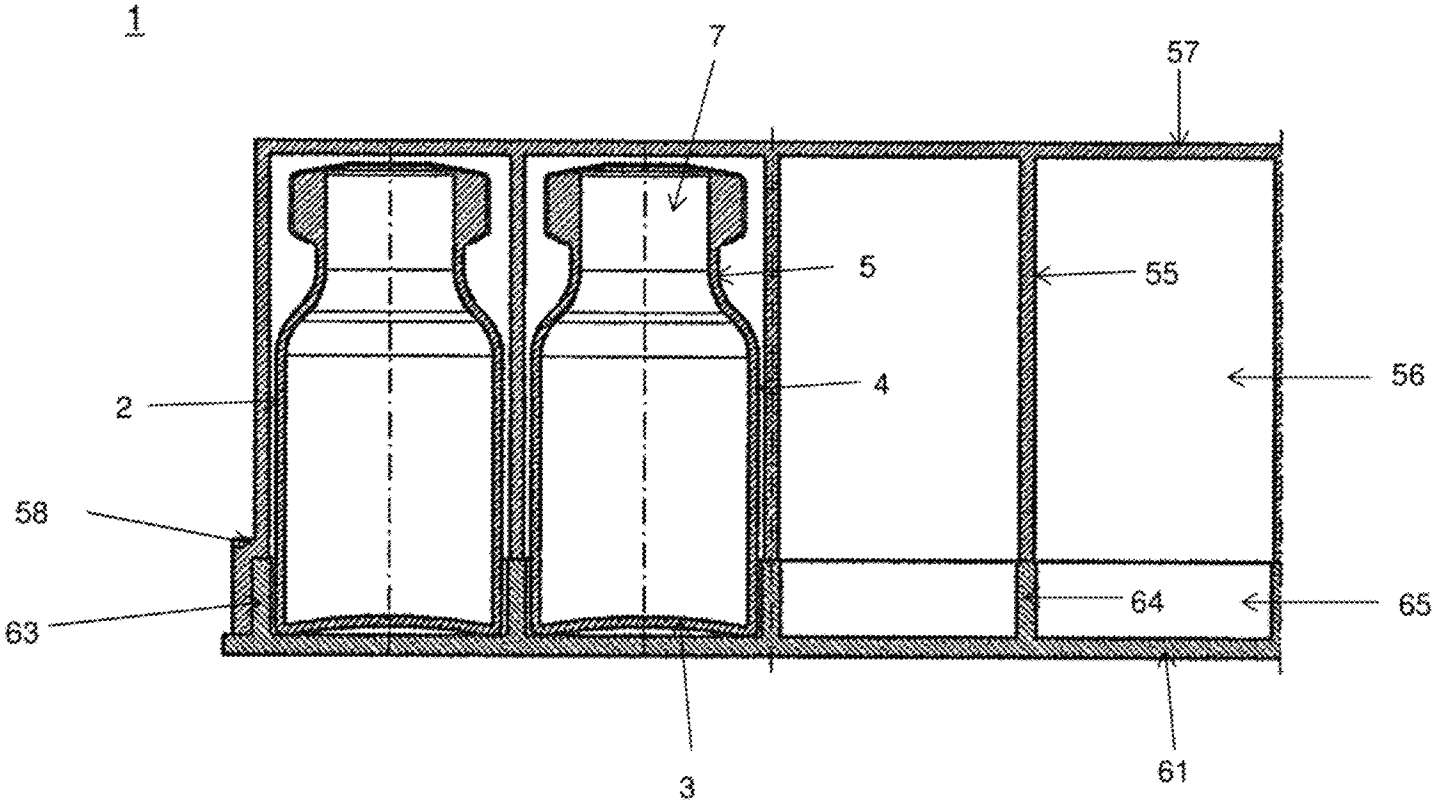

FIG. 9*a* shows a further variant in which the aforementioned edge portion of the base plate are formed very narrow, so that the side walls 63 of the supporting structure 60 are received directly in the corresponding edge portion 58 of the insert 54, as shown in the sectional view of FIG. 9*b*. In the assembled condition of FIG. 9*b* a transport and packaging unit 1 is also formed, which can be hermetically sealed from the outside environment. According to FIG. 9*b* the bottoms 3 of the containers are supported directly on the base plate 61 and the containers 2 are fixed by friction near their lower ends in the elongated receptacles 65 formed by the transverse webs.

Figure 8B:
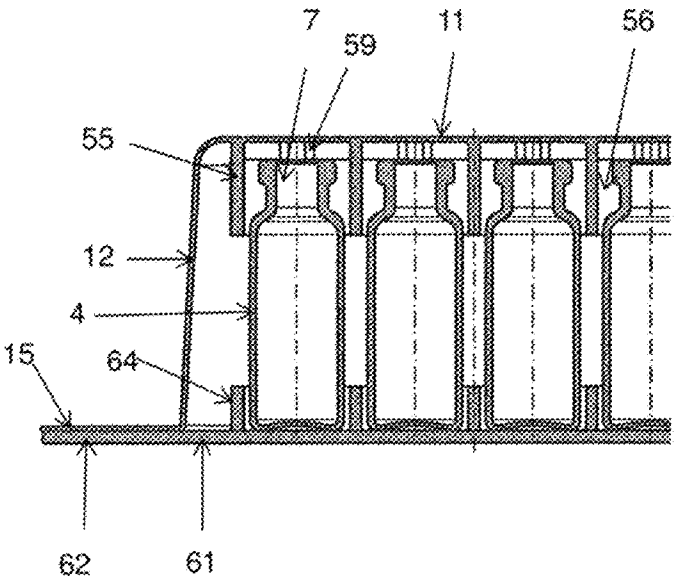
FIGS. 8*a*-8*e* show a transport and packaging container according to a further embodiment for use in a process according to the present invention.
Figure 8A:
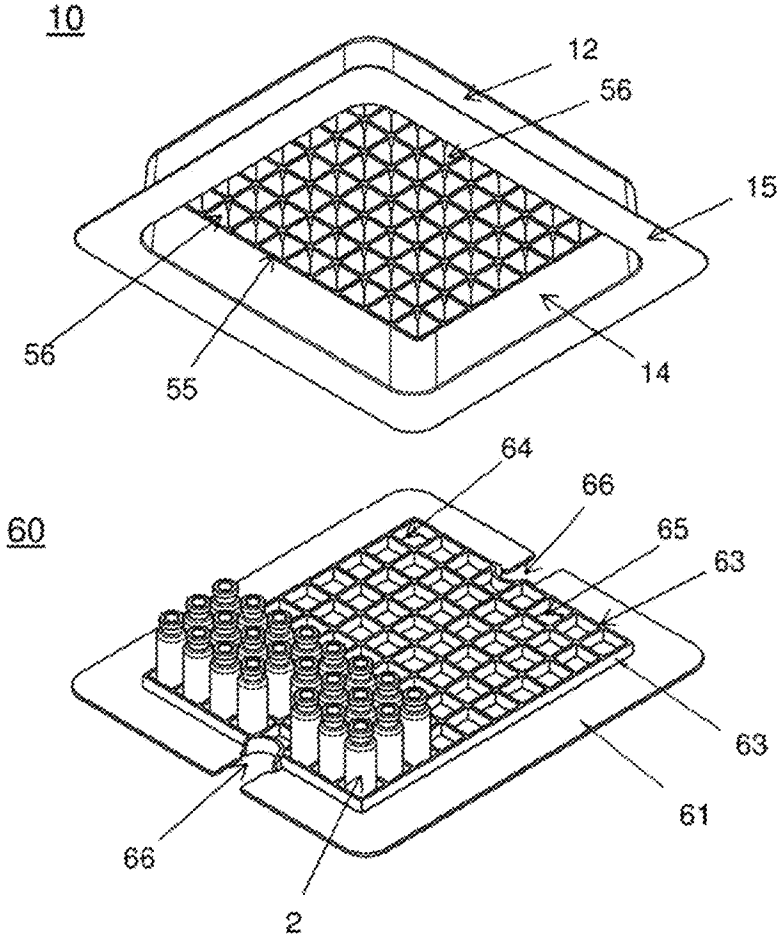

In a further embodiment according to FIG. 8*a*, the containers 2 are located directly on a protective or packaging film 130 on which a transport and packaging container 10, as described above with reference to FIG. 2*a* by way of example, is placed, wherein the transverse webs 55 formed on the bottom of the container 10 prevent a direct contact of the side walls 4 of the containers. At their upper ends, the containers may also be fixed by friction by the transverse bars 55, in particular they may be clamped. The film 130 may be in particular a sterile, but gas-permeable film, especially a plastic mesh, such as Tyveck®.

Figure 8D:
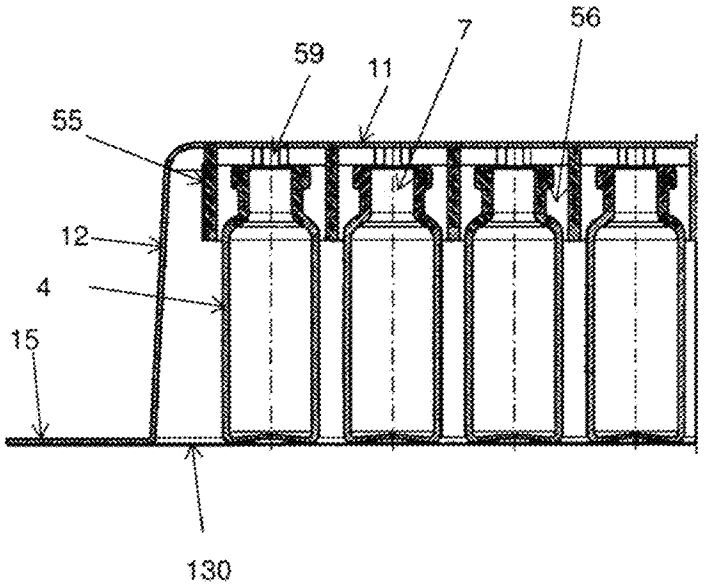
Figure 8C:
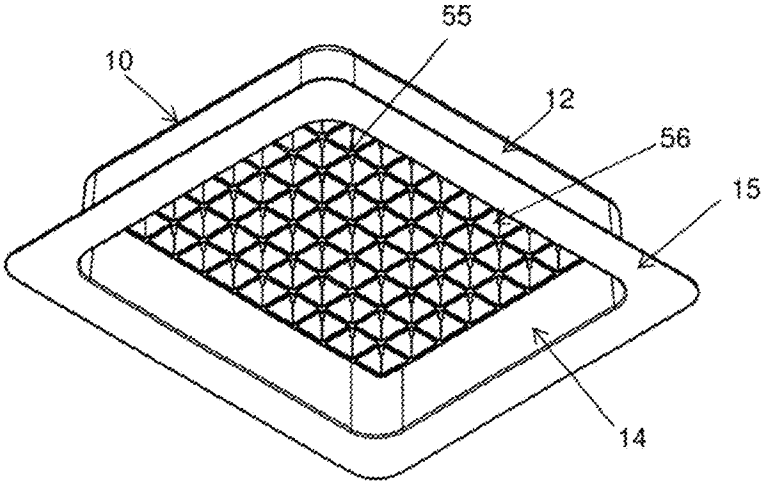
Figure 8C:
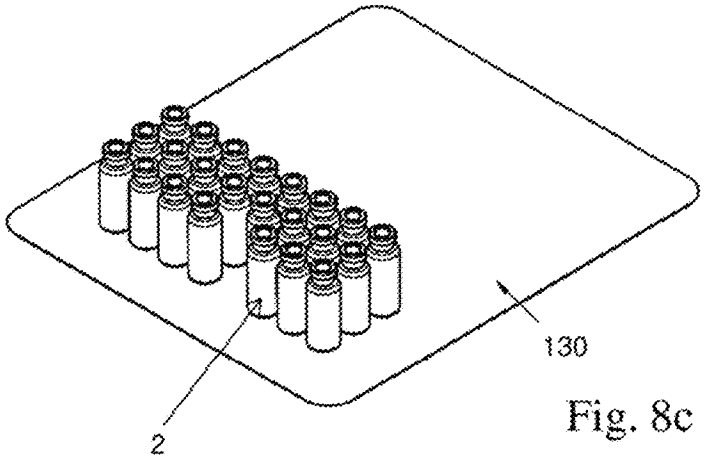
Figure 8E:
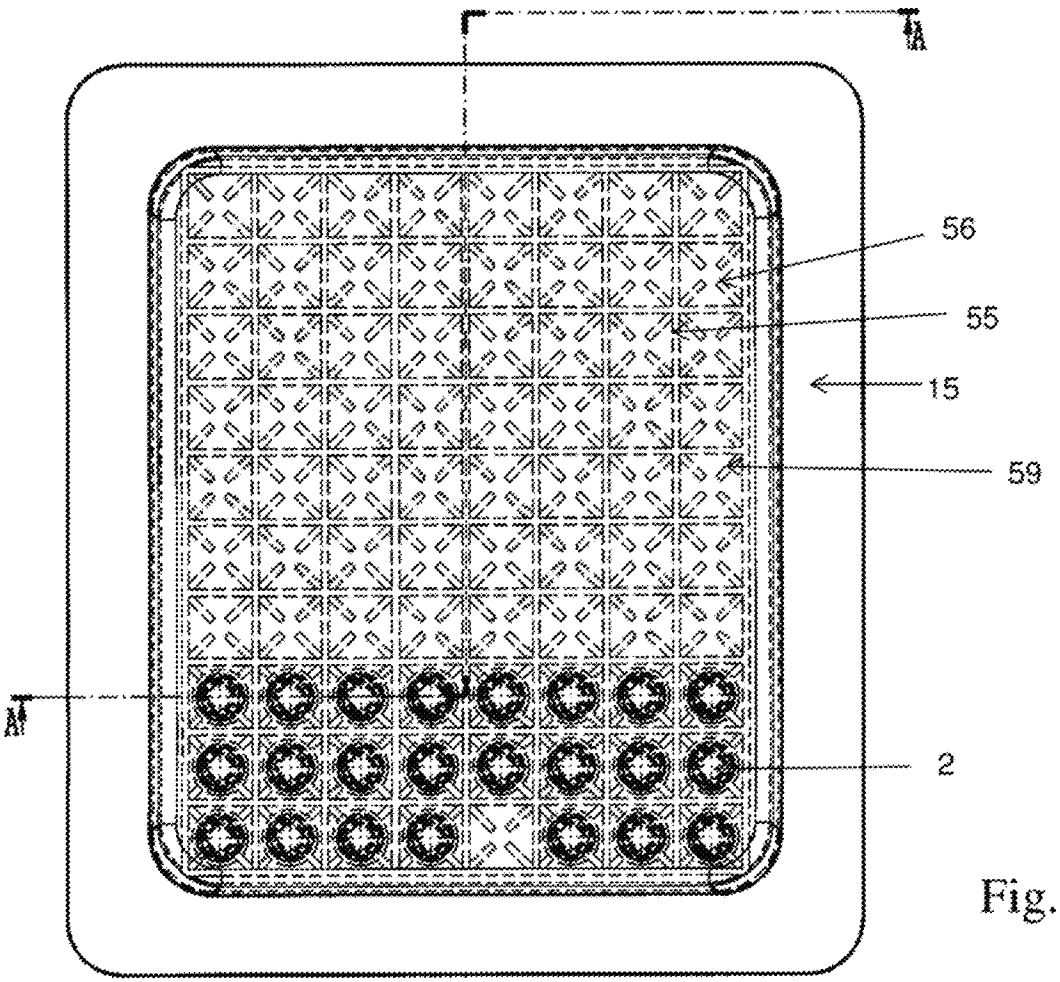

FIGS. 8*c* to 8*e* show a further variant of this embodiment, wherein the containers accommodated in the transport and packaging container 10 are sterilized through the film 130 by blowing-in a gas. To ensure that inflowing gases can flow into the inner volumes of the containers 2, spacers 59 are provided between the bottom 11 of the transport and the packaging container 10 and the upper rims of the containers 2, so that the containers do not rest directly on the bottom 11.

These spacers 59 may extend from the corners of a respective receptacle 56 diagonally toward the center of the respective receptacle 56. The cross-shaped spacer webs 59 are, however, not connected to each other so that the upper edges of the containers are freely accessible in the middle of a respective receptacle 56. FIG. 8*e* shows a plan view on the insert formed on the bottom of the transport and packaging container 10, which can be removable.

According to a further embodiment according to FIGS. 11*a* to 11*e* a planar transport board 25 is provided for concurrently supporting a plurality of containers 2, which is formed of a plastic material, e.g. by stamping or injection molding, and which consists of a plurality of circular eyelets 30 which are connected to each other. The eyelets 30 are sufficiently flexible or expandable, so that the containers can be inserted 2 from above or from below into the openings of the eyelets 30. This allows a plurality of containers 2 to be fixed by frictional in the region of their constricted neck portions 5. This is illustrated in more detail in the schematic longitudinal sectional views shown in FIGS. 11*c* to 11*e*.

For most of the embodiments described above, the bottoms of the containers are fully accessible from their bottoms when they are supported together on the carrier. This allows for example the batch-wise freeze-drying of a plurality of containers in a freeze-dryer, while they are supported together on the carrier. This will be described in more detail below with reference to FIGS. 12 to 14.

Figure 12:
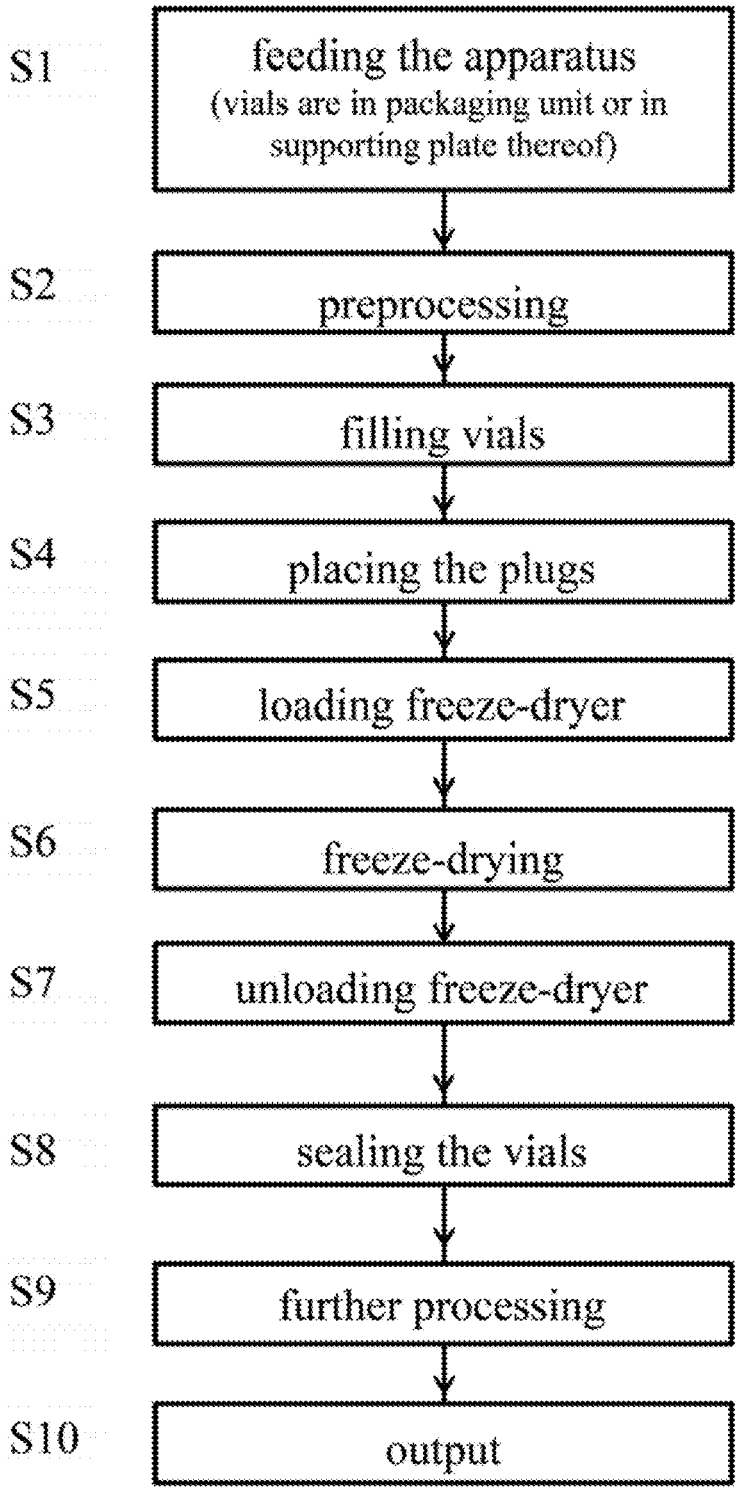
FIG. 12 is a flow diagram of a process for the treatment or processing of containers according to the present invention.

FIG. 12 shows a schematic flow diagram of such a process step, in which, in contrast to a conventional process step, as described above with reference to FIG. 1, a plurality of containers are supported together on a carrier or are at least accommodated by the latter in the process steps S1 to S9, at least in the process steps S5 to S7.

Figure 13:
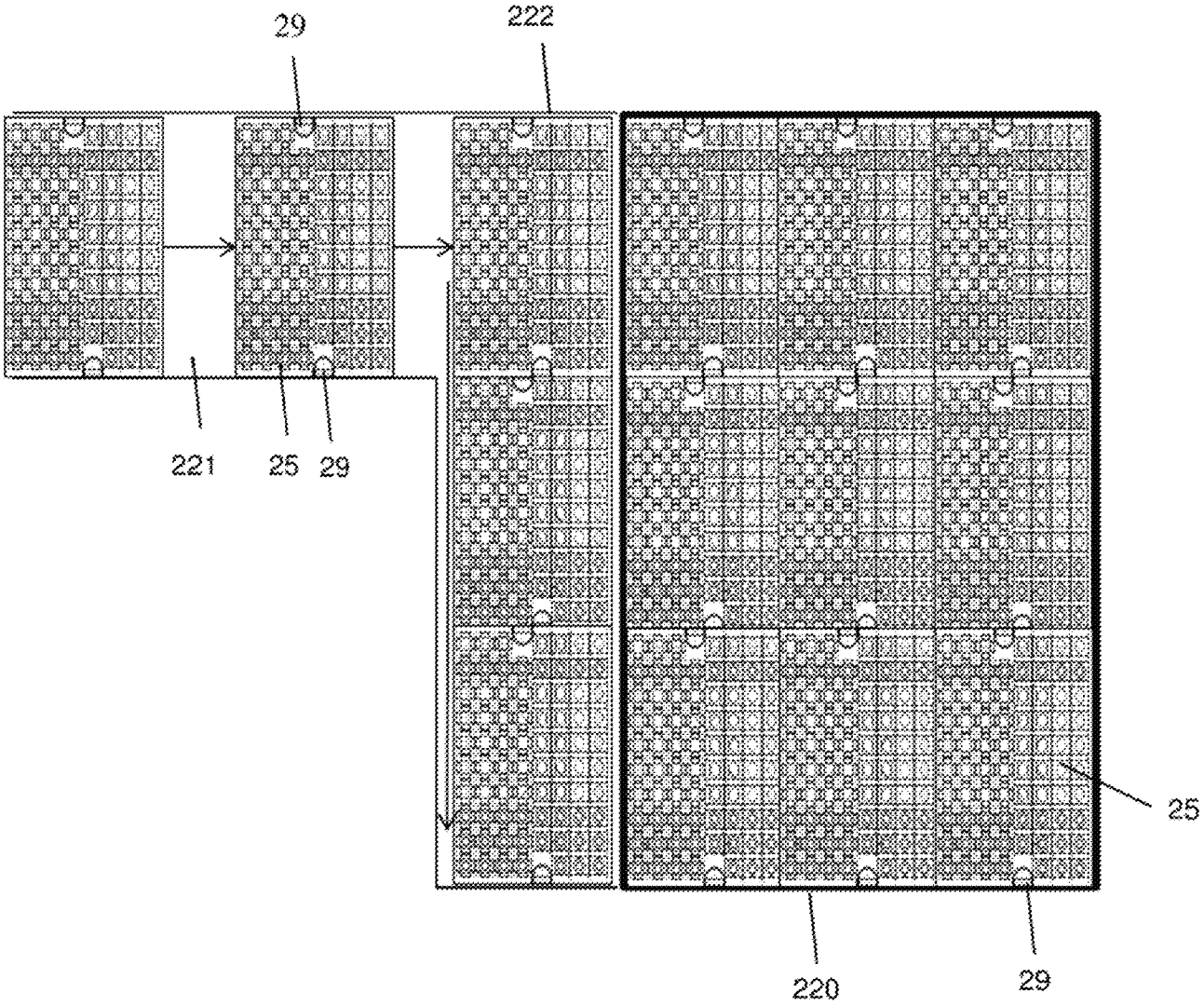
FIG. 13 shows in a schematic top view the use of a process according to the present invention for freeze-drying a substance in the containers.

This is shown schematically in the plan view of FIG. 13. The carriers 25 together with the containers supported by them in a regular two-dimensional array are conveyed by means of the conveying device 221, such as a belt conveyor or a roller conveyor, in the direction of the arrow toward a freeze-dryer 220. This can be arranged, for example, laterally to a main conveying device of a processing apparatus (not shown) which transfers or diverts the carriers 25 onto the conveying device 221 and conveys them towards a freeze-dryer 220. In front of the freeze-dryer 220 there is provided a shelf extending transversely to the conveying device 221 on which the carriers are collected. This collecting of the carriers 25 in front of the freeze-dryer 220 can also be performed on several levels in correspondence with the levels of the freeze-dryer 220.

Figure 5D:
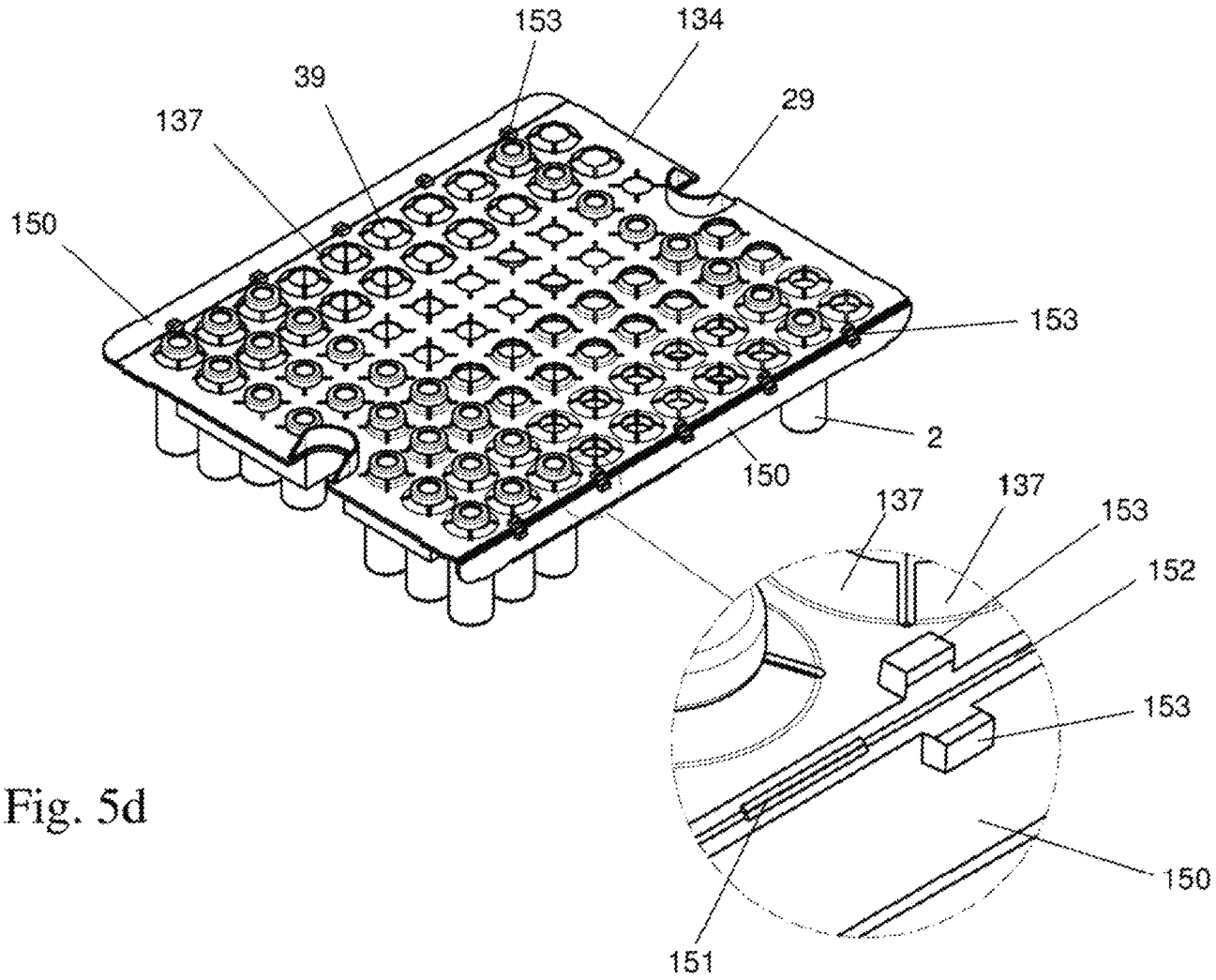

For reducing the base areas of the carriers 25 further, it may be of advantage if the edge portions of the carriers 150 (see FIG. 5*d*) can be removed or pivoted away, as shown in FIG. 5*d*. For this purpose, the edges 150 are connected with the carrier 134 via hinges 151 according to FIG. 5*d*. On the upper side of the carrier 134 and of the edges 150 block-shaped stops 153 are provided at corresponding positions which define a co-planar alignment of the edges 150 and of the carrier 134 by mutual abutment. According to a further embodiment (not shown), also the edges 150 can be removed from the carrier 134. Of course, the edges 150 may be provided along all four longitudinal sides of the carrier 134.

Figure 14:
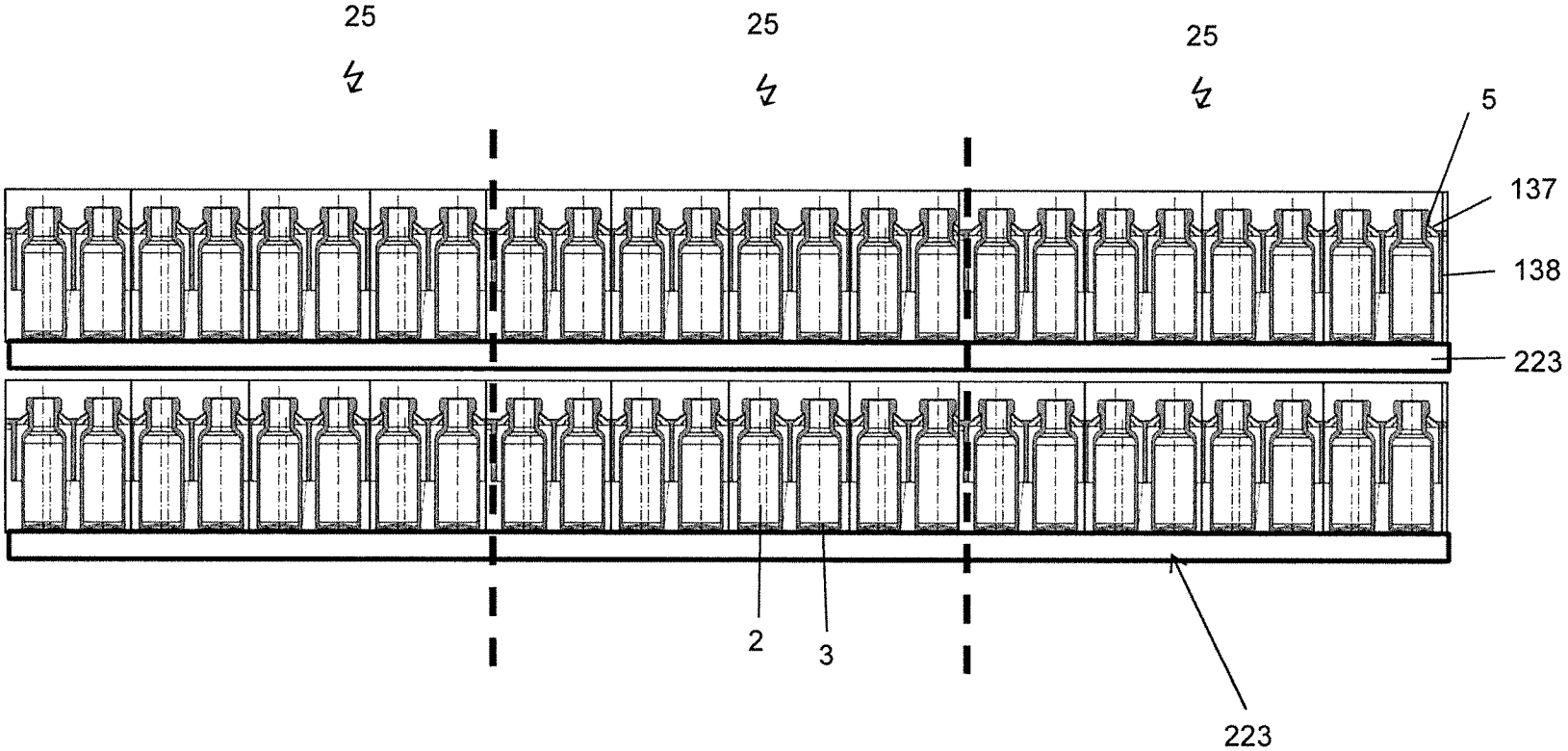
FIG. 14 shows in an enlarged partial section the arrangement of the containers on the cooling bottom of a freeze-dryer in a process according to FIG. 13.

This simple measure further enhances the packing density of the containers 2 that can be achieved when loading the freeze-dryer 220 (see FIG. 13). FIG. 14 shows an enlarged partial sectional view of a freeze-dryer. As can be seen, the bottoms 3 of the containers 2 rest directly on the cooling trays 223, so that an optimum cooling effect can be achieved. The cooling trays 223 are arranged on several levels.

Figure 15A:
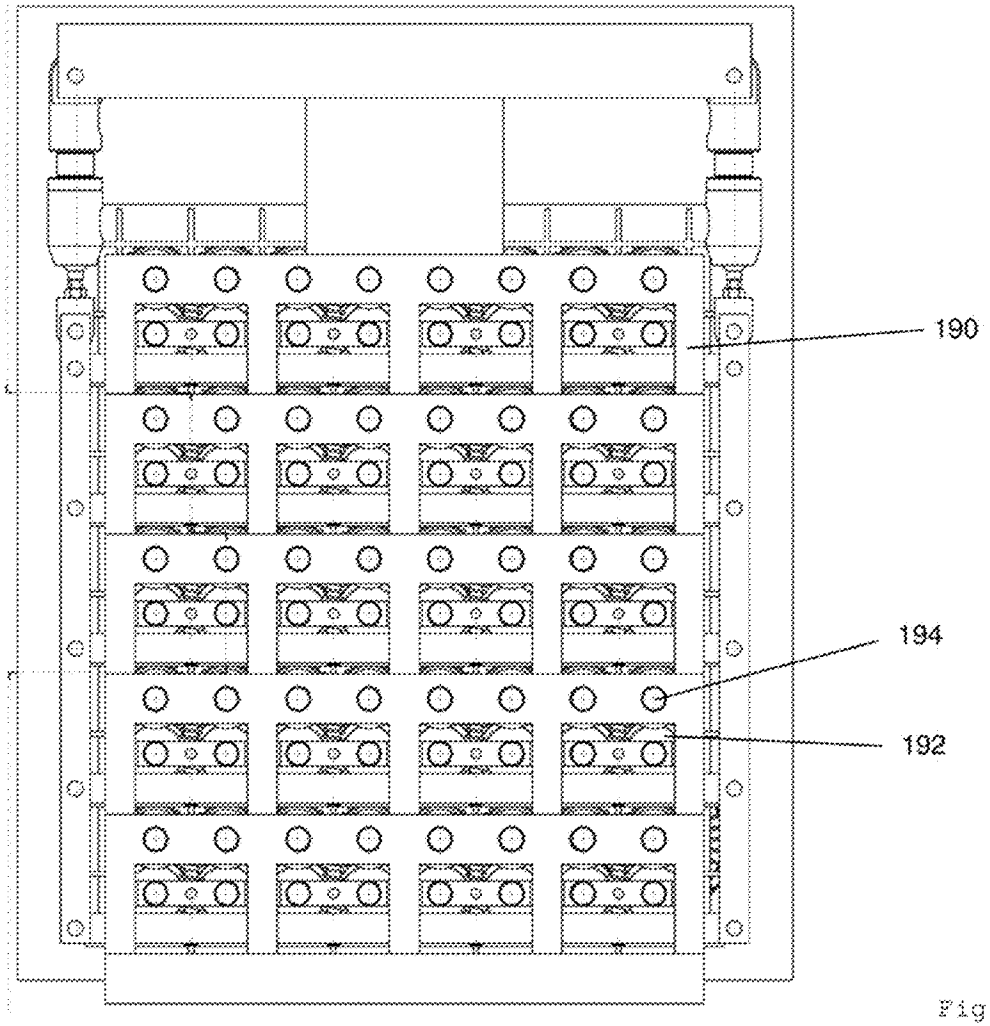
FIGS. 15*a* and 15*b* show a further variant of a processing station for crimping metal lids onto the upper rims of a plurality of containers in a process according to the present invention.
Figure 15B:
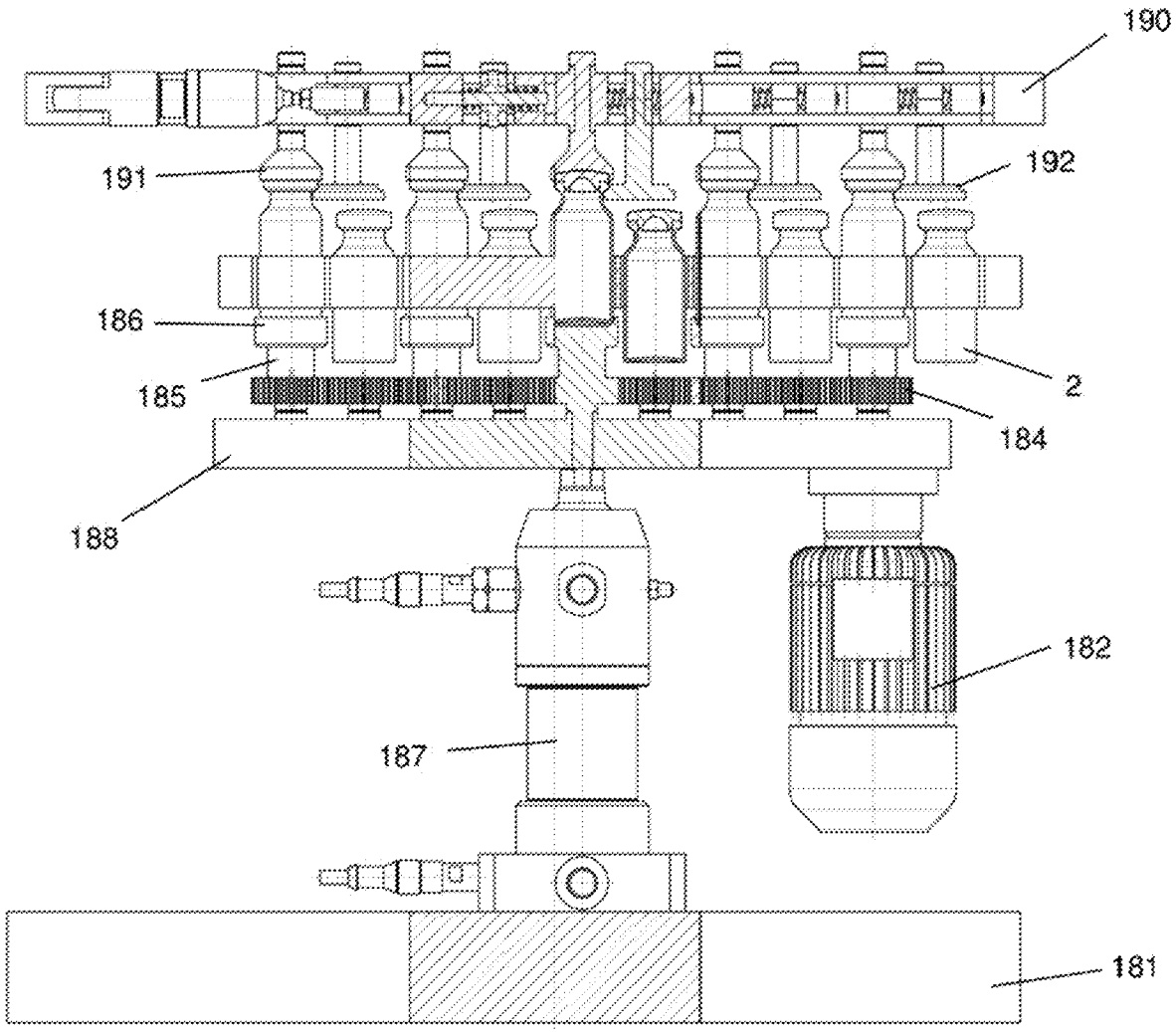

FIGS. 15*a* and 15*b* show a further variant of a crimping station for crimping metal lids on the upper rim of a plurality of containers in a process according to the present invention. The centering discs 191 with their centers of rotation 194 are jointly mounted on a rectangular supporting plate 190, on which also the crimping discs 192 are supported, whose positions can be precisely adjusted. In this variant, all containers of a carrier or of a subsection thereof are crimped in two process steps, because the lifting rods 185 alternately lift and lower each second container 2.

FIGS. 16*a* to 16*d* show a further variant of a crimping station 180 for crimping metal lids on the upper rims of containers in a process according to the present invention. Here, the driving motors 182 and associated rotating means are arranged above the plane of the conveying device and of the carrier. The carriers are passed along the crimping station 180 by using an assembly line technique, while they are frictionally supported by the transverse webs 35 of the carrier, preferably in the position according to FIG. 2*a*, in which the frictional engagement between the transverse webs 35 and the containers 2 is released completely or at least to a sufficient extent. In the region of the crimping station 180 a ramp-like supporting and guiding surface 201 extends in the conveying direction, where the containers 2 are raised in sequence to a raised position. The clearance between the lower ends of the transverse webs 35 and the conveying device is sufficient so that the transverse webs 35 of the carrier can pass the ramp-like supporting and guiding surface 201 without hindrance.

Figure 16A:
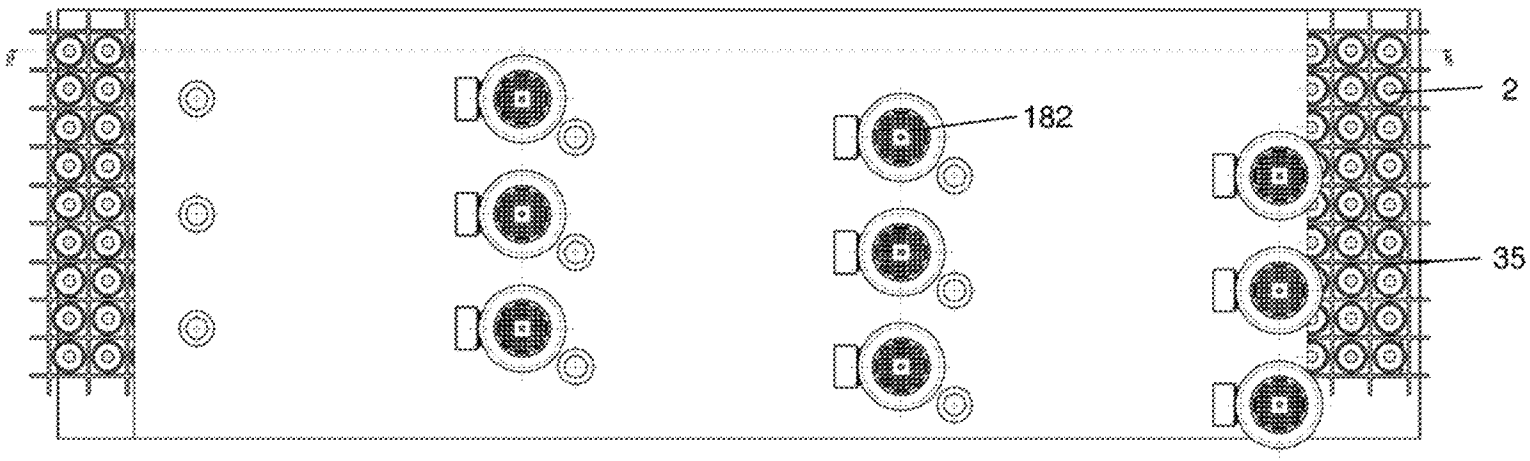
FIGS. 16*a*-16*e* show a further variant of a processing station in a process according to the present invention.
Figure 16B:
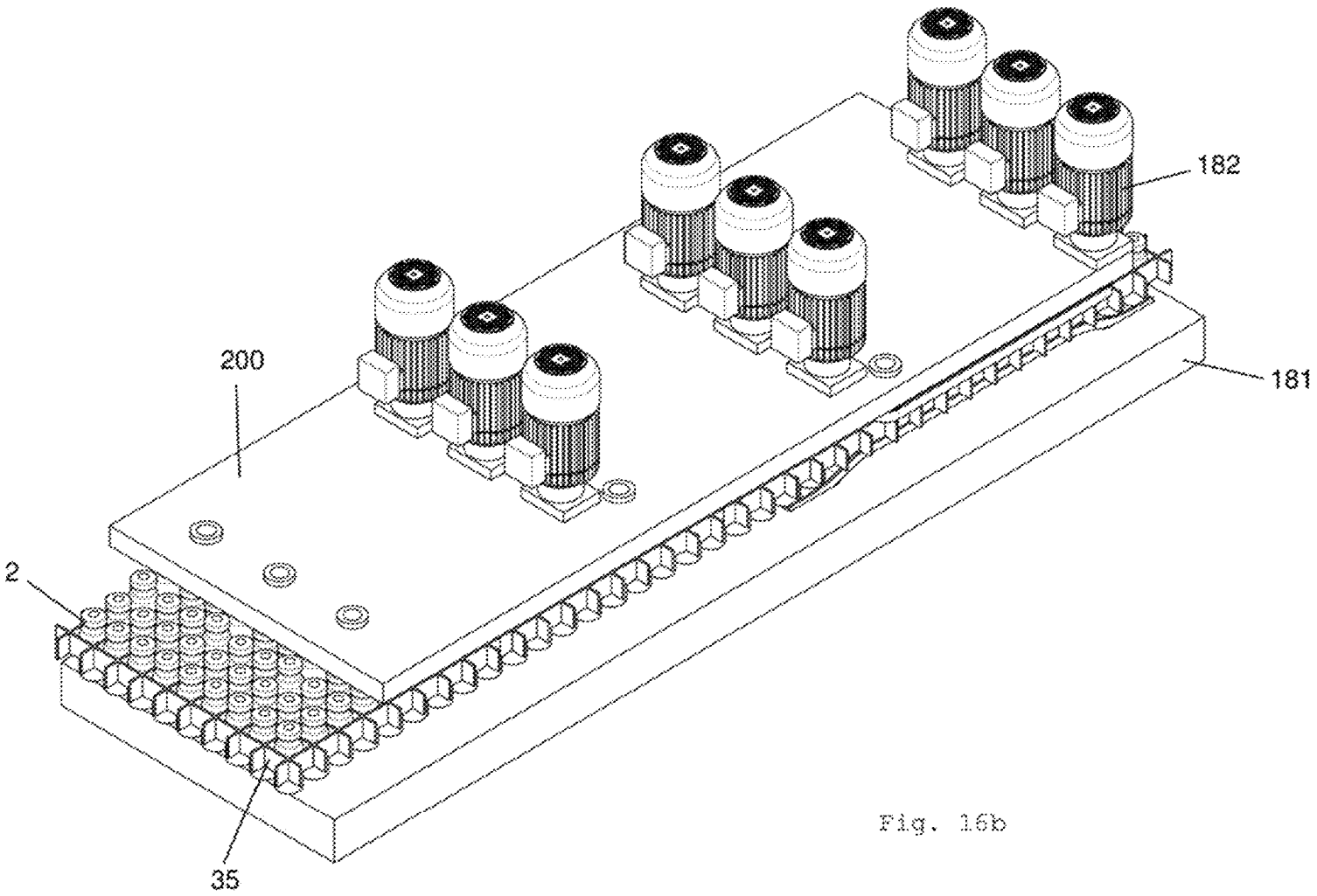
Figure 16C:
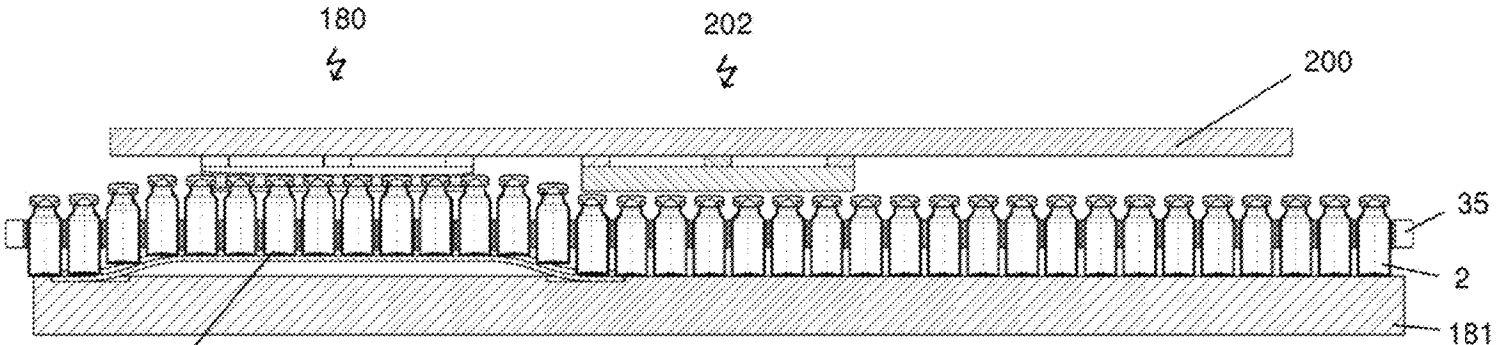
Figure 16D:
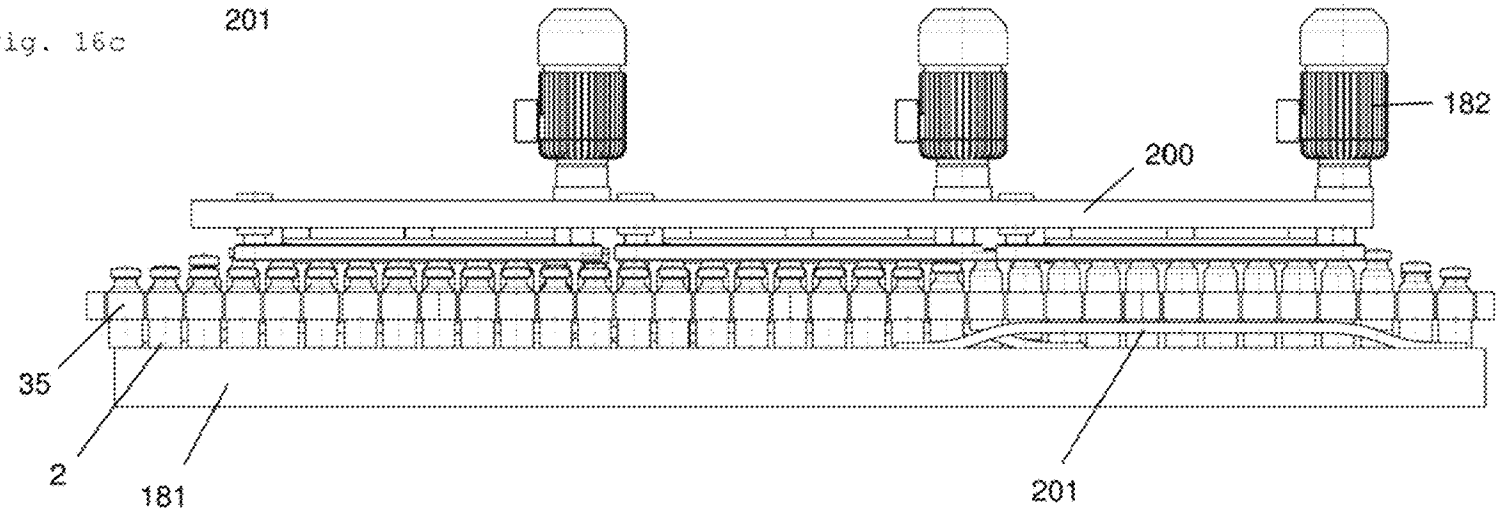
Figure 16E:
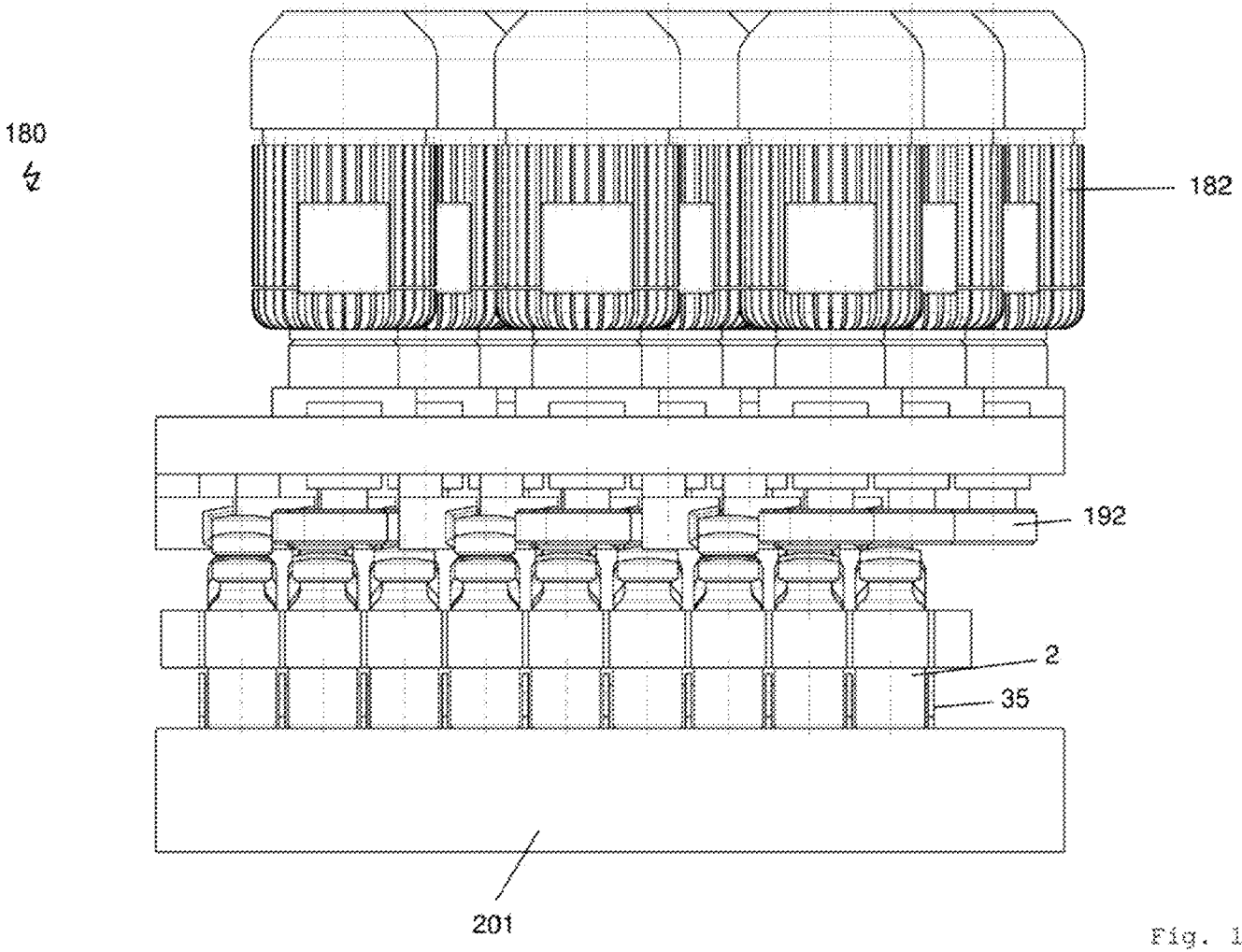

As can be seen in the enlarged view of FIG. 16*e*, in the raised position, i.e. while their bottoms are supported on the ramp-like supporting and guiding surface 201, the upper rims of the containers 2 get in the area of influence of the crimping station 180, so that the metal lids applied to the upper rims of the containers 2 can be suitably crimped.

Subsequently, the containers 2 are conveyed further along the ramp-like supporting and guiding surface 201 until they are finally lowered back to the normal position into the receptacles formed by the transverse webs 35 of the carriers.

A corresponding raising and lowering of the containers, while they are supported in carriers or at least guided therein, is also of advantage for the inspection of a container or its contents, in particular by means of optical inspection methods. As can be seen from most drawings of the present application, the containers with their upper rims mostly do not extend beyond the upper edge of the associated carrier so that they cannot be inspected and assessed optically. Generally, this is also not possible in a reliable manner if the transport and packaging container is made of a transparent plastic material. In the raised position described above, however, the containers are available for an inspection method or for an assessment at least in their upper region. This can be exploited if one selectively raises e.g. the container in a conveying device by means of a ramp-like guide surface, as exemplified in FIGS. 16*c* and 16*d*, which suitable engages in the path of the conveying device and then lowers them back into the receptacles of the carriers.

A corresponding raising and lowering of the containers, while they are supported in carriers or at least guided therein, is also of advantage for a coordinated transfer of the containers to downstream processing stations. As an example, the containers can gripped individually or row-wise by a gripper, for example at their upper rim, and transferred in a coordinated manner in the above-mentioned raised position, in which the holding force in the receptacles or openings of the carrier is fully released or at least released to an extent sufficient for their removal.

For concurrently supporting a plurality of containers, according to a further embodiment, as shown in FIGS. 17*a* and 17*b*, a planar rectangular carrier 134 is provided which is formed of a plastic material, e.g. by punching or injection molding, and which comprises a plurality of openings 135 for accommodating the vials 2. The openings 135 are delimited by side walls 138 (see FIG. 17*d*) on the bottom side of the carrier 134. According to FIG. 17*b* resilient holding tongues 140 protrude from the upper surface of the carrier 134 in an arc-shaped manner and, if viewed in a plan view, into the associated openings 135. The resilient holding tongues and the side walls 140 and 138 are preferably formed integrally with the planar carrier 134, e.g. by a 1K or 2K plastic injection molding process.

Figure 17D:
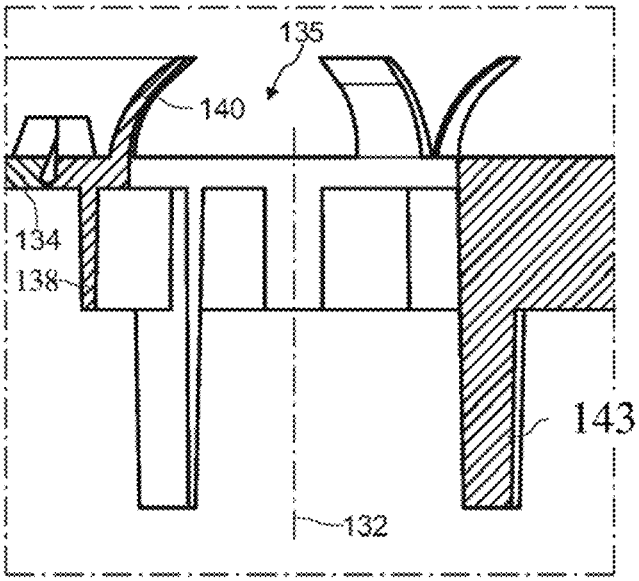

As can be sees in a comparison of FIGS. 17*b* and 17*d*, the side walls 138 are arranged distributed in a regular hexagonal arrangement on the bottom side of the carrier 134. The side walls 138 are formed to be circumferential, but may also be formed as rather short side wall portions to define an associated opening or receptacle only in sections. In each case, a collision of containers, which are accommodated in directly adjacent openings 135, is prevented by the side walls 138. According to FIG. 17*c*, pins 143 project from the bottom side of the carrier 134, by means of which the carrier 134 can be placed on a supporting surface and spaced from it.

According to FIG. 17*b*, the side walls 138 each run together in the corner regions of the openings 135 and are interconnected there or integrally formed. From these corner regions the resilient holding tongues 140 project into the adjacent openings 135 in an arrangement with a three-fold point symmetry. This results in a symmetrical force distribution when supporting the containers by means of the holding tongues 140. The holding tongues 140 thus result in an advantageous three-point support of the containers in the openings, so that the containers are automatically supported in a respective opening 135 centered with respect to a center line 132 (see FIG. 17*d*).

As can be concluded from FIG. 17*b*, the holding tongues 140 protrude from the side walls 138 of the carrier 134 in corner regions of the openings 135, i.e. where the side walls 138, which are interconnected or formed integrally, form portions with a relatively high stability. Conveniently, the aforesaid pins 143 may be formed integrally in these regions.

In an alternative embodiment in which the side walls of a respective opening or receptacle are each circular in shape and circumferential, the side walls are also preferably connected to each other or formed integrally. Here, the holding tongues protrude from the same regions as in the arrangement shown in FIG. 17*b*. In these regions, the gaps between the circular side walls can also be filled.

FIG. 17*c* shows a partial sectional view of the supporting structure along A-A of FIG. 17*b*. It can be seen that the carrier 134 is delimited on the bottom side by a circumferential rim 133 on which the carrier 134 can be supported on a circumferential step 13 (see FIG. 18*a*) of a transport or packaging container 1.

FIG. 17*d* shows a largely enlarged partial sectional view of the insert, which is shown in FIG. 17*c*. It can be seen that the containers can be inserted easily from below into the openings 135 of the carrier 134. Upon insertion of the containers into the openings 135 there is an elastic bending of the resilient holding tongues 140.

Depending on the specific configuration of the containers to be supported these can in principle also be inserted from above into the openings 135 of the carrier 134 so that they are supported on the carrier 134. This has the advantage that the risk can be further reduced that liquid or other contents of the containers can arrive uncontrollably on the supporting structure, in particular on the carrier 134, during their insertion into the openings and during the pivoting away of the holding tongues 140 from the interior of the container. For this purpose slanted insertion surfaces may be provided on the upper sides of the resilient holding tongues 140, such as these are described in more detail below with reference to FIG. 18*f* for an alternative embodiment.

By means of the strength, material and design of the resilient holding tongues 140 the force required for inserting and removing a container can be easily specified.

According to the present invention, the containers are supported loosely on the holding tongues at least with radial play and preferably both with radial and axial play. In this way, even large tolerances of containers and different outside diameters can be easily compensated for in the region of the neck portion 5. Namely, for supporting the containers it is sufficient if the rolled rim 6 still rests on the upper sides of the holding tongues 140. Basically thereby also containers of various types, e.g. with different diameters in the region of the neck portion 5, can be supported by the same supporting structure.

Figure 17E:
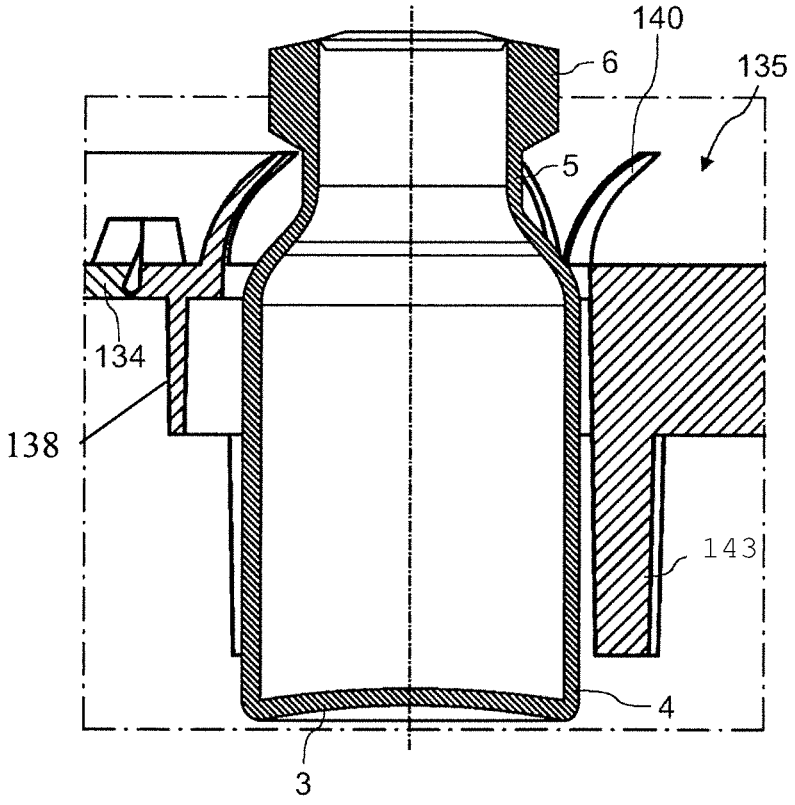

FIG. 17*e* illustrates this in the same largely enlarged partial sectional view as shown in FIG. 17*d* and illustrates the supporting of a container in an opening 135 of the carrier 134. According to FIG. 17*e* the bottom of the expanded rim 6 rests loosely on the front ends of the resilient holding tongues 140 in the transition region between the constricted neck portion 5 and the rim 6 for fixing the position of the container. As can be seen in FIG. 17*e*, an air gap exists between the holding tongues 140 (see left-hand side of the drawing) and the constricted neck portion 5, which enables a radial clearance. Due to this support with radial play, depending on the specific design of the container, the possibility exists to displace the container supported by the holding tongues 140 in axial direction, i.e. in the longitudinal direction of the container, for example until the bottoms 3 of all containers supported by the carrier 134 are supported at the same distance from the carrier 134 to jointly span a plane.

According to FIG. 17*e* the container is inserted into the opening 135 until the expanded rim 6 is supported on the front ends of the holding tongues exactly at the transition region between the constricted neck portion 5 and the expanded upper rim 6. This can be accomplished, for example, by inserting the containers from below into the openings 135 of the carrier 134 and by subsequent pushing down of the containers, namely until the front ends of the holding tongues abut exactly at the transition region between the constricted neck portion 5 and the expanded upper rim 6. In the support position shown in FIG. 17*e*, a certain radial distance between the step-like transition region between the upper rim 6 and the constricted neck portion 5 and the front ends of the holding tongues 140 is provided in any case for the great majority of the fixed containers. In this way, manufacturing tolerances of the containers in the axial direction and also manufacturing tolerances in the radial direction can be compensated for, and thus also containers with different diameters can be supported in the region of the constricted neck portion 5 by one and the same carrier 134. In this way also potential tension in the plastic of the carrier 134 caused by the accommodation of containers with a too large outer diameter can be kept small.

According to an alternative embodiment, as described below with reference to FIG. 18*g*, the containers may also be supported on the carrier 134 in a positive-fit manner.

Figure 18A:
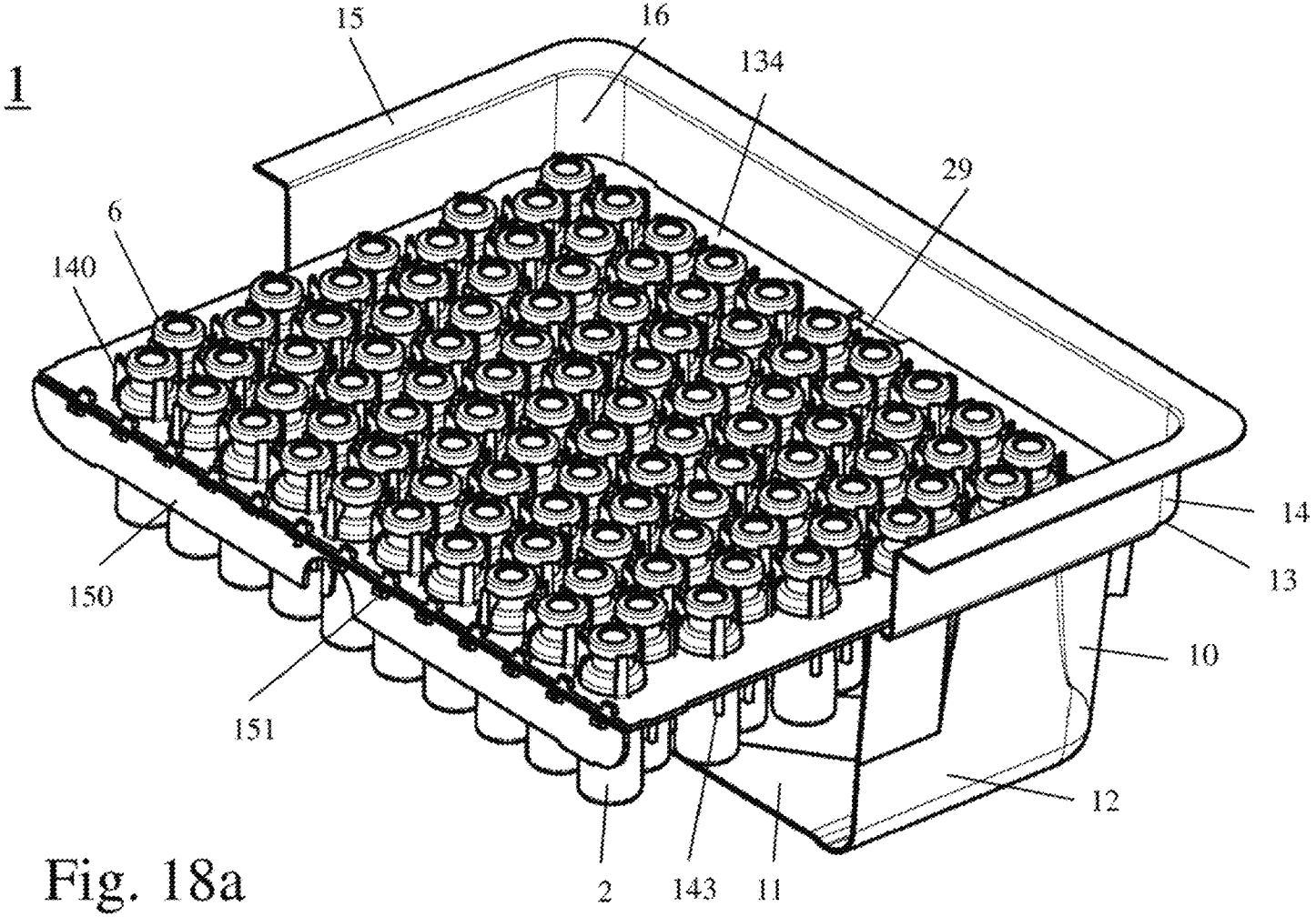
FIGS. 18*a*-18*j* show details of a further supporting structure according to a further embodiment for use in a process according to the present invention.
Figure 18B:
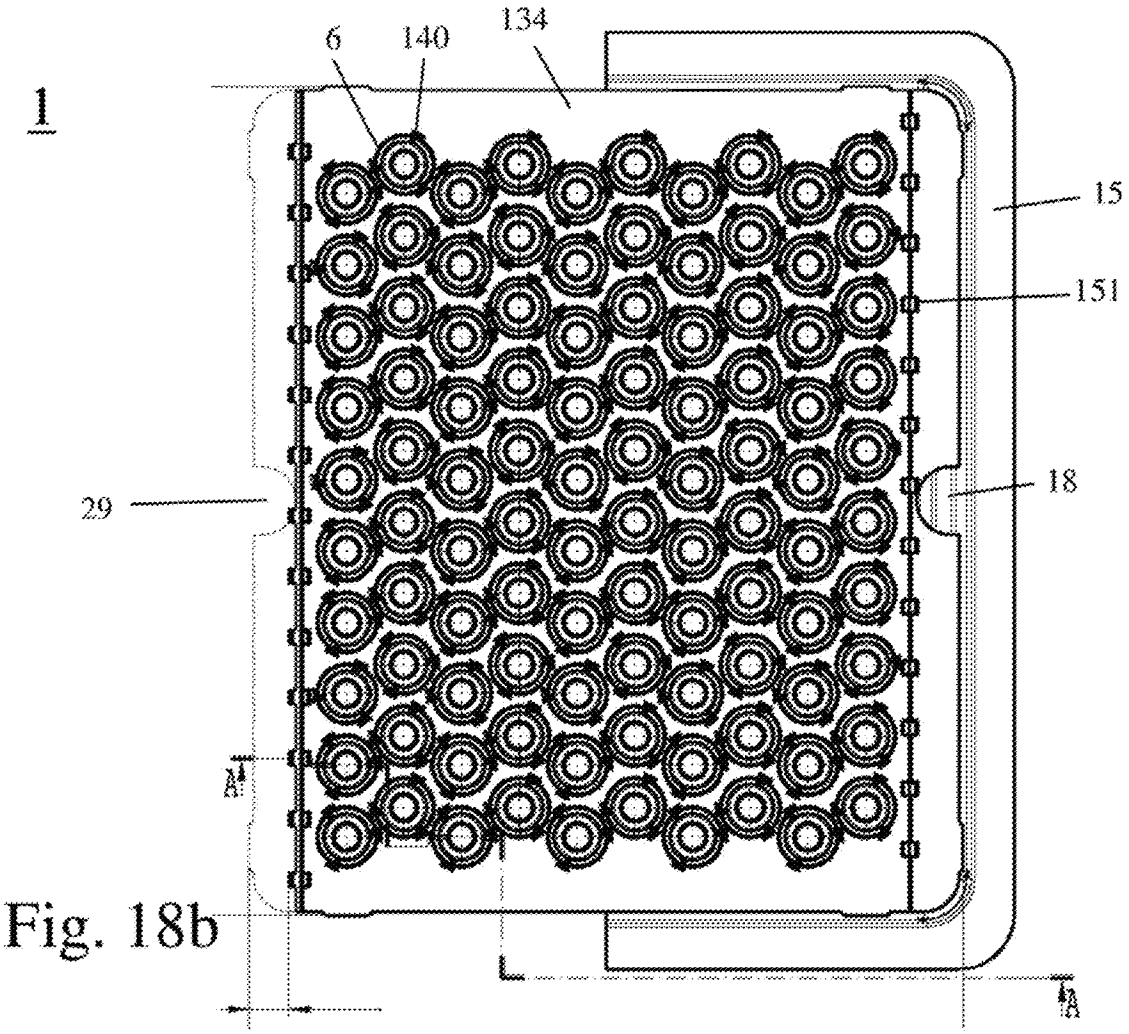
Figure 18C:
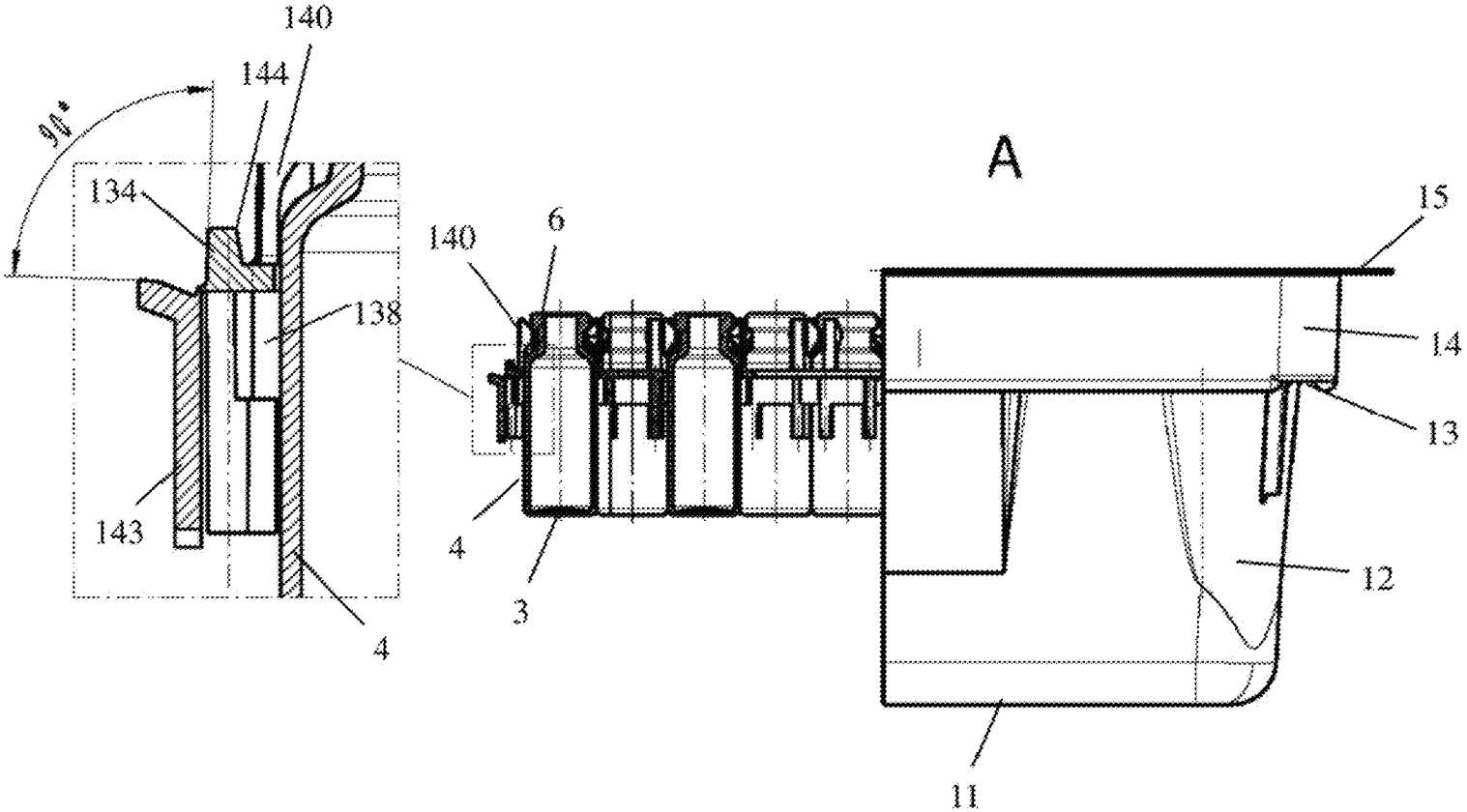

For the transport and packaging of the supporting structure described above together with the containers accommodated therein, a transport and packaging container 10 (in the prior art also referred to as a "tub") is used, such as this is in general described with reference to FIG. 18*c* above and as shown in connection with a drawing of a further embodiment of a supporting structure according to the present invention as shown in FIGS. 18*a* to 18*c*. Here FIG. 18*c* shows in two enlarged partial sectional view along A-A of FIG. 18*b* the supporting of the containers in the supporting structure according to the further embodiment and details thereof. Particularly, it can be seen that slanted stop noses 144 are provided on the upper side of the carrier, which delimit the pivoting back of the resilient holding tongues 140 upon insertion of the containers.

Figure 18D:
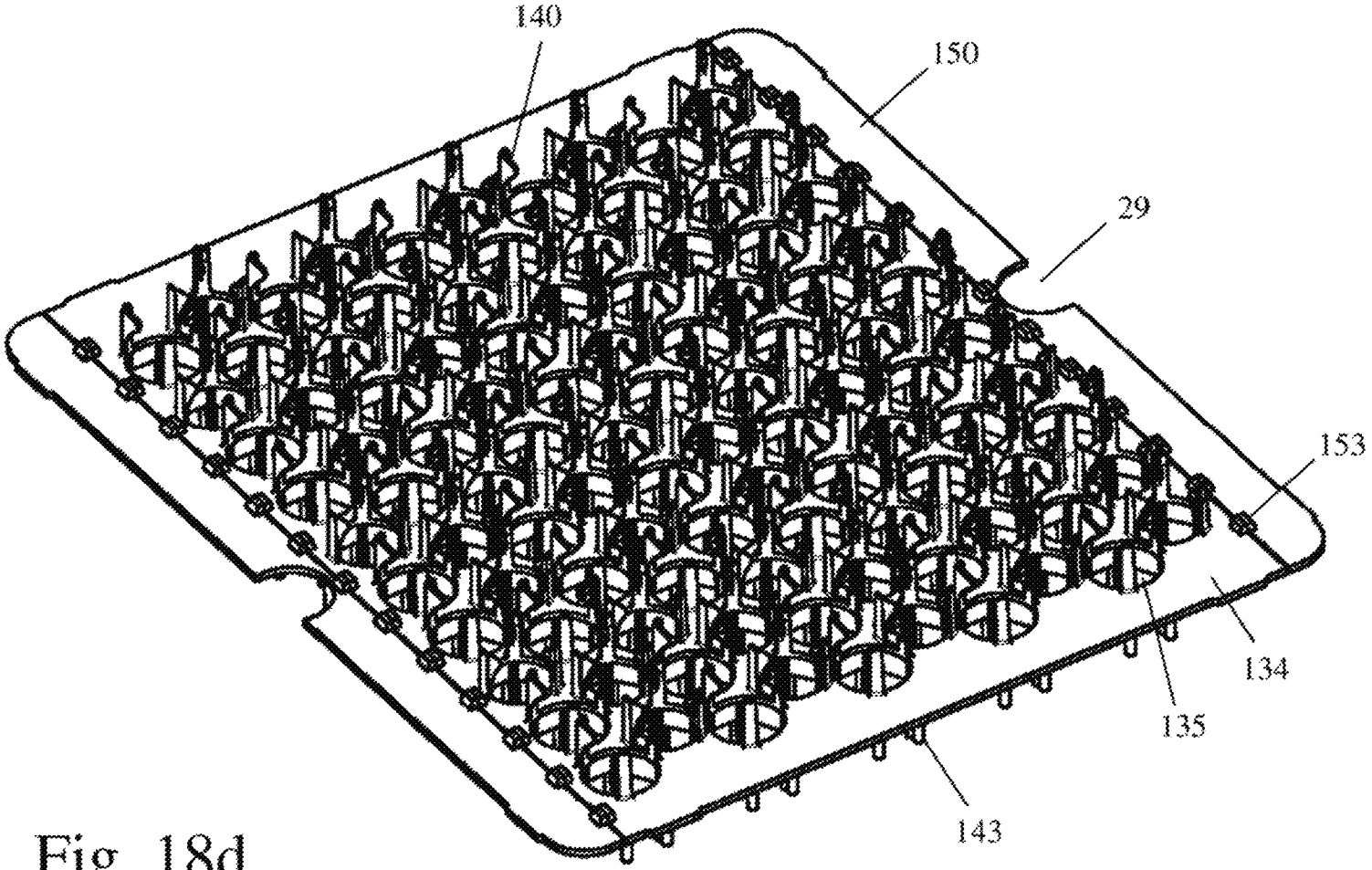

FIG. 18*d* shows a perspective top view of the supporting structure of FIG. 18*a* without containers. It can be seen that the resilient holding tongues 140 have a flag-like shape and are provided with a holding nose projecting radially inward, as it is shown better in the largely enlarged partial sectional view of this supporting structure of FIG. 18*f*. According to FIG. 18*f*, the resilient holding tongues 140 are connected with the carrier 134 via an elastic base 140*a*, which projects perpendicularly from the upper side of the carrier 134. The base 140*a* merges into a portion 140*b* curved radially inwardly, which eventually passes into the holding nose 140*c*, on which the expanded rims 6 (see FIG. 17*e*) of the containers rest, as described above with reference to FIG. 17*e* for first described embodiment. The holding nose 140*c* projects into the opening of the carrier 134. The holding nose 140*c* passes into a slanted insertion surface 140*d* extending obliquely upward, which connects to the upper end of the holding tongue 140. Due to the slanted insertion surface 140*d* on the upper side of the holding tongue 140 and due to the curved portion 140*b* of the holding tongue 140, which is open toward the bottom, the containers can be inserted and removed from these again optionally from above or from below into the openings of the carrier 134.

During the insertion of the containers into the openings from above, at first the bottoms or the lower ends of the containers get in contact with the slanted insertion surfaces

140*d* of the holding tongues 140 Upon further insertion of the containers, the lower ends or bottoms of the containers slide downwards along the slanted insertion surfaces 140*d* and thereby the holding tongues 140 are increasingly and elastically spread apart or pivoted back. Upon further insertion of the containers finally the cylindrical side walls of the containers (see FIG. 17*e*) get in contact with the holding noses 140*c* and these slide therealong, until eventually the bottom sides of the expanded rims of the containers rest loosely on the holding noses 140*c* of the holding tongues 140. Then, the containers can be removed from the openings of the carrier 134 either in the upward direction with the opposite movement of the holding tongues 140 and without an elastic bending of the holding tongues 140, or in the downward direction with elastic bending of the holding tongues 140.

Upon insertion of the containers from below into the openings, the upper ends of the containers first get in contact with the curved portions 140*b* of the holding tongues. Upon further insertion of the containers, the upper ends of the containers slide along the curved portions 140*b* upward and increasingly and resiliently spreads the holding tongues 140 apart or claps or pivots them back until finally the holding noses 140*c* are reached. On further pushing up the containers, the bottoms of the expanded rims of the containers slide over the holding noses 140*c* of the holding tongues 140 and finally rest loosely on the holding noses 140*c* of the holding tongues 140. Thus, the containers can be removed from the openings of the carrier 134 either downward by a reverse movement of the holding tongues 140 and with elastic bending of the holding tongues 140 or upwards without elastic bending of the holding tongues 140.

Figure 18E:
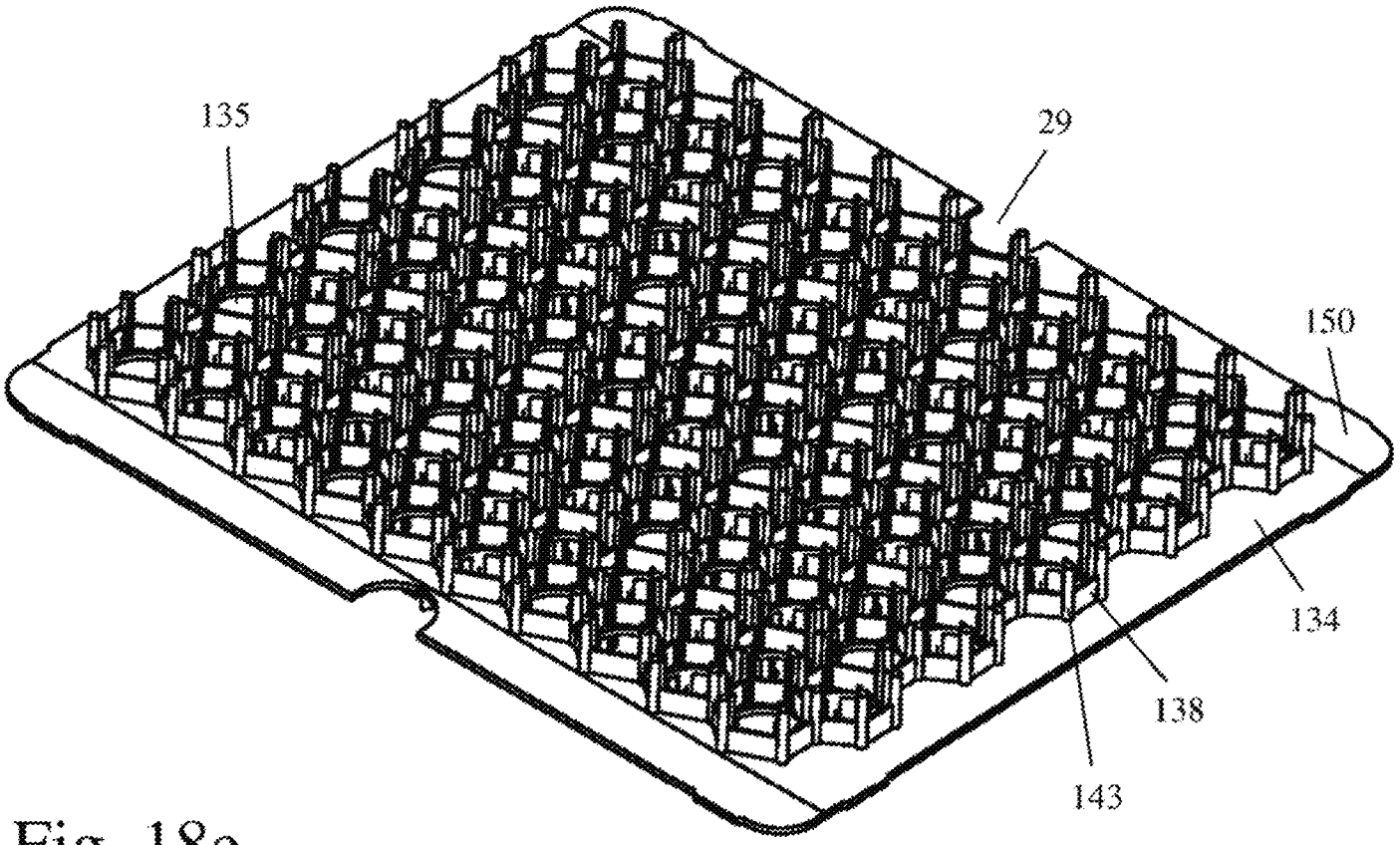
Figure 18F:
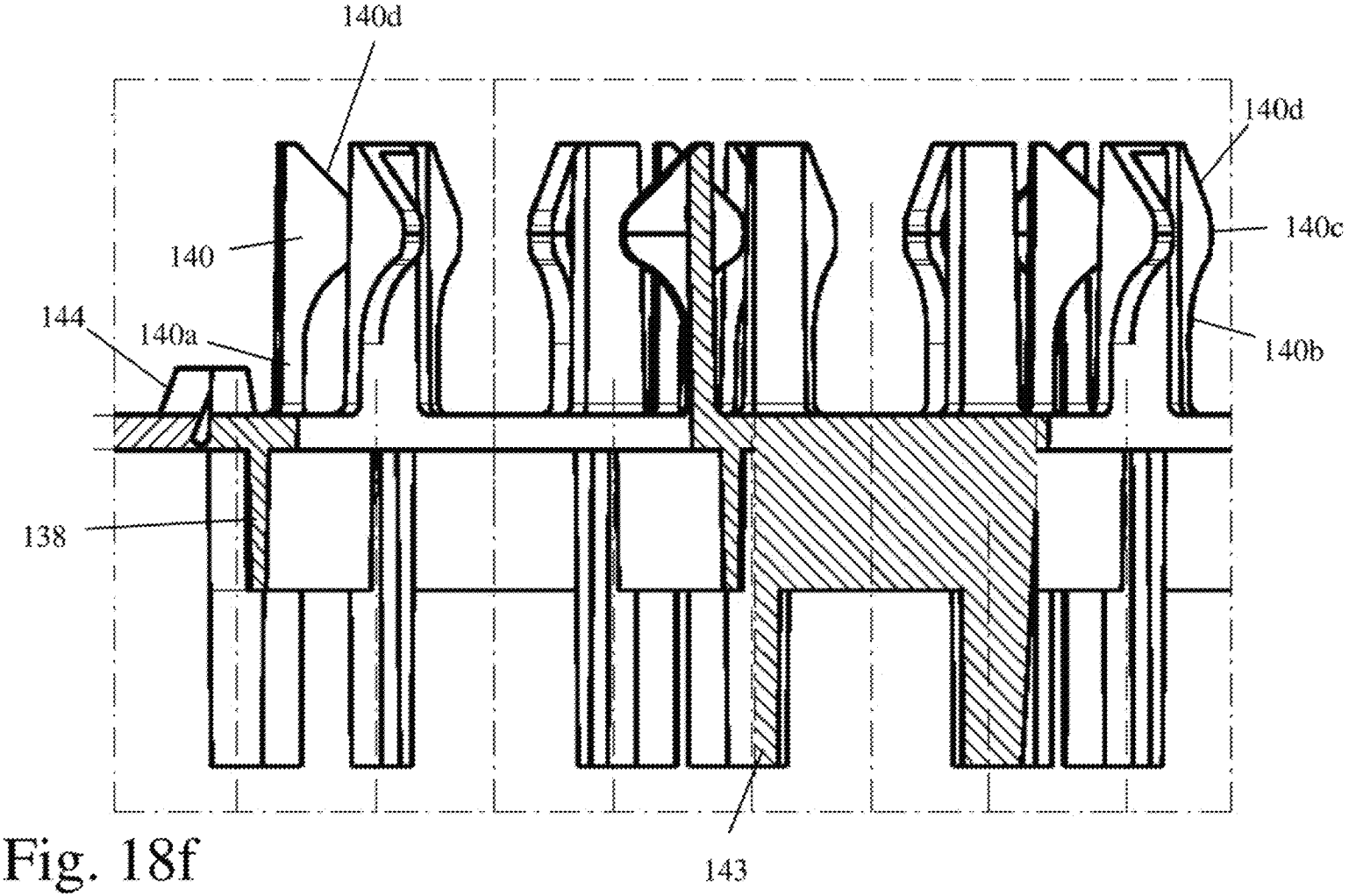

FIG. 18*e* shows in a perspective bottom view the supporting structure of FIG. 18*a* without containers. One can see the honeycomb-shaped, hexagonal arrangement of the circumferential side walls 138, in the corners of which pins 143 project perpendicularly from the bottom side of the carrier 134. These pins 143 serve as spacers in the deposition of the carrier 134 on a supporting surface such as the bottom of a transport and packaging container 11 (see FIG. 18*a*), but at the same time they prevent the contact of the containers with each other.

Figure 18G:
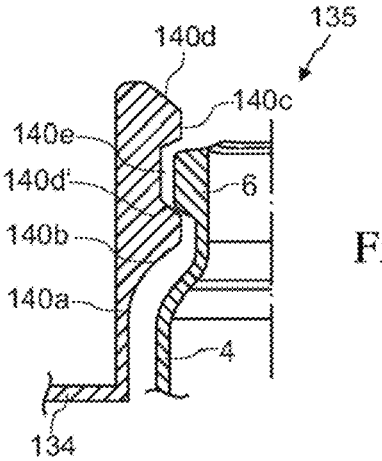

FIG. 18*g* shows in a largely enlarged partial sectional view the supporting of a container in a supporting structure according to a further embodiment of the present invention. Differing to the aforementioned embodiment, here the containers are embraced in a positive-fit manner at their expanded upper rim portion 6 (rolled edge), wherein a sufficient radial clearance, as described above, is ensured, as indicated in FIG. 18*g* by the air gap in the radial direction. Alternatively, in addition to this radial play also a sufficient axial play can be ensured, as indicated in FIG. 18*g* by the air gap in the axial direction. For this purpose, a C-shaped recess 140*e* is provided at the front end of the holding nose 140*c* (see FIG. 18*f*), which passes into the holding nose 140*c* via the bevels 140*d*'. In the supporting position according to FIG. 18*g*, the expanded rim portion 6 rests loosely and with radial clearance on the lower slanted surface 140*d*' of the recess 140*e*. As shown in FIG. 18*g*, a sufficient axial play may be provided between the upper end of the expanded rim portion 6 and the upper slanted surface 140*d*' of the recess. Overall, the expanded rim portion 6 is embraced by the holding tongue 140 like a clamp and in a positive-fit manner. The slanted insertion surface 140*d*', the curved portion 140*b* and the slanted surfaces 140*d*' of the recess thereby allow insertion and removal of the containers into the openings and out of them without too much effort and with an elastic bending away of the holding tongues 140.

Figure 18H:
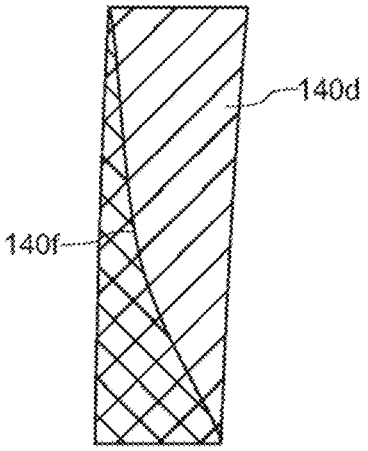

FIG. 18*h* is a largely enlarged top view of a slanted insertion surface of a holding tongue according to a variant of the supporting structure of FIG. 18*a*. According to FIG. 18*h* the slanted insertion surface 140*d* is formed overall like a spiral by means of an arcuate ridge 140*f* formed thereon. This spiral slanted insertion surface 140*d* is formed in the same manner on all holding tongues of the openings or receptacles. Overall, the slanted insertion surfaces, if viewed in a top view, are curved by an angle of less than 90°. Upon insertion of the container into the openings, in cooperation with the container this causes that the holding tongues are not only pivoted away or folded back radially outward, but are also turned away at the same time with a movement component in the circumferential direction in correspondence to the geometry of the slanted insertion surfaces 140*d*, namely by an angle of less than 90°. Depending on the geometry of the arrangement of the holding tongues on the carrier, in this way a collision of the holding tongues of directly adjacent openings or receptacles can be prevented when these are pivoted back or folded back. In this way, the packing density of the containers on the supporting structure can further increased further.

Figure 18I:
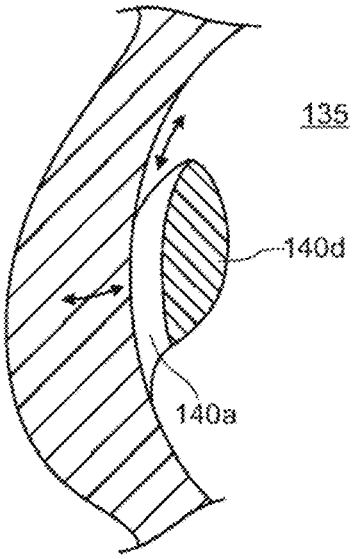

FIG. 18*i* is a top view of a further variant of the holding tongues of a supporting structure of FIG. 18*a*, wherein the base 140*a*, as viewed in the axial direction, is twisted, which causes, in cooperation of the slanted insertion surface 140*d* with the container, both a radial component and a component in the circumferential direction when pivoting away the resilient holding tongues, as indicated schematically by the two double arrows.

Figure 18J:
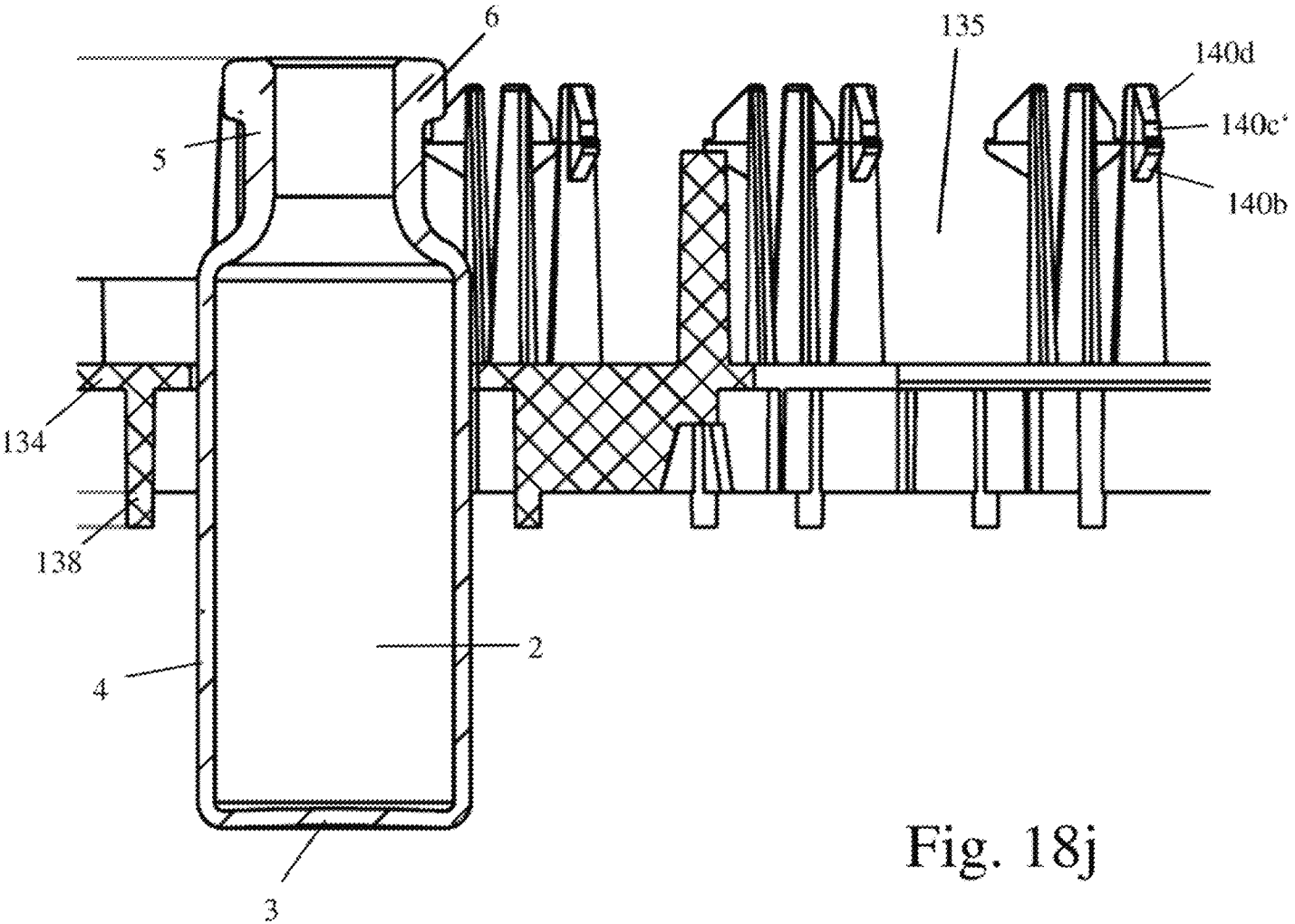

FIG. 18*j* shows in a schematic sectional view a further variant of holding tongues for a supporting structure as shown in FIG. 18*a*, wherein a recess 140*c*' is formed below the upper slanted insertion surface 140*d*, which extends substantially in vertical direction and merges into a step, on which the bottom side of the upper rim of the container to accommodated is directly supported. The step is followed by the lower slanted insertion surface 140*b* in the manner described above.

Figure 17F:
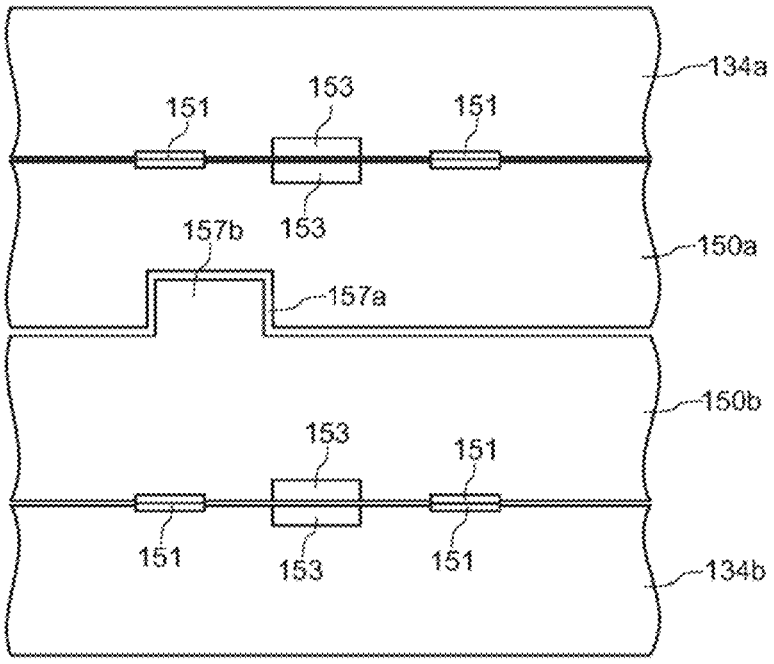

FIG. 17*f* shows in a largely enlarged partial sectional view and in a top view a further variant of the supporting structure of FIG. 17*b*, wherein edges 150*a*, 150*b* of the planar supporting plate 134*a*, 134*b* can be pivoted away to further reduce the base area of the respective carrier, for example if this is to be transferred together with the containers to a processing station with constricted space, such as a freeze-dryer with limited floor space. For this purpose, the edges 150*a*, 150*b* are connected with the respective carrier via hinges 151. In particular, the hinges 151 can be formed as film hinges or snap or spring hinges from a plastic material and integrally with the carrier 134.

According to FIG. 17*f* recesses 157*a* and/or protrusions 157*b* are formed on the removable or pivotable elements 150*a*, 150*b*. The recesses 157*a* and/or protrusions 157*b* of the removable or pivotable elements 150 of a carrier are formed corresponding to the recesses 157*a* and/or protrusions 157*b* of the removable or pivotable elements 150 of a directly adjacent planar carrier so that a positive-fit between the recesses 157*a* and/or protrusions 157*b* can be established to define and stabilize the mutual position of the carriers.

On the upper side of the carrier 134*a*, 134*b* and of the edges 150*a*, 150*b*, block-shaped stops 153 are provided at corresponding positions, which define in mutual abutment a coplanar alignment of the edges 150*a*, 150*b* and of the carrier 134 and prevent a folding-up of the edges 150*a*,

150*b*. The carriers can therefore also be placed only at the edges in a transport and packaging container (see FIG. 18*a*).

According to a further embodiment (not shown), the edges 150 can also be removed from the carrier 134. The edges 150 may of course be provided along all four longitudinal sides of the carrier 134.

Figure 17G:
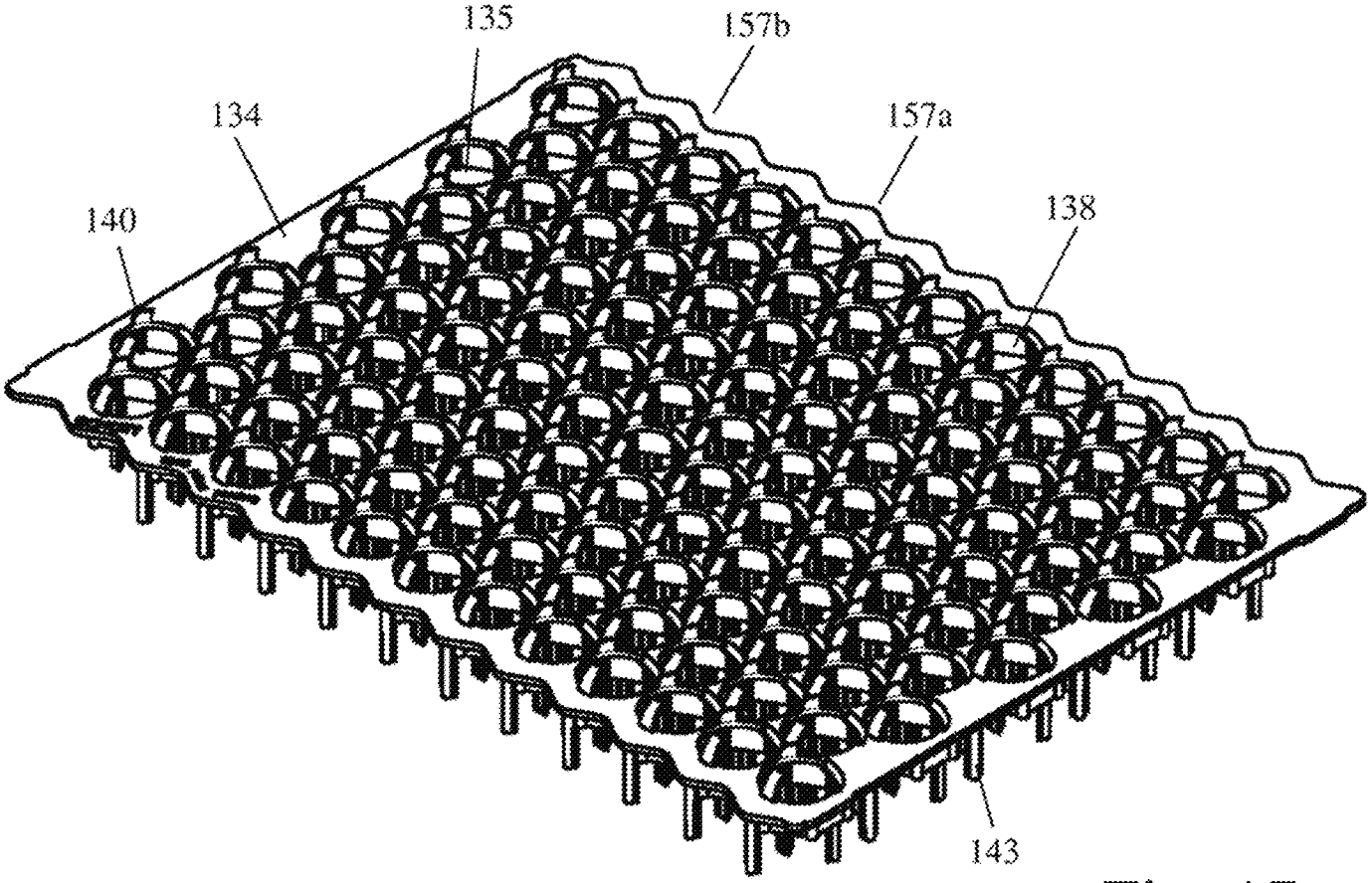
Figure 17H:
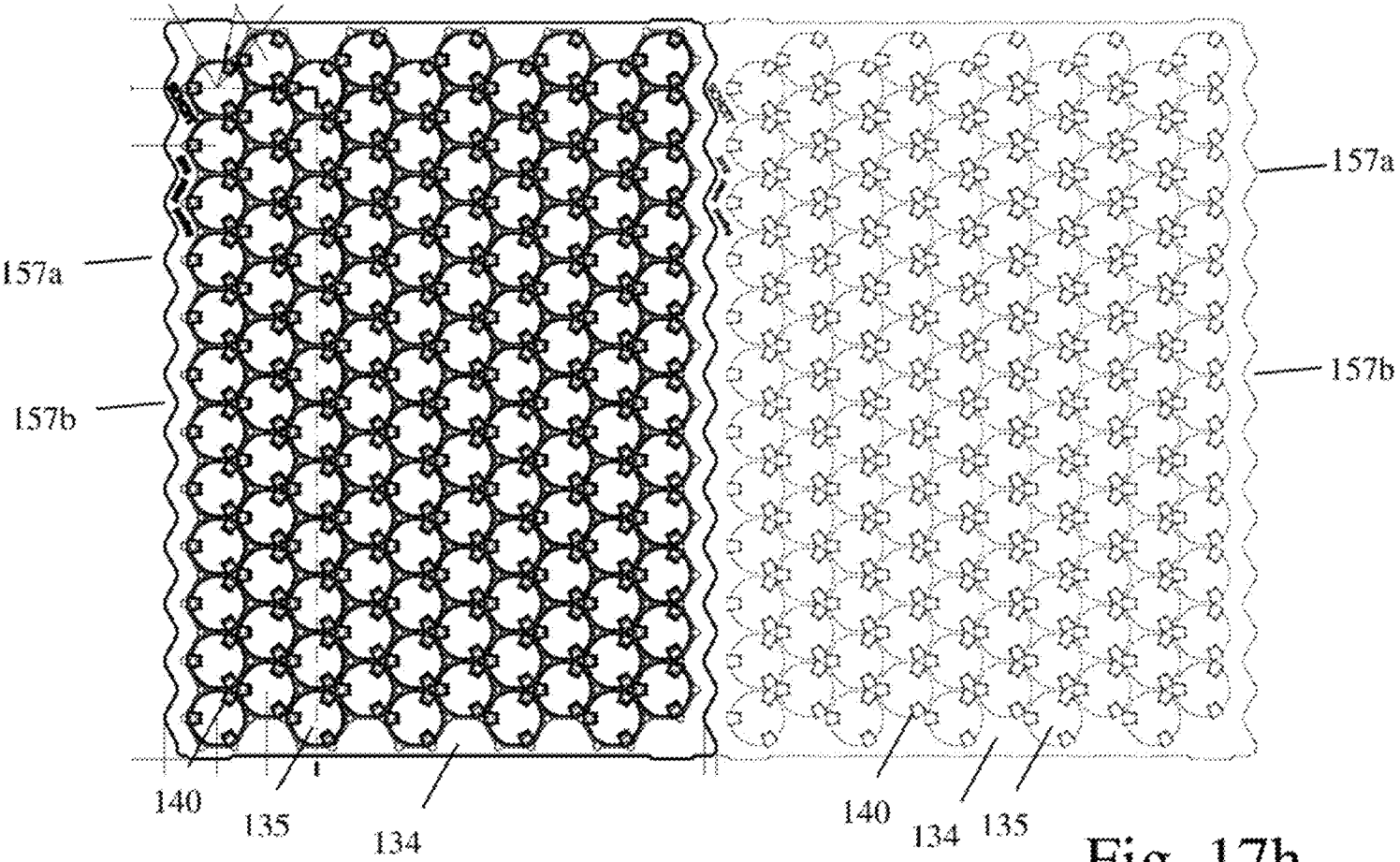

FIG. 17*g* shows a further variant of the above supporting structure of FIG. 17*f*, wherein the aforementioned protrusions 157*a* and recesses 157*b* are formed directly on the edge of the planar carrier 134. FIG. 17*h* shows the cooperation of the protrusions 157*b* and recesses 157*b* of two adjacent carriers 134, so that these are in engagement with each other and a relative displacement between the two carriers 134 is prevented. In this position, adjacent carriers 134 may be transported and displaced together, for example in a collection area in front of a freeze-dryer, as exemplified in FIG. 13.

Figure 19A:
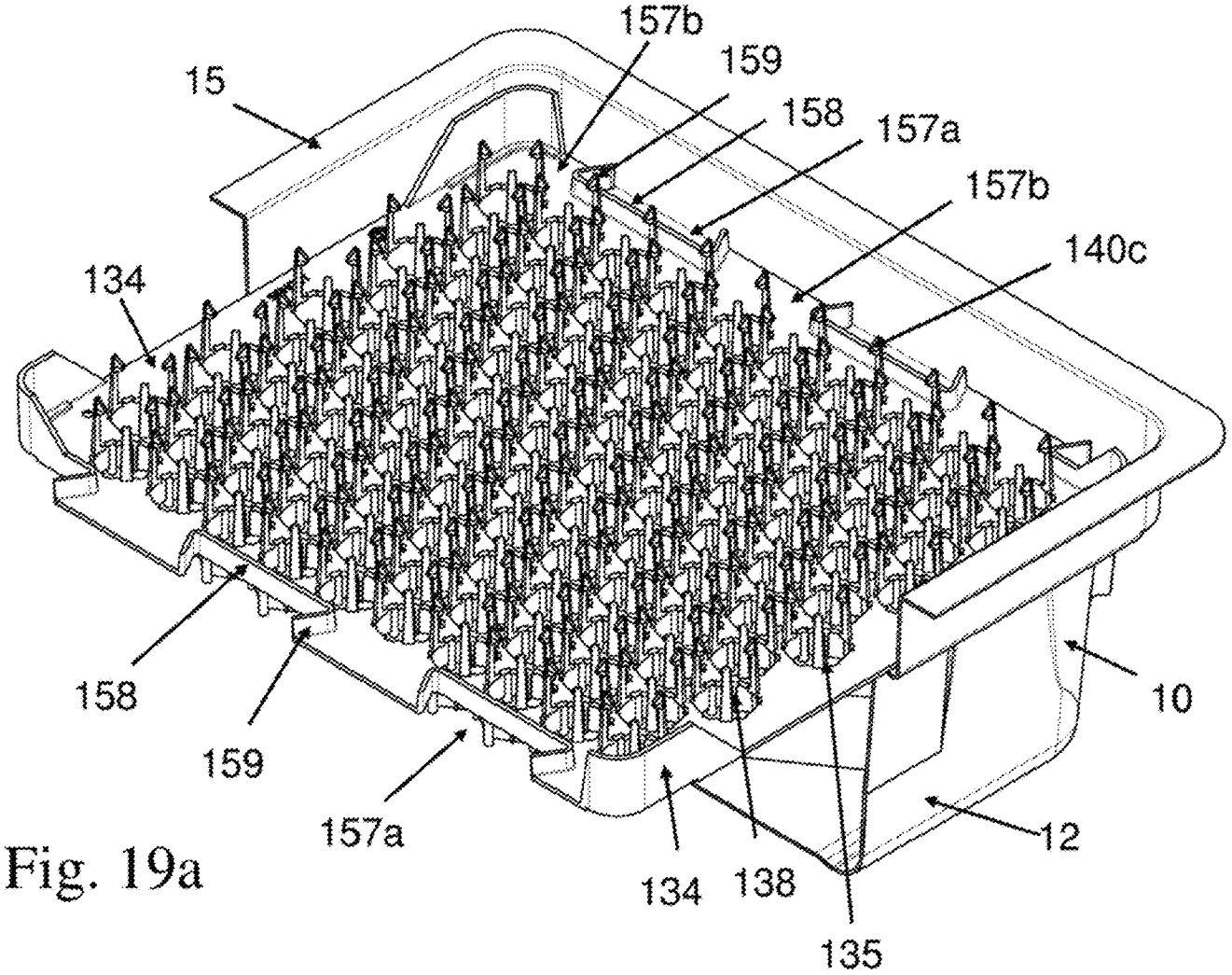
FIGS. 19*a*-19*f* show details of a further supporting structure according to a further embodiment for use in a process according to the present invention.

FIG. 19*a* shows in a perspective top view a supporting structure according to a further embodiment according to the present invention that can also be claimed independently. According to FIG. 19*a* a plurality of protrusions 157*b* and recesses 157*a* are formed along the two longitudinal sides of the supporting plate 134 alternately and at regular distances from each other. If viewed in a top view, these have each a generally triangular-shaped or polyhedral base and are formed corresponding to each other, so that they can be hooked directly to one another.

Figure 19B:
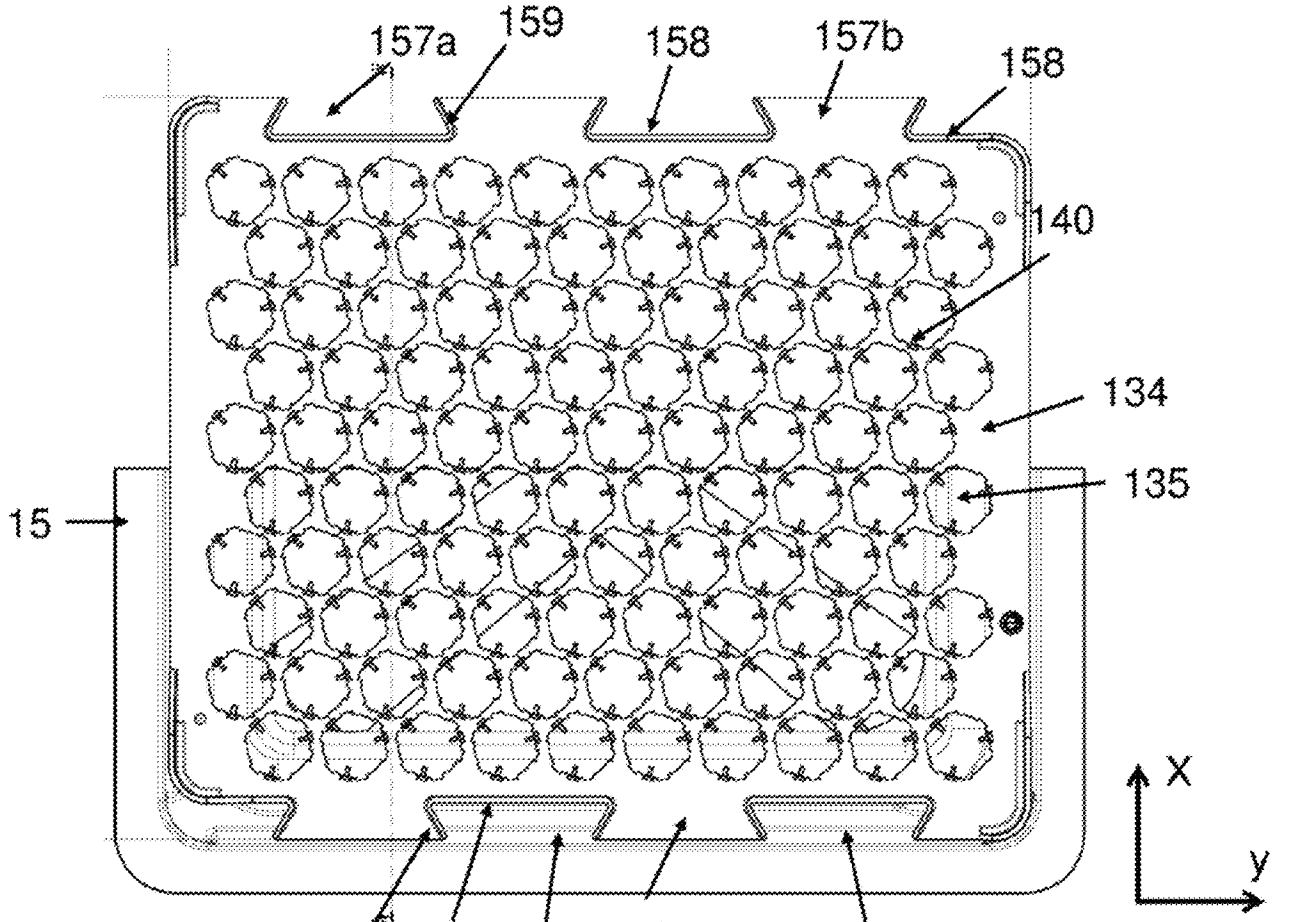

As can be seen from the plan view of FIG. 19*b*, two supporting structures can be hooked together so that these are aligned in the transverse direction (x). For this purpose, the recess 157*a* is formed only in half in the lower corner region of the holding plate 134 on the right-hand side. In the opposite upper right-hand side corner region of the supporting plate 134, however, the corresponding protrusion 157*b* is also formed only half and merges into a rounded corner of the supporting plate 134.

By means of the aforementioned configuration of the protrusions 157*b* and recesses 157*a*, however, in general two supporting structures can be also interlocked with each other so that these are displaced relative to each other in the transverse direction (x), i.e. they are not aligned.

For hooking or interlocking two supporting structures, one of the supporting structures can be lifted by means of a lifting device in a direction perpendicular to the plane of the supporting plate 134. Subsequently, the two supporting structures are moved towards each other until finally, if viewed in a plan view, the protrusions 157*b* and recesses 157*a* of the adjacent supporting structures overlap each other. By a subsequent lowering of the supporting plate 134 perpendicular to the plane of the supporting plate 134 finally the protrusions 157*b* and recesses 157*a* engage with each other in a positive-fit manner. This procedure can be done manually but also fully automatic or semi-automatic. Here, the supporting plates 134 may be already equipped with vials. In general, however, the loading of the supporting plates 134 with vials can also only take place when the supporting plates 134 are coupled with each other.

Because of the above configuration of the protrusions 157*b* and recesses 157*a* overall an interlocking cooperation in the manner of a dovetail joint is implemented. As will be readily apparent to the person skilled in the art upon reading the foregoing description, in principle, any other positive-fit or frictional coupling techniques can be used for a temporary releasable coupling of two supporting structures.

As can be concluded from the perspective top view of FIG. 19*a*, side walls 158, 159 are at least partially formed along the edges of the protrusions 157*b* and recesses 157*a* which project perpendicularly from the surface of the supporting plate 134. These side walls 158, 159 follow the contour of the associated recess 157*a* and protrusion 157*b*, respectively, and act as stop and guide surfaces, which prevent that the supporting plates 134 slide over each other. More specifically, as shown in FIG. 19*b*, a sidewall 158 is formed along the front side of the protrusions 157*b* at the upper edge of the supporting plate 134, which is followed by a side wall 159 in the region of the adjacent recess 157*a*, which does not extend over the entire depth of the recesses (in the x-direction). At the opposite bottom edge of the supporting plate 134, however the side walls 158 are formed along the base of the recesses 157*a*, while the angled side walls 159*a* extend along the angled sides of the recesses 157*a*, but not over their entire depth (in the x direction).

Figure 19C:
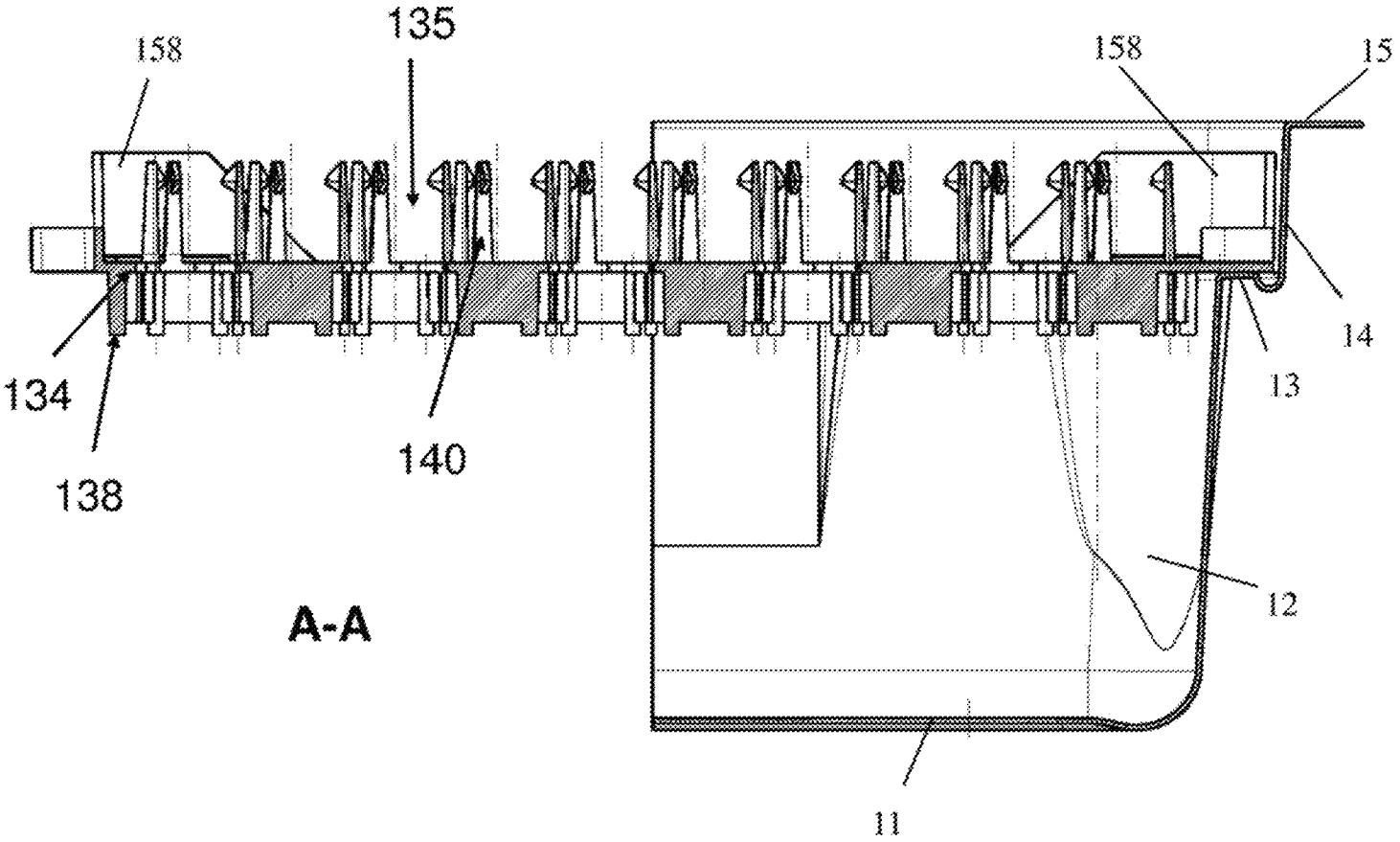

As shown in the largely enlarged partial plan view of FIG. 19*c*, the side walls 158*a* of the lower supporting plate 134*a* directly abut the side walls 158*b* of the upper supporting plate 134*b*. Furthermore, also the angled side walls 159*b* of the upper supporting plate 134*b* directly abut the angled side walls 159*a* of the lower supporting plate 134*a*.

Figure 19D:
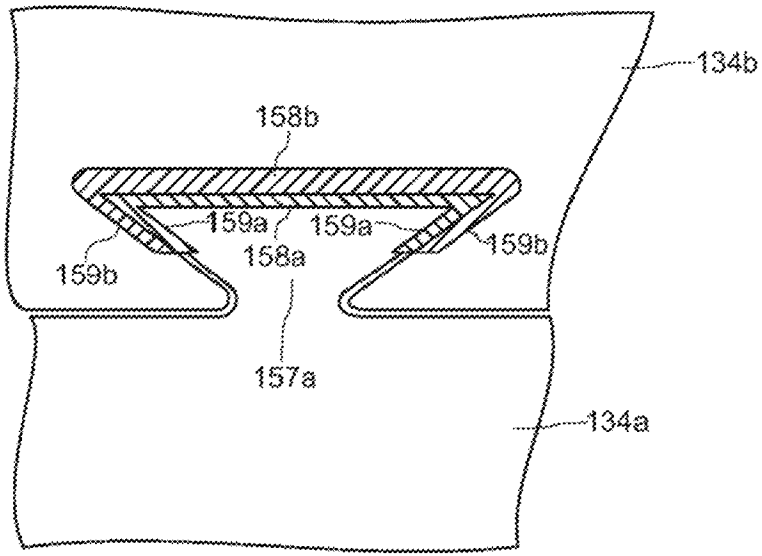
Figure 19F:
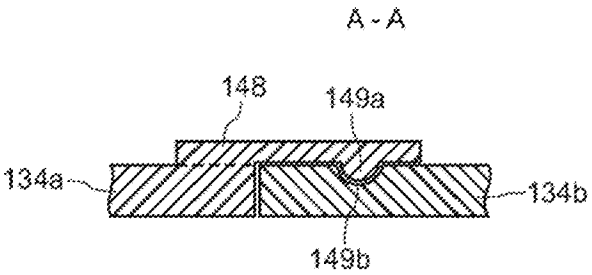
Figure 19E:
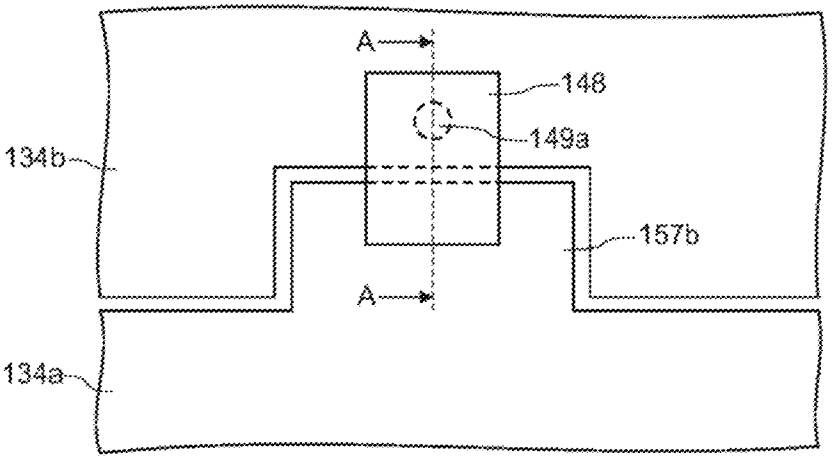

As a further example for a positive-fit coupling FIG. 19*d* shows in a largely enlarged partial plan view the coupling of two supporting plates 134*a*, 134*b* according to a further embodiment. According to FIG. 19*d* elastic tongues 148 protrude perpendicularly from the rectangular-shaped protrusions 157*b* of the lower supporting plate 134*a* in the direction of the associated recess of the upper supporting plate 134*b*. As can be concluded from the partial sectional view of FIG. 19*e* along line A-A of FIG. 19*d*, the resilient tongue protrudes from the plane spanned by the supporting plates 134*a*, 134*b*, but extends in parallel with them. At the front end of the resilient tongue 148, a spherical protrusion 149*a* is formed, which engages in a corresponding receptacle 149*b* on the upper side of the upper supporting plate 134*b*. The supporting plates 134*a*, 134*b* can be displaced toward one another for the coupling, until the front end of the resilient tongue 148 having the protrusion 149*a* finally gets in contact with the upper side of the upper supporting plate 134*b*. Upon further approach of the two supporting plates 134*a*, 134*b*, finally, the resilient tongue 148 is bent upwards so that the protrusion 149*a* slides along the surface of the upper supporting plate 134*b*, until it finally passes into the region of the receptacle 149*b* and is pressed into the latter due to the resilient force of the resilient tongue 148. The elasticity of the tongues 148 and the design of the positive-fit structures 149*a*, 149*b* define in a simple manner the strength of the releasable coupling between the two supporting plates 134*a*, 134*b*. For preventing a sliding of the two supporting plates 134*a*, 134*b*, also in this embodiment stop and guide surfaces can be provided, in particular in the form of side walls projecting perpendicularly from the upper side of the supporting plates 134*a*, 134*b*, as described above with reference to FIG. 19*a*. In the embodiment of FIG. 19*d* such side walls would be disposed particularly laterally next to the resilient tongues 148.

As will be readily apparent to the person skilled in the art upon reading the foregoing description, the aforementioned aspect of the positive-fit or frictional coupling between directly adjacent supporting structures is in principle independent from the specific configuration of the supporting of the vials in such supporting structures, so that this aspect in principle may also be claimed as an independent aspect of the present invention, regardless of the specific implementation of the supporting of the vials at such supporting structures.

The process according to the present invention is based essentially on the fact that a plurality of containers are supported together on a carrier and can be treated or processed further, while they are supported on the carrier or at least guided by the carrier. As will readily apparent to the person skilled in the art upon reading the foregoing description, this approach is generally suitable for any process steps for the treatment or processing of containers for the storage of substances for cosmetic, medical or pharmaceutical applications.

The holding force respectively exerted by the frictional-type or positive-fit-type holding means on the containers is sufficient to hold the containers reliably on the supporting structure. Particularly, the holding force applied is greater than the weight of the containers, optionally including the content and a sealing stopper. According to further embodiments, the holding force can be configured by means of an appropriate design of the holding means such that it is greater than the standard forces during handling, processing or treatment of the containers in a processing apparatus. Thereby a reliable holding of the containers is always ensured. However, according to further preferred embodiments of the invention the containers are displaced in the openings or receptacles despite the holding force, in particular displaced in axial direction or rotated. The force required for this only needs to be greater than the force exerted by the holding means.

For inserting, removing or displacing the containers on a carrier this holding force must first be overcome. This has the advantage that the containers continue to be reliably held on the carrier and do not fall over accidentally if a small force is applied, such as caused by shocks to the processing apparatuses or to conveying devices of the same. This reduces the risk of undesired impurities in processing apparatuses considerably. As an example, plugs inserted into the openings of containers frequently stick in the course of treatment and cannot be displaced thereafter without shaking, e.g. for sealing a container or for opening it. Conventionally, this has often resulted in a falling over of containers and in an undesirable leakage of substances in processing apparatuses. Since according to the present invention the containers are supported with a predetermined minimum holding force on the carriers, this risk is greatly minimized in a process according to the present invention.

Conventionally, therefore, elastic plugs or similar closure members have been provided with an anti-friction coating, resulting in undesired impurities. According to the present invention, generally one can work without such anti-friction coatings, so that active agents can be processed and treated in an even purer form by a process according to the present invention.

Of course, the supporting structure (the carrier) in the sense of the present invention may also be formed of a thermoplastic, thermosetting or elastomeric plastic material, wherein at least portions of the supporting structure or of the carrier are provided with a coating reducing friction to facilitate the insertion and removal of the containers.

According to a further embodiment, the supporting structure and/or transport container, or portions thereof, may be formed of fiber reinforced plastics or of a plastic to which ceramics or metals are added in order to increase its thermal conductivity. As is known, fiber reinforced plastics have a higher thermal conductivity of up to 0.9 W/(m K) if including carbon fibers. If ceramics or metals are added to the plastics, the thermal conductivity is further increased. Thus so-called heat-conductive plastics are created. Thus, a thermal conductivity of 20 W/(m K) is accomplished.

As will be readily apparent to the person skilled in the art upon reading the above description, the various aspects and features of the embodiments described above may be combined in any manner with one another, resulting in numerous further embodiments and modifications. As will be readily apparent to the person skilled in the art upon reading the above description, all such further embodiments and modifications shall be comprised by the present invention, as long as these do not depart from the general solution and scope of the present invention, as defined in the appended claims.

What is claimed is:

1. A process for the treatment or processing of containers, which serve for storing substances for medical, pharmaceutical or cosmetic applications or contain such substances, wherein the containers are conveyed automatically, by a conveyor, to processing stations or pass them for the treatment or processing, in which process a plurality of containers are conveyed by the conveyor while the containers are supported by a supporting structure in a regular two-dimensional array, wherein the supporting structure comprises a plurality of openings or receptacles, which define the regular array, and the treatment or processing of the containers at or in at least one of the processing stations is carried out while the containers are supported by said supporting structure or while the containers are accommodated in openings or receptacles of said supporting structure, in which process a metal lid is crimped on the upper rim of the containers by a crimping device, wherein the containers are displaced in the respective opening or receptacle in an axial direction to a raised position to be crimped and are rotated about a longitudinal axis thereof in said raised position while the containers are accommodated in the openings or receptacles of the supporting structure, and are pushed back into the openings or receptacles to be supported by said supporting structure.

2. The process according to claim 1, wherein for said crimping the containers are lifted by a lifting rod into the raised position, wherein the containers are rotated about the longitudinal axis in said raised position by a turntable and wherein the respective turntable is supported on the lifting rod and wherein the upper rims of the containers together with the metal lids placed thereon are centered during rotation by centering discs.

3. The process according to claim 1, wherein the containers continue to be accommodated in the openings or receptacles in the raised position of the supporting structure, however, are supported on an additional supporting surface or by an additional holding or gripping device to be treated or processed at or in the processing station.

4. The process according to claim 3, wherein the additional supporting surface comprises at least one rotatable and driven turntable on which the containers are rotated while being treated or processed at or in the processing station and while the containers are accommodated in the openings or receptacles of the supporting structure.

5. The process according to claim 1, further comprising a holding device associated with the openings or receptacles of the supporting structure, which hold the plurality of containers on the supporting structure at the predetermined positions and in the two-dimensional array, wherein said holding device supports the containers on the supporting structure in a positive-fit manner.

6. The process of claim 5, wherein the supporting structure comprises a plurality of mutually-associated transverse webs extending in parallel with each other and spaced apart from each other at regular intervals, along which a plurality of pairs of resilient, concavely shaped holding arms are disposed which positively fix the upper rims of the containers accommodated by a pair of opposite holding arms, wherein the containers are inserted into or retracted from the holding arms while spreading the holding arms.

7. The process of claim 5, wherein the holding device comprises at least two resilient holding tongues, which are disposed at a rim of the respective opening or receptacle and protrude from an upper side of the supporting structure for supporting the respective container, wherein the holding tongues are resiliently pivoted or clapped away when the containers are inserted into the openings or receptacles and wherein the holding tongues support the containers with a radial play.

8. The process of claim 7, wherein the holding tongues support the containers such that the containers rest loosely on upper sides of the holding tongues with an upper rim formed at an upper end of the containers.

9. The process of claim 7, wherein the holding tongues embrace an expanded rim formed at an upper end of the containers such that the containers are supported by the holding tongues with a radial play or with a radial and axial play.

10. The process of claim 9, further comprising slanted insertion surfaces are formed at upper ends of the holding tongues each of which pass into a holding nose protruding inwards from the holding tongues for supporting the containers.

11. The process according to claim 1, further comprising a holding device associated with the openings or receptacles of the supporting structure, which hold the plurality of containers on the supporting structure at the predetermined positions and in the two-dimensional array, wherein said holding device is configured for holding the containers on the supporting structure by friction.

12. The process of claim 11, wherein the holding device is formed as circumferential receptacles extending in the longitudinal direction of the containers and wherein side wall portions of the containers are embraced at least partially to accomplish said friction.

13. The process of claim 12, wherein the receptacles have a polygonal cross-section, wherein the frictional engagement is accomplished by the interaction of opposing side walls of said receptacles and the cylindrical side walls of the containers, wherein the side walls of the receptacles are formed of an elastic plastic or are coated or provided with such an elastic plastic, and wherein all side walls of the openings or receptacles can be adjusted in a coordinated manner all-together between a first position and a second position, wherein, in the first position, the containers can be inserted with little force into the openings or receptacles or can be displaced therein, and wherein, in the second position, the containers are fixed by friction.

14. The process according to claim 1, further comprising webs or side walls between the openings or receptacles of the supporting structures prevent a direct contact of adjacent containers, which are accommodated therein.

15. An apparatus for the treatment or processing of containers, which serve for storing substances for medical, pharmaceutical or cosmetic applications or contain such substances, said apparatus comprising:

a conveying device;

a plurality of processing stations, wherein the respective containers are treated or processed in or at a respective processing station;

said apparatus being configured for the treatment or processing of the containers such that a plurality of containers are conveyed automatically, by said conveying device, to said processing stations or pass them to be treated or processed while the containers are supported by a supporting structure in a regular two-dimensional array, said supporting structure having a plurality of openings or receptacles, which together determine the regular array, said apparatus further comprising a crimping device, where a metal lid is crimped on the upper rim of the containers, said apparatus being configured such that the containers are displaced in a longitudinal direction to a raised position while the containers are in the respective opening or receptacle to be crimped and are rotated about a longitudinal axis in said raised position while the containers are accommodated in the openings or receptacles of the supporting structure, and are pushed back into the openings or receptacles after said crimping.

16. The apparatus according to claim 15, which is further configured such that the treatment or processing of the containers is carried out at or in the respective processing station while the containers are supported by a supporting structure.

* * * * *